US009365031B2

(12) United States Patent
Koga

(10) Patent No.: US 9,365,031 B2
(45) Date of Patent: Jun. 14, 2016

(54) INKJET RECORDING DEVICE AND INKJET HEAD HEAD-MODULE REPLACING METHOD

(71) Applicant: FUJIFILM Corporation, Tokyo (JP)

(72) Inventor: Takehiko Koga, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 14/940,826

(22) Filed: Nov. 13, 2015

(65) Prior Publication Data

US 2016/0096365 A1 Apr. 7, 2016

Related U.S. Application Data

(63) Continuation of application No. PCT/JP2014/062841, filed on May 14, 2014.

(30) Foreign Application Priority Data

May 15, 2013 (JP) ..... 2013-103016

(51) Int. Cl.
*B41J 29/38* (2006.01)
*B41J 2/045* (2006.01)

(52) U.S. Cl.
CPC ..... *B41J 2/04505* (2013.01); *B41J 2/04586* (2013.01)

(58) Field of Classification Search
CPC .... B41J 2/1621; B41J 2/2132; B41J 2/04505; B41J 2/04506
See application file for complete search history.

(56) References Cited

U.S. PATENT DOCUMENTS 5,903,289 A * 5/1999 Takayanagi ..... B41J 2/2132 347/13
6,367,903 B1 * 4/2002 Gast ..... B41J 2/04505 347/19

(Continued)

FOREIGN PATENT DOCUMENTS

JP 2001-330720 A 11/2001
JP 2007-021834 A 2/2007

(Continued)

OTHER PUBLICATIONS

International Search Report and Written Opinion of the International Searching Authority, PCT/JP2014/062841, Jul. 15, 2014.

*Primary Examiner* — Julian Huffman
*Assistant Examiner* — Sharon A Polk
(74) *Attorney, Agent, or Firm* — Studebaker & Brackett PC

(57) ABSTRACT

A base frame, which supports head modules, is provided with a first storage device that stores information about the positions of support reference points of the head modules. The head module is provided with a second storage device that stores information about the positions of nozzles of the head module. An inkjet recording device is provided with a third storage device that stores information about the positions of the nozzles of the respective head modules provided on the base frame. When the head module is replaced, information about the correction of a position, which is required to mount the replaced head module at a normal position, is generated based on the information stored in the first storage device, the information stored in the second storage device, and the information stored in the third storage device. The mounting position of the replaced head module is corrected based on the generated information.

20 Claims, 23 Drawing Sheets

(56) References Cited

U.S. PATENT DOCUMENTS

| | | | | |
|---|---|---|---|---|
| 2002/0044163 | A1 | 4/2002 | Shigemura | |
| 2005/0285889 | A1 * | 12/2005 | McGarry | B41J 2/04505 347/9 |
| 2007/0285449 | A1 * | 12/2007 | Ikemoto | B41J 2/04505 347/12 |
| 2011/0216128 | A1 | 9/2011 | Saito | |

FOREIGN PATENT DOCUMENTS

| | | | |
|---|---|---|---|
| JP | 2010-064466 | A | 3/2010 |
| JP | 2011-183619 | A | 9/2011 |
| JP | 2012-000930 | A | 1/2012 |
| JP | 2012-161992 | A | 8/2012 |

* cited by examiner

INKJET RECORDING DEVICE AND INKJET HEAD HEAD-MODULE REPLACING METHOD

CROSS-REFERENCE TO RELATED APPLICATIONS

The present application is a Continuation of PCT International Application No. PCT/JP2014/062841 filed on May 14, 2014 claiming priority under 35 U.S.C §119(a) to Japanese Patent Application No. 2013-103016 filed on May 15, 2013. Each of the above applications is hereby expressly incorporated by reference, in their entirety, into the present application.

BACKGROUND OF THE INVENTION

1. Field of the Invention

The present invention relates to a method of replacing a head module of an inkjet head that includes a plurality of head modules joined in a line (including zigzag arrangement).

2. Description of the Related Art

A method of manufacturing a long inkjet head by preparing a plurality of standardized short inkjet heads (head modules) and joining the short inkjet heads in a line is known. The yield of an inkjet head, which is manufactured in this way, is higher than that of an inkjet head, which is formed of a single body having the same length as the inkjet head, and the head modules can be replaced as a unit. For this reason, there is an advantage in that the inkjet head can be used economically.

Meanwhile, when the respective head modules are not accurately joined, there is a problem in that stripes and unevenness are generated at joints of this kind of inkjet head and a high quality image cannot be recorded. For this reason, whenever a head module is replaced, the adjustment of the position of the head module is performed in this kind of inkjet head.

Generally, the adjustment of the position of the head module is performed by detecting a distance between adjacent head modules and adjusting the position of the head module so that the distance is within an allowable range (for example, JP2001-330720A and the like). Further, a method of printing a test pattern and obtaining the distance between adjacent head modules from the result of the printing of the test pattern is generally employed. Alternatively, a method of imaging a nozzle face by an electronic camera and obtaining the distance between adjacent head modules from obtained image data is employed.

SUMMARY OF THE INVENTION

However, in the method of performing the adjustment of the position of the head module through the printing of a test pattern, a test pattern should be printed whenever a head module is replaced. For this reason, there is a drawback in that a lot of time is required for replacement work. Likewise, even in the method of performing the adjustment of the position of the head module through the imaging of a nozzle face using an electronic camera, the nozzle face should be imaged whenever a head module is replaced. For this reason, there is a drawback in that a lot of time is required for replacement work.

Further, in the method of performing the adjustment of the position of the head module through the printing of a test pattern, there is a drawback in that the inkjet recording device separately requires means for reading the printed test pattern (for example, scanner). Likewise, in the method of performing the adjustment of the position of the head module through the imaging of a nozzle face using an electronic camera, there is a drawback in that the inkjet recording device separately requires the electronic camera.

Furthermore, in the method of detecting a distance between adjacent head modules through the printing of a test pattern, the test pattern needs to be printed whenever a head module is replaced. For this reason, there is a drawback in that ink and media are consumed.

The invention has been made in consideration of the above-mentioned circumstances, and an object of the invention is to provide an inkjet recording device for which work for replacing a head module can be simply performed and a method of replacing a head module of an inkjet head.

Means for solving the problem is as follows:

According to a first aspect, there is provided an inkjet recording device including: an inkjet head including a base frame, a plurality of support devices that are provided on the base frame at regular intervals, a plurality of head modules that are joined in a line (including zigzag arrangement other than linear arrangement) by being mounted on the base frame through the support devices, a plurality of position adjusting devices configured to individually adjust the positions of the head modules mounted on the base frame, and a plurality of position detecting devices configured to individually detect the positions of the head modules, which are mounted on the base frame, relative to support reference points that are set at the respective support devices and serve as references; a first storage device which is provided on the base frame and in which information about the positions of the respective support reference points is stored; second storage devices which are provided in the respective head modules and in which information about the positions of nozzles of the head modules is stored; a third storage device in which information about the positions of the nozzles of the respective head modules mounted on the base frame is stored; and a position-correction-information generating device configured to generate information about the correction of a position, which is required to mount the replaced head module at a normal position, based on the information stored in the first storage device, the information stored in the second storage devices, and the information stored in the third storage device when the head module is replaced.

According to this aspect, the first storage device is provided on the base frame. The information about the positions of the support reference points, which are set at the respective support devices, is stored in the first storage device. Further, the second storage devices are provided in the respective head modules. The information about the positions of the nozzles of the head modules in which the second storage devices are provided is stored in the second storage devices. Furthermore, the inkjet recording device is provided with the third storage device. The information about the positions of the nozzles of the respective head modules mounted on the base frame (the positions of the nozzles on the base frame) is stored in the third storage device. When the head module is replaced, the position-correction-information generating device acquires the information stored in the first storage device, the information stored in the second storage devices, and the information stored in the third storage and generates the information about the correction of a position that is required to mount the replaced head module at a normal position. That is, the position-correction-information generating device can determine the position of the replaced head module on the base frame by acquiring the information about the position of the support reference point of the support device supporting the replaced head module, and can determine the positions of the nozzles of the replaced head module on the base frame by acquiring the information about the positions of the nozzles of the replaced head module. Further, the position-correction-information generating device can acquire the information about the positions of the nozzles (the positions of the nozzles on the base frame) of the head modules, which are adjacent to the replaced head module, by acquiring the information about the positions of the nozzles (the positions of the nozzles on the base frame) of the respective head modules, which are mounted on the base frame, from the third storage device; and can determine the distances between the replaced head module and the head modules, which are adjacent to the replaced head module, by acquiring the information. Furthermore, the position-correction-information generating device can generate the information about the correction of the position, which is required to mount the replaced head module at the normal position, by determining the distances. That is, the position-correction-information generating device can generate the information about the correction of the position, which is required to mount the replaced head module at the normal position, by obtaining the amount of correction of the position of the head module that is required to allow the determined distances to be within an allowable range. Accordingly, it is possible to adjust the position of the replaced head module without printing a test pattern or imaging the nozzle face by an electronic camera.

Meanwhile, the positions of the support reference points, which are set at the respective support devices, are detected in advance (for example, at the time of manufacture, at the time of shipment from the factory, or the like), and are stored in the first storage device. Further, the positions of the nozzles of the respective head modules are also detected in advance, and are stored in the second storage devices. Furthermore, the positions of the nozzles of the respective head modules, which are mounted on the base frame, (the positions of the nozzles on the base frame) are detected after the mounting of the respective head modules on the base frame and the adjustment of the positions of the respective head modules, and are stored in the third storage device. In this case, for example, a test pattern is printed and the positions of the nozzles of the respective head modules are detected from the result of the printing of the test pattern. Alternatively, the nozzle face is imaged by an electronic camera and the positions of the nozzles of the respective head modules are detected from an obtained image. Since each piece of the information is acquired in advance as described above and is stored in the storage device, required information can be simply and quickly acquired. Accordingly, the information about correction can be quickly generated. The same applies to each of the following aspects.

Further, the information about the positions of the nozzles of the respective head modules does not necessarily need to be the information about the positions of all nozzles, and may be the information about the positions of the nozzles that are required for the adjustment of position. The information about the positions of the nozzles, which are required for the adjustment of position, is the information of the positions of nozzles that are positioned at both ends, for example, when the nozzles are arranged in a line. Furthermore, for example, when nozzles are arranged in the form of a matrix, the information about the positions of the nozzles, which are required for the adjustment of position, is the information about the positions of nozzles positioned at the outermost ends, the information about the positions of nozzles positioned at four corners, or the like. The same applies to each of the following aspects.

According to a second aspect, in the inkjet recording device of the first aspect, the position-correction-information generating device calculates the positions of nozzles of the replaced head module based on the information stored in the first storage device and the information stored in the second storage devices, acquires information about the positions of nozzles of the head modules adjacent to the replaced head module based on the information stored in the third storage device, and generates the information about the correction of the position, which is required to mount the replaced head module at the normal position, based on information about the positions of the nozzles of the replaced head module and the information about the positions of the nozzles of the head modules adjacent to the replaced head module.

According to this aspect, the positions of nozzles of the replaced head module are calculated based on the information stored in the first storage device and the information stored in the second storage devices, and the information about the positions of the nozzles of the head modules adjacent to the replaced head module is acquired based on the information stored in the third storage device. Then, the information about the correction of the position, which is required to mount the replaced head module at the normal position, is generated based on the obtained information. That is, the position-correction-information generating device can determine the position of the replaced head module on the base frame by acquiring the information about the position of the support reference point of the support device, which supports the replaced head module, from the first storage device, and can determine the positions of the nozzles of the replaced head module on the base frame by acquiring the information about the positions of the nozzles of the replaced head module from the second storage devices. Further, the position-correction-information generating device can acquire the information about the positions of the nozzles of the head modules, which are adjacent to the replaced head module, by referring to the information stored in the third storage device. Furthermore, the position-correction-information generating device can determine the distances between the replaced head module and the head modules, which are adjacent to the replaced head module, by acquiring these kinds of information, and can generate the information about the correction of the position, which is required to mount the replaced head module at the normal position, by determining the distances.

According to a third aspect, the inkjet recording device of the first or second aspect further includes: a nozzle position calculating device configured to acquire information about the position of the replaced head module from the position detecting device after the position of the replaced head module is adjusted to the normal position, and calculating the positions of the nozzles of the replaced head module based on the acquired information, the information stored in the first storage device, and the information stored in the second storage devices; and an updating device configured to acquire information about the positions of the nozzles calculated by the nozzle position calculating device and updating the information stored in the third storage device.

According to this aspect, when the adjustment of the position of the replaced head module is completed and the replaced head module is mounted at the normal position, the positions of the nozzles (the positions of the nozzles on the base frame) of the head module of which the position has been adjusted are obtained and the information stored in the third storage device is updated. Accordingly, it is possible to always keep the information, which is stored in the third storage device, up-to-date. The positions of the nozzles of the head module of which the position has been adjusted are calculated based on information that is obtained through the acquisition of the information of the position of the replaced head module from the position detecting device, the information that is stored in the first storage device, and the information that is stored in the second storage devices.

According to a fourth aspect, the inkjet recording device of the first or second aspect further includes: a nozzle position detecting device configured to detect the positions of the nozzles of the respective head modules mounted on the base frame; and an updating device configured to acquire the information about the positions of the nozzles of the respective head modules mounted on the base frame from the nozzle position detecting device after the position of the replaced head module is adjusted to the normal position, and updating the information stored in the third storage device.

According to this aspect, when the adjustment of the position of the replaced head module is completed and the replaced head module is mounted at the normal position, the positions of the nozzles of the respective head modules mounted on the base frame are detected by the nozzle position detecting device. Then, the information stored in the third storage device is updated with the detected information. Accordingly, it is possible to always keep the information, which is stored in the third storage device, up-to-date. The nozzle position detecting device prints a test pattern by, for example, the inkjet head of which the head module has been replaced, reads an obtained image of the test pattern by a scanner, and detects the positions of the nozzles based on the read image. Alternatively, the nozzle position detecting device images the nozzle face of the inkjet head, of which the head module has been replaced, by an electronic camera, and detects the positions of the nozzles based on an obtained image. The nozzle position detecting device may be mounted on the inkjet recording device or may be installed outside the inkjet recording device.

According to a fifth aspect, there is provided an inkjet recording device including: an inkjet head including a base frame, a plurality of support devices that are provided on the base frame at regular intervals, a plurality of head modules that are joined in a line (including zigzag arrangement other than linear arrangement) by being mounted on the base frame through the support devices, a plurality of position adjusting devices configured to individually adjust the positions of the head modules mounted on the base frame, and a plurality of position detecting devices configured to individually detect the positions of the head modules, which are mounted on the base frame, relative to support reference points that are set at the respective support devices and serve as references; a first storage device which is provided on the base frame and in which information about the positions of the respective support reference points is stored; second storage devices which are provided in the respective head modules and in which information about the positions of nozzles of the head modules is stored; and a position-correction-information generating device configured to generate information about the correction of a position, which is required to mount the replaced head module at a normal position, based on the information stored in the first storage device, the information stored in the second storage devices, and information about the positions of the head modules detected by the position detecting device when the head module is replaced.

According to this aspect, the first storage device is provided on the base frame. The information about the positions of the support reference points, which are set at the respective support devices, is stored in the first storage device. Further, the second storage devices are provided in the respective head modules. The information about the positions of the nozzles of the head modules in which the second storage devices are provided is stored in the second storage devices. When the head module is replaced, the position-correction-information generating device acquires the information stored in the first storage device, the information stored in the second storage devices, and the information about the positions of the head modules detected by the position detecting device and generates the information about the correction of a position that is required to mount the replaced head module at a normal position. That is, the position-correction-information generating device can determine the position of the replaced head module on the base frame by acquiring the information about the position of the support reference point of the support device supporting the replaced head module, and can determine the positions of the nozzles of the replaced head module on the base frame by acquiring the information about the positions of the nozzles of the replaced head module. Furthermore, the information about the positions of the nozzles (the information about the positions of the nozzles on the base frame) of the respective head modules mounted on the base frame can be acquired from the information about the positions of the respective support reference points, the information about the positions of the nozzles of the respective head modules, and the information about the positions of the head modules detected by the position detecting device. That is, the position-correction-information generating device can determine the positions of the respective head modules on the base frame from the information about the positions of the respective support reference points and the information about the positions of the head modules detected by the position detecting device, and can determine the positions of the nozzles of the respective head modules on the base frame by acquiring the information about the positions of the nozzles of the respective head modules. The position-correction-information generating device can determine the distances between the replaced head module and the head modules, which are adjacent to the replaced head module, by determining the positions of the nozzles of the respective head modules on the base frame. Then, the position-correction-information generating device can generate the information about the correction of a position, which is required to mount the replaced head module at a normal position, by acquiring the information about the distances. That is, the position-correction-information generating device can generate the information about the correction of the position, which is required to mount the replaced head module at the normal position, by obtaining the amount of correction of the position of the head module required for a position that allows the determined distances to be within an allowable range. Accordingly, it is possible to adjust the position of the replaced head module without printing a test pattern or imaging the nozzle face by an electronic camera.

According to a sixth aspect, in the inkjet recording device of the fifth aspect, the position-correction-information generating device calculates the positions of nozzles of the replaced head module based on the information stored in the first storage device and the information stored in the second storage devices, calculates the positions of nozzles of the head modules adjacent to the replaced head module based on the information stored in the first storage device, the information stored in the second storage devices, and the information detected by the position detecting device, and generates the information about the correction of the position, which is required to mount the replaced head module at the normal position, based on information about the positions of the nozzles of the replaced head module and the information about the positions of the nozzles of the head modules adjacent to the replaced head module.

According to this aspect, the positions of the nozzles of the replaced head module are calculated based on the information stored in the first storage device and the information stored in the second storage devices, and the information about the positions of the nozzles of the head modules, which are adjacent to the replaced head module, is calculated based on the information stored in the first storage device, the information stored in the second storage devices, and the information detected by the position detecting device. Then, the information about the correction of the position, which is required to mount the replaced head module at the normal position, is generated based on the obtained information. That is, the position-correction-information generating device can determine the position of the replaced head module on the base frame by acquiring the information about the position of the support reference point of the support device, which supports the replaced head module, from the first storage device, and can determine the positions of the nozzles of the replaced head module on the base frame by acquiring the information about the positions of the nozzles of the replaced head module from the second storage devices. Further, the position-correction-information generating device can determine the positions of the respective head modules on the base frame from the information about the positions of the respective support reference points and the information about the positions of the head modules detected by the position detecting device, and can determine the positions of the nozzles of the respective head modules on the base frame by acquiring the information about the positions of the nozzles of the respective head modules. The position-correction-information generating device can determine the distances between the replaced head module and the head modules, which are adjacent to the replaced head module, by determining the positions of the nozzles of the respective head modules on the base frame. Furthermore, the position-correction-information generating device can generate the information about the correction of the position, which is required to mount the replaced head module at the normal position, by acquiring the information about the distances.

According to a seventh aspect, in the inkjet recording device of any one of the first to sixth aspects, the position detecting device includes a detection target member that is provided in the head module and a sensor that is provided on the base frame and detects the displacement of the detection target member, and detects the displacement of the detection target member by the sensor and detects the position of the head module relative to the support reference point that serves as a reference.

According to this aspect, the position detecting device includes the detection target member that is provided in the head module and the sensor that is provided on the base frame. The position detecting device detects the displacement of the detection target member by the sensor, and detects the position of the head module relative to the support reference point serving as a reference.

For example, a combination of a magnetic sensor and a magnet, a combination of a laser distance sensor and an object to be irradiated with laser beams, a combination of an infrared distance sensor and object to be irradiated with infrared rays, a combination of an eddy current sensor and a detection object, and the like are considered as a combination of this kind of sensor and the detection target member. The same applies to the following aspects.

According to an eighth aspect, in the inkjet recording device of the seventh aspect, information, which is required to correct the sensitivity of the sensor when the sensor is used, is further stored in the first storage device as first sensor-sensitivity-correction information, and information, which is required to correct the sensitivity of the sensor when the detection target member is used, is further stored in the second storage devices as second sensor-sensitivity-correction information. The inkjet recording device further includes a sensor-sensitivity correcting device configured to acquire the first sensor-sensitivity-correction information and the second sensor-sensitivity-correction information and correcting the sensitivity of the sensor.

According to this aspect, the sensor-sensitivity correcting device configured to correct the sensitivity of the sensor is further provided, and corrects the sensitivity of the sensor based on the first sensor-sensitivity-correction information (the information that is required to correct the sensitivity of the sensor when the sensor is used) stored in the first storage device and the second sensor-sensitivity-correction information (the information that is required to correct the sensitivity of the sensor when the detection target member is used is the second sensor-sensitivity-correction information) stored in the second storage devices. Since each head module is standardized, every head module can also be mounted at every position (the mounting position is not limited). Meanwhile, the sensitivity of the sensor changes slightly according to a combination of the sensor and a detection target member to be used, the mounting position of the sensor, or the like. Accordingly, it is necessary to correct the sensitivity of the sensor to perform detection with higher accuracy. According to this aspect, since it is possible to appropriately correct sensitivity even though the sensor and the detection target member may be used in the form of any combination, it is possible to perform position detection with higher accuracy. Accordingly, it is possible to perform positioning with higher accuracy. Further, since the first sensor-sensitivity-correction information is stored in the first storage device provided on the base frame and the second sensor-sensitivity-correction information is stored in the second storage devices provided on the respective head modules, it is possible to simply and reliably acquire information that is required for correction.

According to a ninth aspect, the inkjet recording device of the seventh aspect further includes: a first detection target member-sensitivity measuring jig that is used to measure the sensitivity of the detection target member; a second detection target member-sensitivity measuring jig that is used to measure the sensitivity of the detection target member; a first sensor-sensitivity measuring jig that is used to measure the sensitivity of the sensor; a second sensor-sensitivity measuring jig that is used to measure the sensitivity of the sensor; and a sensor-sensitivity setting device configured to set the sensitivity of the sensor. When sensitivity data, which is acquired by using the first detection target member-sensitivity measuring jig and the first sensor-sensitivity measuring jig, is defined as reference data ST, sensitivity data, which is acquired by using the first sensor-sensitivity measuring jig and the second detection target member-sensitivity measuring jig, is defined as characteristic data AT of the second detection target member-sensitivity measuring jig, sensitivity data, which is acquired by using the first detection target member-sensitivity measuring jig and the second sensor-sensitivity measuring jig, is defined as characteristic data BT of the second sensor-sensitivity measuring jig, sensitivity data of the detection target member, which is acquired by using the second detection target member-sensitivity measuring jig, is defined as temporary sensitivity data MM (temporary) of the detection target member, sensitivity data of the sensor, which is acquired by using the second sensor-sensitivity measuring jig, is defined as temporary sensitivity data MS (temporary) of the sensor, data, which is obtained by correcting the temporary sensitivity data MM (temporary) of the detection target member based on the reference data ST and the characteristic data AT, is defined as detection target member-sensitivity information MM, and data, which is obtained by correcting the temporary sensitivity data MS (temporary) of the sensor based on the reference data ST and the characteristic data BT, is defined as sensor-sensitivity information MS, the sensor-sensitivity information MS is further stored in the first storage device, the detection target member-sensitivity information MM is further stored in the second storage devices, and the sensor-sensitivity setting device acquires the sensor-sensitivity information MS from the first storage device, acquires the detection target member-sensitivity information MM from the second storage devices, and sets the sensitivity of the sensor based on the sensor-sensitivity information MS, the detection target member-sensitivity information MM, and the reference data ST.

According to this aspect, the sensitivity of the sensor and the sensitivity of the detection target member are measured by using dedicated measuring jigs, and information based on the result of the measurement is stored in the first storage device and the second storage devices as the sensor-sensitivity information MS and the detection target member-sensitivity information MM. When the head module is replaced, the sensor-sensitivity information MS and the detection target member-sensitivity information MM are acquired from the first storage device and the second storage devices and the sensitivity of the sensor is set based on the obtained information. Accordingly, since the variation of the sensitivity of each of the sensor and the detection target member can be absorbed, detection with high accuracy can be performed even when the combination of the sensor and the detection target member is changed.

According to a tenth aspect, the inkjet recording device of the ninth aspect further includes a temperature detecting device and a sensor-sensitivity correcting device configured to correct the sensitivity of the sensor based on information about temperature detected by the temperature detecting device.

According to this aspect, the sensitivity of the sensor is further corrected based on the information about temperature. The sensitivity of the sensor changes slightly according to temperature. Accordingly, it is preferable to correct the sensitivity of the sensor according to the temperature of the usage environment in order to perform detection with higher accuracy. According to this aspect, the information about the temperature of the usage environment of the sensor is acquired and the sensitivity of the sensor is further corrected. Accordingly, it is possible to perform position detection with higher accuracy. Meanwhile, in this case, for example, the sensor-sensitivity correcting device has the information about the correction of sensitivity corresponding to temperature (for example, a function for correction, a table for correction), and corrects the sensitivity of the sensor with reference to the information about correction.

According to an eleventh aspect, in the inkjet recording device of any one of the first to tenth aspects, the position adjusting device includes a positioning reference pin that is provided on the base frame, an eccentric roller that is provided on the head module, and a biasing device that is provided on the head module, is engaged with the positioning reference pin, and allows the eccentric roller to come into pressure contact with the positioning reference pin; and moves the head module to the mounting position of the head module by rotating the eccentric roller that comes into pressure contact with the positioning reference pin.

According to this aspect, the position adjusting device includes the positioning reference pin that is provided on the base frame, the eccentric roller that is provided on the head module, and the biasing device that is provided on the head module. The position adjusting device moves the head module to the mounting position of the head module by rotating the eccentric roller that comes into pressure contact with the positioning reference pin. Accordingly, it is possible to simply and accurately perform the fine adjustment of the position of the head module.

According to a twelfth aspect, there is provided a method of replacing a head module of an inkjet head. The inkjet head includes a base frame, a plurality of support devices that are provided on the base frame at regular intervals, a plurality of head modules that are joined in a line (including zigzag arrangement other than linear arrangement) by being mounted on the base frame through the support devices, a plurality of position adjusting devices configured to individually adjust the positions of the head modules mounted on the base frame, and a plurality of position detecting devices configured to individually detect the positions of the head modules, which are mounted on the base frame, relative to support reference points that are set at the respective support devices and serve as references. The method includes: a step of acquiring information about the position of the support reference point of the support device, which supports the replaced head module, as first information; a step of acquiring information about the positions of nozzles of the replaced head module as second information; a step of acquiring information about the positions of the nozzles of the respective head modules, which are mounted on the base frame, as third information; a step of generating information about the correction of a position, which is required to mount the replaced head module at a normal position, based on the first information, the second information, and the third information; and a step of adjusting the position of the replaced head module according to the generated information about the correction of the position.

According to this aspect, the information (first information) about the position of the support reference point of the support device supporting the replaced head module, the information (second information) about the positions of the nozzles of the replaced head module, and the information (third information) about the positions of the nozzles of the respective head modules mounted on the base frame are acquired; and the information about the correction of a position, which is required to mount the replaced head module at a normal position, is generated based on these kinds of information. Then, the position of the replaced head module is adjusted according to the generated information about the correction of the position. It is possible to determine the position of the replaced head module on the base frame by acquiring the information (first information) about the position of the support reference point of the support device supporting the replaced head module, and to determine the positions of the nozzles of the replaced head module on the base frame by acquiring the information (second information) about the positions of the nozzles of the replaced head module. Further, it is possible to acquire the information about the positions of the nozzles (the positions of the nozzles on the base frame) of the head modules, which are adjacent to the replaced head module, by acquiring the information (third information) about the positions of the nozzles of the respective head modules mounted on the base frame. Then, it is possible to determine the distances between the replaced head module and the head modules, which are adjacent to the replaced head module, by acquiring this information. Further, it is possible to generate the information about the correction of the position, which is required to mount the replaced head module at the normal position, by determining the distances. That is, it is possible to generate the information about the correction of the position, which is required to mount the replaced head module at the normal position, by obtaining the amount of correction of the position of the head module that is required to allow the determined distances to be within an allowable range. Accordingly, it is possible to adjust the position of the replaced head module without printing a test pattern or imaging the nozzle face by an electronic camera.

According to a thirteenth aspect, in the method of replacing a head module of an inkjet head of the twelfth aspect, the step of generating the information about the correction of a position, which is required to mount the replaced head module at a normal position, based on the first information, the second information, and the third information calculates the positions of nozzles of the replaced head module based on the first information and the second information, acquires information about the positions of nozzles of the head modules adjacent to the replaced head module based on the third information, and generates the information about the correction of the position, which is required to mount the replaced head module at the normal position, based on information about the positions of the nozzles of the replaced head module and the information about the positions of the nozzles of the head modules adjacent to the replaced head module.

According to this aspect, the positions of the nozzles of the replaced head module are calculated based on the first information and the second information, and the information about the positions of the nozzles of the head modules adjacent to the replaced head module are acquired based on the third information. Then, the information about the correction of the position, which is required to mount the replaced head module at the normal position, is generated based on the obtained information.

According to a fourteenth aspect, in the method of replacing a head module of an inkjet head of the twelfth or thirteenth aspect, the base frame includes a first storage device in which information about the positions of the respective support reference points is stored, the respective head modules include second storage devices in which information about the positions of the nozzles of the head modules is stored, an inkjet recording device on which the inkjet head is mounted or the base frame includes a third storage device in which information about the positions of the nozzles of the respective head modules mounted on the base frame is stored, the first information is acquired from the first storage device, the second information is acquired from the second storage devices, and the third information is acquired from the third storage device.

According to this aspect, the base frame is provided with first storage device, and the information about the positions of the respective support reference points is stored in the first storage device. Further, the respective head modules are provided with second storage devices, and the information about the positions of the nozzles of the head modules is stored in the second storage devices. Furthermore, an inkjet recording device on which the inkjet head is mounted or the base frame is provided with a third storage device, and the information about the positions of the nozzles of the respective head modules mounted on the base frame is stored in the third storage device. The first information is acquired from the first storage device, the second information is acquired from the second storage devices, and the third information is acquired from the third storage device. Since each piece of the information is acquired in advance as described above and is stored in the storage device, required information can be simply and quickly acquired. Accordingly, the information about correction can be quickly generated.

According to a fifteenth aspect, the method of replacing a head module of an inkjet head of the fourteenth aspect further includes a step of acquiring information about the position of the replaced head module from the position detecting device after adjusting the position of the replaced head module according to the generated information about the correction of the position, calculating the positions of the nozzles of the replaced head module based on the acquired information, the information stored in the first storage device, and the information stored in the second storage devices, and updating the information, which is stored in the third storage device, with the calculated information.

According to this aspect, when the adjustment of the position of the replaced head module is completed and the replaced head module is mounted at the normal position, the positions of the nozzles (the positions of the nozzles on the base frame) of the head module of which the position has been adjusted are obtained and the information stored in the third storage device is updated. Accordingly, it is possible to always keep the information, which is stored in the third storage device, up-to-date.

According to a sixteenth aspect, the method of replacing a head module of an inkjet head of the fourteenth aspect further includes a step of detecting the positions of the nozzles of the respective head modules mounted on the base frame after adjusting the position of the replaced head module according to the generated information about the correction of the position, and updating the information, which is stored in the third storage device, with the detected information.

According to this aspect, when the adjustment of the position of the replaced head module is completed and the replaced head module is mounted at the normal position, the positions of the nozzles of the respective head modules mounted on the base frame are detected by the nozzle position detecting device. Then, the information stored in the third storage device is updated with the detected information. Accordingly, it is possible to always keep the information, which is stored in the third storage device, up-to-date.

According to a seventeenth aspect, there is provided a method of replacing a head module of an inkjet head. The inkjet head includes a base frame, a plurality of support devices that are provided on the base frame at regular intervals, a plurality of head modules that are joined in a line (including zigzag arrangement other than linear arrangement) by being mounted on the base frame through the support devices, a plurality of position adjusting devices configured to individually adjust the positions of the head modules mounted on the base frame, and a plurality of position detecting devices configured to individually detect the positions of the head modules, which are mounted on the base frame, relative to support reference points that are set at the respective support devices and serve as references. The method includes: a step of acquiring information about the positions of the respective support reference points as first information; a step of acquiring information about the positions of nozzles of the respective head modules as second information; a step of acquiring information about the positions of the respective head modules, which are mounted on the base frame, from the position detecting device; a step of generating information about the correction of a position, which is required to mount the replaced head module at a normal position, based on the first information, the second information, and the information acquired from the position detecting device; and a step of adjusting the position of the replaced head module according to the generated information about the correction of the position.

According to this aspect, the information (first information) about the positions of the respective support reference points, the information (second information) about the positions of the nozzles of the respective head modules, and the information about the positions of the respective head modules mounted on the base frame are acquired; and the information about the correction of a position, which is required to mount the replaced head module at a normal position, is generated based on the acquired information. Then, the position of the replaced head module is adjusted according to the generated information about the correction of the position. It is possible to determine the position of the replaced head module on the base frame by acquiring the information (included in the first information) about the position of the support reference point of the support device supporting the replaced head module, and to determine the positions of the nozzles of the replaced head module on the base frame by acquiring the information (included in the second information) about the positions of the nozzles of the replaced head module. Further, the information about the positions of the nozzles (the information about the positions of the nozzles on the base frame) of the respective head modules mounted on the base frame can be acquired from the information (first information) about the positions of the respective support reference points, the information (second information) about the positions of the nozzles of the respective head modules, and the information about the positions of the head modules detected by the position detecting device. That is, it is possible to determine the positions of the respective head modules on the base frame from the information about the positions of the respective support reference points and the information about the positions of the head modules detected by the position detecting device, and to determine the positions of the nozzles of the respective head modules on the base frame by acquiring the information about the positions of the nozzles of the respective head modules. It is possible to determine the distances between the replaced head module and the head modules, which are adjacent to the replaced head module, by determining the positions of the nozzles of the respective head modules on the base frame. Then, it is possible to generate the information about the correction of a position, which is required to mount the replaced head module at a normal position, by acquiring the information about the distances. That is, it is possible to generate the information about the correction of the position, which is required to mount the replaced head module at the normal position, by obtaining the amount of correction of the position of the head module required for a position that allows the determined distances to be within an allowable range. Accordingly, it is possible to adjust the position of the replaced head module without printing a test pattern or imaging the nozzle face by an electronic camera.

According to an eighteenth aspect, in the method of replacing a head module of an inkjet head of the seventeenth aspect, the step of generating the information about the correction of a position, which is required to mount the replaced head module at a normal position, based on the first information, the second information, and the information acquired from the position detecting device calculates the positions of nozzles of the replaced head module based on the first information and the second information, calculates the positions of the nozzles of the head modules, which are adjacent to the replaced head module, based on the first information, the second information, and the information detected by the position detecting device, and generates the information about the correction of the position, which is required to mount the replaced head module at the normal position, based on information about the positions of the nozzles of the replaced head module and the information about the positions of the nozzles of the head modules adjacent to the replaced head module.

According to this aspect, the positions of the nozzles of the replaced head module are calculated based on the information stored in the first storage device and the information stored in the second storage devices, and the information about the positions of the nozzles of the head modules, which are adjacent to the replaced head module, is calculated based on the information stored in the first storage device, the information stored in the second storage devices, and the information detected by the position detecting device. Then, the information about the correction of the position, which is required to mount the replaced head module at the normal position, is generated based on the obtained information.

According to a nineteenth aspect, in the method of replacing a head module of an inkjet head of the seventeenth or eighteenth aspect, the base frame includes a first storage device in which information about the positions of the respective support reference points is stored, the respective head modules include second storage devices in which information about the positions of the nozzles of the head modules is stored, the first information is acquired from the first storage device, and the second information is acquired from the second storage devices.

According to this aspect, the base frame is provided with a first storage device, and the information about the positions of the respective support reference points is stored in the first storage device. Further, the respective head modules are provided with second storage devices, and the information about the positions of the nozzles of the head modules is stored in the second storage devices. The first information is acquired from the first storage device, and the second information is acquired from the second storage devices. Since each piece of the information is acquired in advance as described above and is stored in the storage device, required information can be simply and quickly acquired. Accordingly, the information about correction can be quickly generated.

According to a twentieth aspect, when the position detecting device includes a detection target member provided in the head module and a sensor provided on the base frame and detecting the displacement of the detection target member, detects the displacement of the detection target member by the sensor, and detects the position of the head module relative to the support reference point serving as a reference, the method of replacing a head module of an inkjet head of the fourteenth, fifteenth, sixteenth, or nineteenth aspect further includes: a step of acquiring information, which is required to correct the sensitivity of the sensor when the sensor is used, as first sensor-sensitivity-correction information; a step of acquiring information, which is required to correct the sensitivity of the sensor when the detection target member is used, as second sensor-sensitivity-correction information; and a step of correcting the sensitivity of the sensor based on the first sensor-sensitivity-correction information and the second sensor-sensitivity-correction information.

According to this aspect, the position detecting device includes the detection target member provided in the head module and the sensor provided on the base frame, detects the displacement of the detection target member by the sensor, and detects the position of the head module relative to the support reference point serving as a reference.

Further, according to this aspect, the first sensor-sensitivity-correction information (the information required to correct the sensitivity of the sensor when the sensor is used) and the second sensor-sensitivity-correction information (the information, which is required to correct the sensitivity of the sensor when the detection target member is used, is the second sensor-sensitivity-correction information) stored in the second storage devices are acquired during detection, and the sensitivity of the sensor is corrected based on the acquired information. Accordingly, since it is possible to appropriately correct sensitivity even though the sensor and the detection target member may be used in the form of any combination, it is possible to perform position detection with higher accuracy. Accordingly, it is possible to perform positioning with higher accuracy.

According to a twenty-first aspect, in the method of replacing a head module of an inkjet head of the twentieth aspect, the first sensor-sensitivity-correction information is further stored in the first storage device, the second sensor-sensitivity-correction information is further stored in the second storage devices, the first sensor-sensitivity-correction information is acquired from the first storage device, and the second sensor-sensitivity-correction information is acquired from the second storage devices.

According to this aspect, the first sensor-sensitivity-correction information is stored in the first storage device of the base frame, and the second sensor-sensitivity-correction information is stored in the second storage devices of the respective head modules. Further, the first sensor-sensitivity-correction information is acquired from the first storage device, and the second sensor-sensitivity-correction information is acquired from the second storage devices. Accordingly, it is possible to simply and reliably acquire information that is required to correct the sensitivity of the sensor.

According to a twenty-second aspect, when the position detecting device includes a detection target member provided in the head module and a sensor provided on the base frame and detecting the displacement of the detection target member, detects the displacement of the detection target member by the sensor, and detects the position of the head module relative to the support reference point serving as a reference, the method of replacing a head module of an inkjet head of the fourteenth, fifteenth, sixteenth, or nineteenth aspect further includes a step of setting the sensitivity of the sensor. The step of setting the sensitivity of the sensor includes: a step of preparing a first detection target member-sensitivity measuring jig used to measure the sensitivity of the detection target member, a second detection target member-sensitivity measuring jig used to measure the sensitivity of the detection target member, a first sensor-sensitivity measuring jig used to measure the sensitivity of the sensor, and a second sensor-sensitivity measuring jig used to measure the sensitivity of the sensor, and acquiring reference data ST by acquiring sensitivity data by using the first detection target member-sensitivity measuring jig and the first sensor-sensitivity measuring jig; a step of acquiring characteristic data AT of the second detection target member-sensitivity measuring jig by acquiring sensitivity data by using the first sensor-sensitivity measuring jig and the second detection target member-sensitivity measuring jig; a step of acquiring characteristic data BT of the second sensor-sensitivity measuring jig by acquiring sensitivity data by using the first detection target member-sensitivity measuring jig and the second sensor-sensitivity measuring jig; a step of acquiring temporary sensitivity data MM (temporary) of the detection target member by acquiring sensitivity data of the detection target member by using the second detection target member-sensitivity measuring jig; a step of acquiring temporary sensitivity data MS (temporary) of the sensor by acquiring sensitivity data of the sensor by using the second sensor-sensitivity measuring jig; a step of acquiring detection target member-sensitivity information MM by correcting the temporary sensitivity data MM (temporary) of the detection target member based on the reference data ST and the characteristic data AT; a step of acquiring sensor-sensitivity information MS by correcting the temporary sensitivity data MS (temporary) of the sensor based on the reference data ST and the characteristic data BT; and a step of setting the sensitivity of the sensor based on the detection target member-sensitivity information MM, the sensor-sensitivity information MS, and the reference data ST.

According to this aspect, when the position detecting device includes a detection target member provided in the head module and a sensor provided on the base frame and detecting the displacement of the detection target member, detects the displacement of the detection target member by the sensor, and detects the position of the head module relative to the support reference point serving as a reference, a step of setting the sensitivity of the sensor is further included. Further, the step of setting the sensitivity of the sensor includes: a step of acquiring reference data ST by acquiring sensitivity data by using the first detection target member-sensitivity measuring jig and the first sensor-sensitivity measuring jig; a step of acquiring characteristic data AT of the second detection target member-sensitivity measuring jig by acquiring sensitivity data by using the first sensor-sensitivity measuring jig and the second detection target member-sensitivity measuring jig; a step of acquiring characteristic data BT of the second sensor-sensitivity measuring jig by acquiring sensitivity data by using the first detection target member-sensitivity measuring jig and the second sensor-sensitivity measuring jig; a step of acquiring temporary sensitivity data MM (temporary) of the detection target member by acquiring sensitivity data of the detection target member by using the second detection target member-sensitivity measuring jig; a step of acquiring temporary sensitivity data MS (temporary) of the sensor by acquiring sensitivity data of the sensor by using the second sensor-sensitivity measuring jig; a step of acquiring detection target member-sensitivity information MM by correcting the temporary sensitivity data MM (temporary) of the detection target member based on the reference data ST and the characteristic data AT; a step of acquiring sensor-sensitivity information MS by correcting the temporary sensitivity data MS (temporary) of the sensor based on the reference data ST and the characteristic data BT; and a step of setting the sensitivity of the sensor based on the detection target member-sensitivity information MM, the sensor-sensitivity information MS, and the reference data ST. Accordingly, since the variation of the sensitivity of each of the sensor and the detection target member can be absorbed, detection with high accuracy can be performed even when the combination of the sensor and the detection target member is changed.

According to a twenty-third aspect, in the method of replacing a head module of an inkjet head of the twenty-second aspect, the sensor-sensitivity information MS is further stored in the first storage device, the detection target member-sensitivity information MM is further stored in the second storage devices, the sensor-sensitivity information MS is acquired from the first storage device, and the detection target member-sensitivity information is acquired from the second storage devices.

According to this aspect, the sensor-sensitivity information MS is stored in the first storage device, and the detection target member-sensitivity information MM is stored in the second storage devices. Accordingly, it is possible to easily acquire the sensor-sensitivity information MS and the detection target member-sensitivity information MM. The sensor-sensitivity information MS is stored in the first storage device, for example, at the time of the manufacture of the base frame or at the time of the shipment of the base frame from the factory. Further, the detection target member-sensitivity information MM is stored in the second storage devices, for example, at the time of the manufacture of the head module or at the time of the shipment of the head module from the factory.

According to a twenty-fourth aspect, in the method of replacing a head module of an inkjet head of the twenty-second or twenty-third aspect, information about temperature is further acquired and the sensitivity of the sensor is corrected.

According to this aspect, the sensitivity of the sensor is further corrected based on the information about temperature. Accordingly, it is possible to perform position detection with higher accuracy.

According to the invention, it is possible to easily replace a head module.

DESCRIPTION OF THE PREFERRED EMBODIMENTS

Preferred embodiments of the invention will be described in detail below with reference to the accompanying drawings.

<<Inkjet Recording Device>>

<Structure>

A case in which the invention is applied to a line inkjet recording device will be described here by way of example. Meanwhile, the line inkjet recording device means an inkjet recording device that records images on the entire area of a medium in a single pass by using long inkjet heads (so-called line heads) corresponding to the width of a medium.

Figure 1:
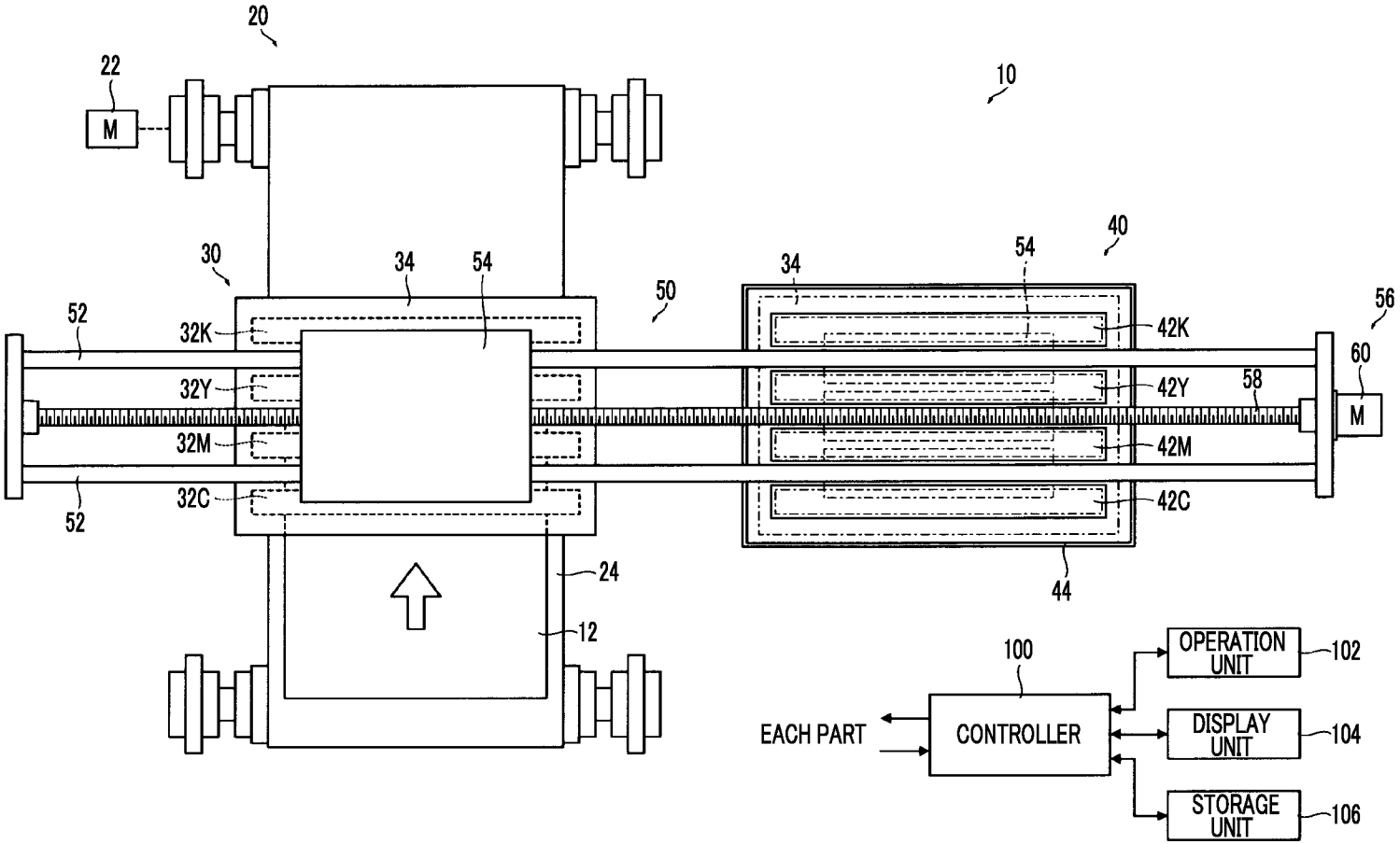
FIG. 1 is a plan view of a line inkjet recording device according to an embodiment.

FIG. 1 is a plan view of a line inkjet recording device according to an embodiment. Further, FIG. 2 is a front view of the inkjet recording device shown in FIG. 1, and FIG. 3 is a sectional view taken along 3-3 of FIG. 2.

Figure 2:
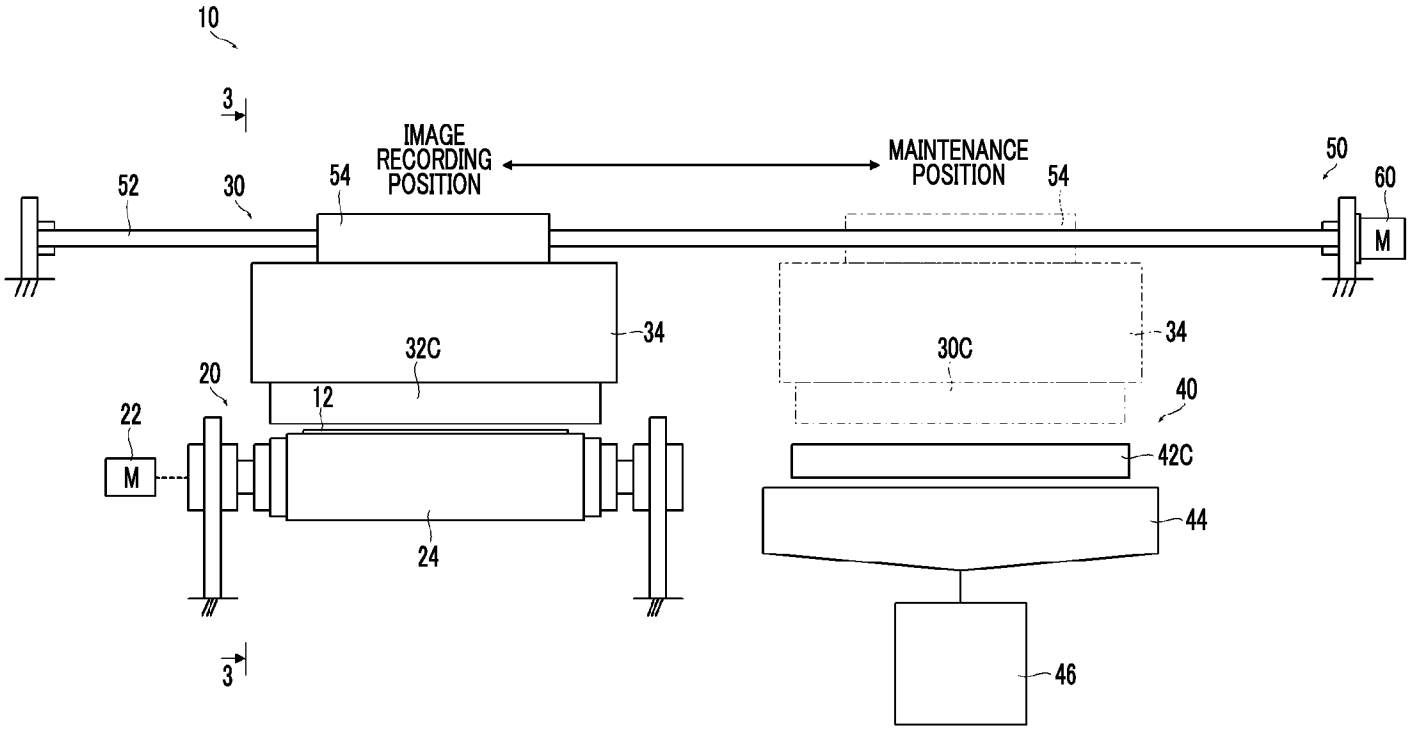
FIG. 2 is a front view of the inkjet recording device shown in FIG. 1.
Figure 3:
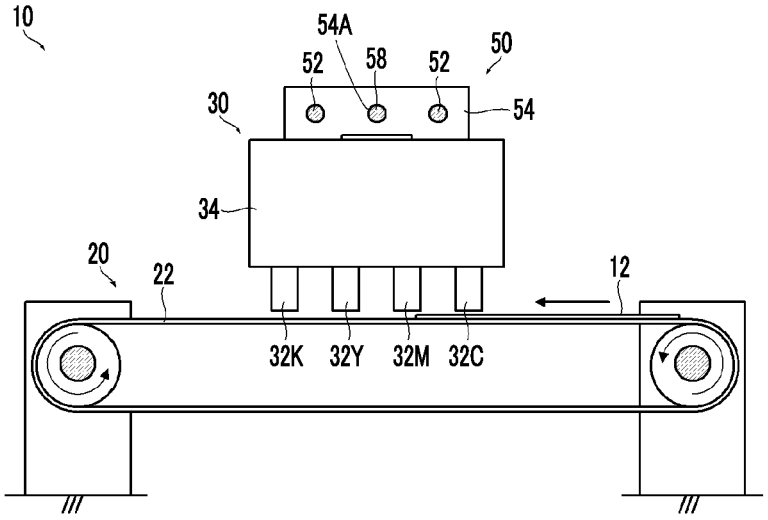
FIG. 3 is a sectional view taken along 3-3 of FIG. 2.

As shown in FIGS. 1 to 3, the inkjet recording device 10 mainly includes: a medium conveying unit 20 that conveys a sheet-like medium 12; a head unit 30 that records images on the medium 12 by discharging droplets of inks having colors of cyan (C), magenta (M), yellow (Y), and black (K) to the medium 12 conveyed by the medium conveying unit 20; a maintenance station 40 that performs the keeping and maintenance of the head unit 30; a transfer unit 50 that transfers the head unit 30 to the maintenance station 40; and a system controller 100 that collectively controls the operation of the entire inkjet recording device 10.

<Medium Conveying Unit>

The medium conveying unit 20 conveys a medium (for example, a paper sheet) 12 along a predetermined conveying path. In this embodiment, the medium conveying unit 20 is formed of a belt conveying mechanism. The medium conveying unit 20 includes an endless belt 24, which is driven by a motor 22 and rotationally runs, and conveys the medium 12 while holding the medium 12 on the peripheral surface of the belt 24 by suction.

In addition, for example, a drum conveying mechanism, a roller conveying mechanism, or the like can be employed as the medium conveying unit 20.

<Inkjet Unit>

The head unit 30 discharges droplets of inks having colors of cyan, magenta, yellow, and black to the medium 12 conveyed by the medium conveying unit 20. The head unit 30 includes an inkjet head 32C that discharges droplets of a cyan ink, an inkjet head 32M that discharges droplets of a magenta ink, an inkjet head 32Y that discharges droplets of a yellow ink, an inkjet head 32K that discharges droplets of a black ink, and a head unit body 34 on which the respective inkjet heads 32C, 32M, 32Y, and 32K are mounted.

The head unit body 34 includes holders (not shown) that are used to mount the respective inkjet heads 32C, 32M, 32Y, and 32K. A holder is provided for each of the inkjet heads 32C, 32M, 32Y, and 32K corresponding to the respective colors. The respective inkjet heads 32C, 32M, 32Y, and 32K are individually mounted on the holders and are detachably mounted on the holders.

Each of the inkjet heads 32C, 32M, 32Y, and 32K is formed of a line head corresponding to the width of the medium 12. When the respective inkjet heads 32C, 32M, 32Y, and 32K are mounted on the head unit body 34, the respective inkjet heads are disposed in parallel with each other at regular intervals and are disposed orthogonal to the conveying direction of the medium 12 that is conveyed by the medium conveying unit 20.

Each of the inkjet heads 32C, 32M, 32Y, and 32K includes a plurality of short inkjet heads (head modules) that are joined to one another. This will be described in detail below.

<Maintenance Station>

The maintenance station 40 performs the keeping and maintenance of the head unit 30. The maintenance station 40 is provided with cap units 42C, 42M, 42Y, and 42K that cap (cover nozzle faces) the respective inkjet heads 32C, 32M, 32Y, and 32K of the head unit 30.

The cap units 42C, 42M, 42Y, and 42K are provided for the inkjet heads 32C, 32M, 32Y, and 32K corresponding to the respective colors, respectively. The cap units 42C, 42M, 42Y, and 42K cover the nozzle faces of the inkjet heads 32C, 32M, 32Y, and 32K and prevent solvent components of the inks from being evaporated from nozzles. Further, the cap units prevent foreign materials from adhering to the nozzle faces.

The cap units 42C, 42M, 42Y, and 42K are provided with pressurization/suction mechanisms that pressurize and suck the inside of the nozzles of the inkjet heads 32C, 32M, 32Y, and 32K while the inkjet heads 32C, 32M, 32Y, and 32K are capped with the cap units. When a discharge failure or the like occurs, the inside of the nozzle is pressurized and sucked by the pressurization/suction mechanism (so-called recovery processing).

A waste liquid tray 44 is disposed below the cap units 42C, 42M, 42Y, and 42K. Inks, which are sucked by the cap units 42C, 42M, 42Y, and 42K, are discarded into the waste liquid tray 44 and are recovered by the waste liquid tank 46.

<Transfer Unit>

The transfer unit 50 transfers the head unit 30 to the maintenance station 40. The transfer unit 50 includes a pair of guide rails 52, a slider 54 that is guided by the pair of guide rails 52 and is moved, and a drive unit 56 that moves the slider 54 along the guide rails 52.

The pair of guide rails 52 are disposed above the medium conveying unit 20 and the maintenance station 40, and are disposed so as to bridge between the medium conveying unit 20 and the maintenance station 40.

The slider 54 slides along the guide rails 52, and is linearly moved between the medium conveying unit 20 and the maintenance station 40. The head unit 30 is mounted on the slider 54.

The drive unit 56 is formed of a so-called feed screw mechanism, and includes a screw rod 58 and a motor 60 that rotationally drives the screw rod 58. The screw rod 58 is disposed along the guide rails 52. The slider 54 is provided with a female screw portion 54A to which the screw rod 58 is screwed. The motor 60 is connected to the screw rod 58 and rotates the screw rod 58 in a normal direction/reverse direction.

When the motor 60 is driven and rotates the screw rod 58 in the normal direction/reverse direction, the slider 54 slides along the guide rails 52. The head unit 30 is mounted on the slider 54 as described above. Accordingly, when the slider 54 is moved, the head unit 30 is also moved together with the slider 54 and is linearly moved between the medium conveying unit 20 and the maintenance station 40.

The head unit 30 is linearly moved between the medium conveying unit 20 and the maintenance station 40, and is moved between an "image recording position" set at the medium conveying unit 20 and a "maintenance position" set at the maintenance station 40.

When the head unit 30 is positioned at the "image recording position", the head unit 30 can record images. When the head unit 30 is positioned at the "maintenance position", the head unit 30 can be subjected to maintenance. That is, since the head unit 30 is set above the medium conveying unit 20 when being positioned at the "image recording position", the head unit 30 can record images on the medium 12 conveyed by the medium conveying unit 20. Further, since the head unit 30 is set at the maintenance station 40 when being positioned at the "maintenance position", the head unit 30 can be capped with the cap units 42C, 42M, 42Y, and 42K or can be subjected to other maintenance (the replacement of the inkjet heads, the replacement of the head modules, and the like).

<System Controller>

The system controller 100 functions as a control device configured to collectively control the operation of the entire inkjet recording device 10. Further, the system controller 100 also functions as a device configured to perform various kinds of calculation processing such as processing for calculating the amount of correction of the position of a head module 210 and processing for calculating the amount of correction of the sensitivity of a sensor (the system controller 100 also functions as a position-correction-information generating device, a sensor-sensitivity setting device, a sensor-sensitivity correcting device, and the like).

The system controller 100 is formed of a so-called microcomputer, and performs various kinds of processing by executing predetermined programs. Accordingly, the system controller 100 is provided with a memory that stores various kinds of control data and the programs used to perform various kinds of processing.

Further, an operation unit 102 as an input device, a display unit 104 as a display device, and the like are connected to the system controller 100. Furthermore, a storage unit 106 as a storage device (third storage device), which is used to preserve various kinds of data, is connected to the system controller 100.

The operation unit 102 includes, for example, a keyboard, a mouse, a touch panel, and the like. The operation unit 102 includes various operation buttons that are provided in the inkjet recording device 10.

The display unit 104 is formed of, for example, a liquid-crystal display or the like. The display unit 104 includes various kinds of display devices that are provided in the inkjet recording device 10.

The storage unit 106 is formed of, for example, a nonvolatile semiconductor memory (for example, EEPROM (registered trademark), a flash memory, or the like), or a HDD (Hard Disk Drive).

<Operation>

<Image Recording Operation>

The head unit 30 is moved to the image recording position. Accordingly, since the head unit 30 is set above the medium conveying unit 20, the head unit 30 can record images.

The medium 12 is fed to the medium conveying unit 20 by a sheet feeding mechanism (not shown). Meanwhile, the medium 12 is subjected to predetermined pretreatment as necessary (for example, the medium 12 is subjected to treatment such as the application of treatment liquid having a function to allow coloring materials to cohere and the like).

The medium conveying unit 20 receives the medium 12 conveyed by the sheet feeding mechanism, and coveys the received medium 12 along a predetermined conveying path.

While the medium 12 is conveyed by the medium conveying unit 20, the medium 12 passes beneath the head unit 30. Further, when the medium 12 passes beneath the head unit 30, droplets of inks having colors of cyan, magenta, yellow, and black are discharged to the medium 12 from the respective inkjet heads 32C, 32M, 32Y, and 32K of the head unit 30. Accordingly, images are recorded on the surface of the medium 12.

The medium 12 on which images have been recorded is recovered from the medium conveying unit 20 by a recovery mechanism (not shown). Meanwhile, the medium 12 on which images have been recorded is subjected to treatment, such as drying or fixing, as necessary.

Since the medium 12 are continuously fed, processing for recording images is continuously performed.

<Maintenance Operation>

The head unit 30 is moved to the maintenance position. Accordingly, the head unit 30 is set at the maintenance station 40.

When the operation of the head unit 30 is to stop for a long time, the head unit 30 is transferred to the maintenance station 40 and the respective inkjet heads 32C, 32M, 32Y, and 32K are capped with the cap units 42C, 42M, 42Y, and 42K of the maintenance station 40.

Further, the inkjet heads 32C, 32M, 32Y, and 32K can be replaced. Accordingly, even when work for replacing the inkjet heads 32C, 32M, 32Y, and 32K is performed, the inkjet heads 32C, 32M, 32Y, and 32K are transferred to the maintenance station 40 and the replacement work is performed by the maintenance station 40.

Furthermore, work for replacing the head modules that form the inkjet heads 32C, 32M, 32Y, and 32K or the like is also performed by the maintenance station 40 as described below.

<<Inkjet Head>>

The structures of the inkjet heads 32C, 32M, 32Y, and 32K will be described below.

Meanwhile, since all of the inkjet heads 32C, 32M, 32Y, and 32K corresponding to the respective colors have the same structure, the structure of the inkjet head will be described here using an inkjet head 200.

Figure 4:
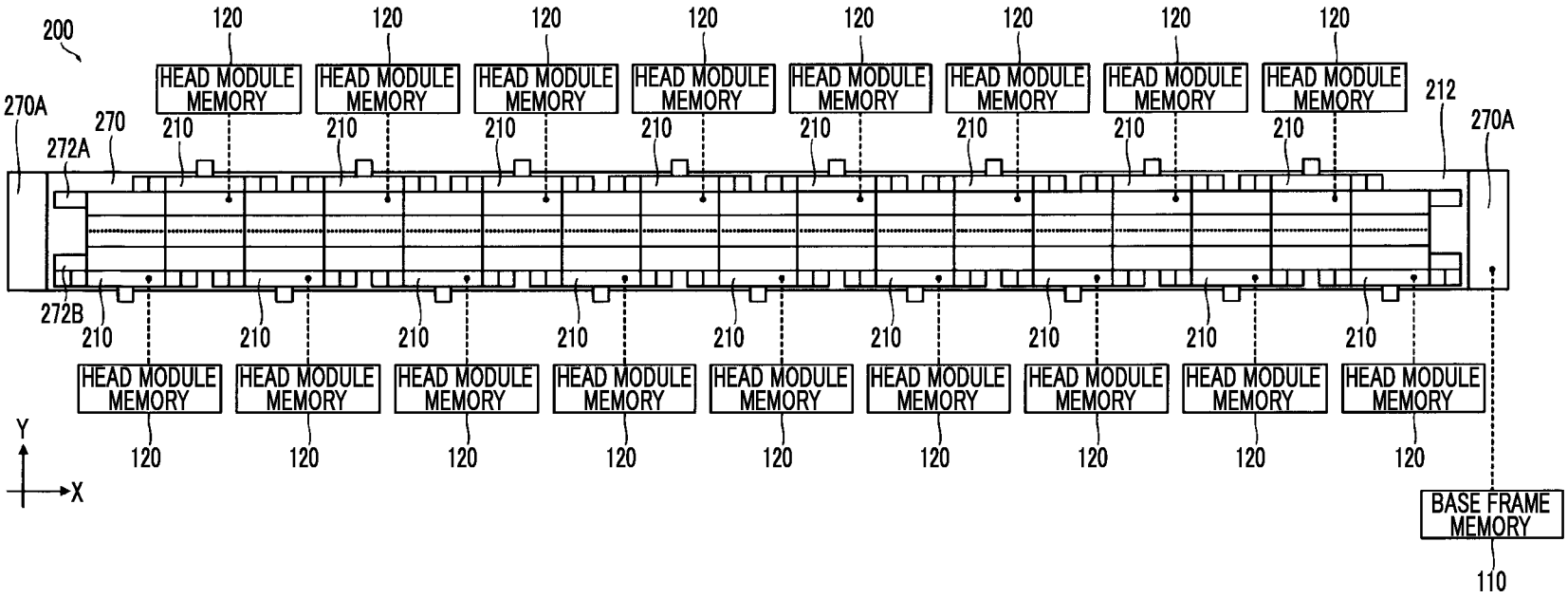
FIG. 4 is a bottom view of an inkjet head.
Figure 5:
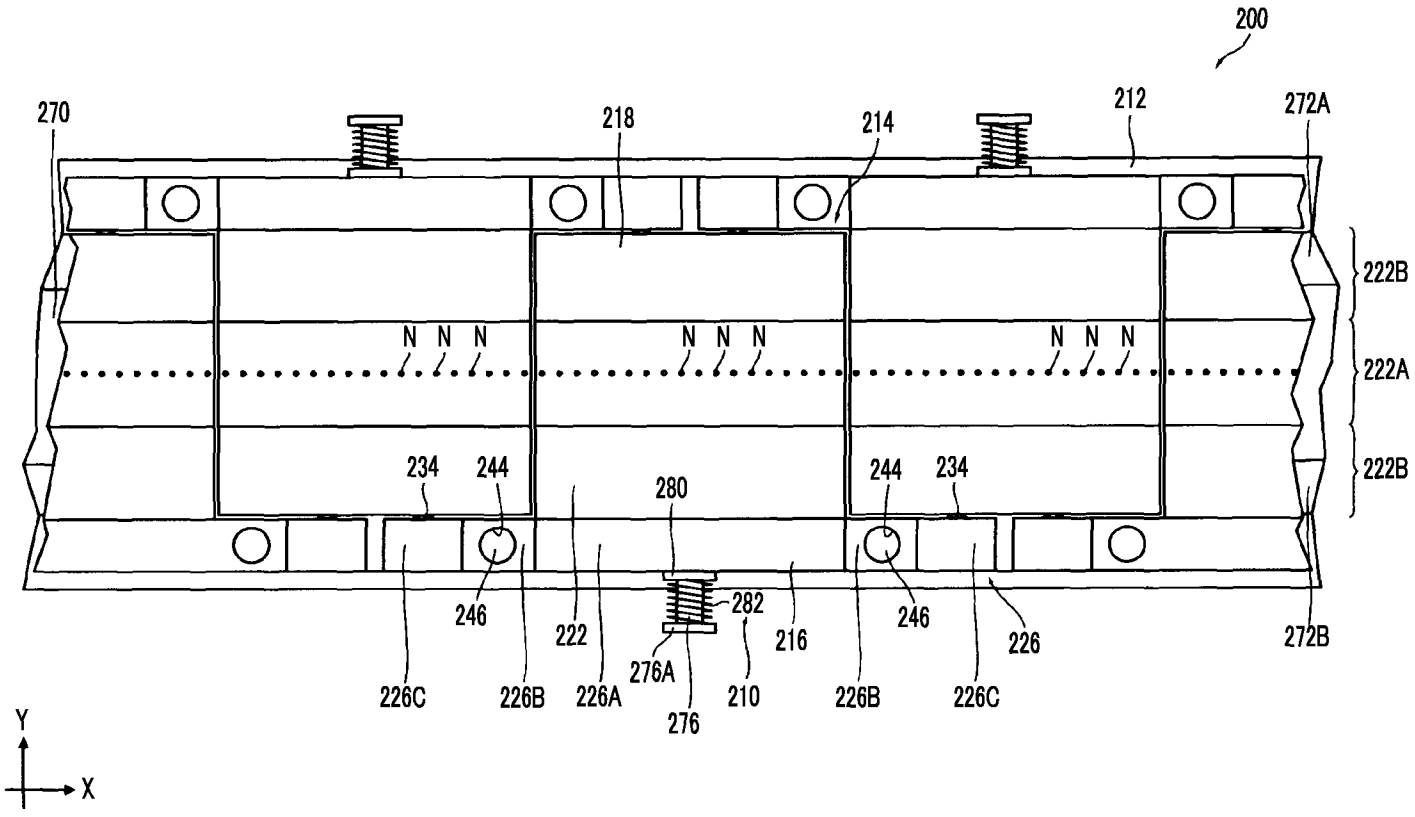
FIG. 5 is an enlarged view of a part of the inkjet head shown in FIG. 4.
Figure 6:
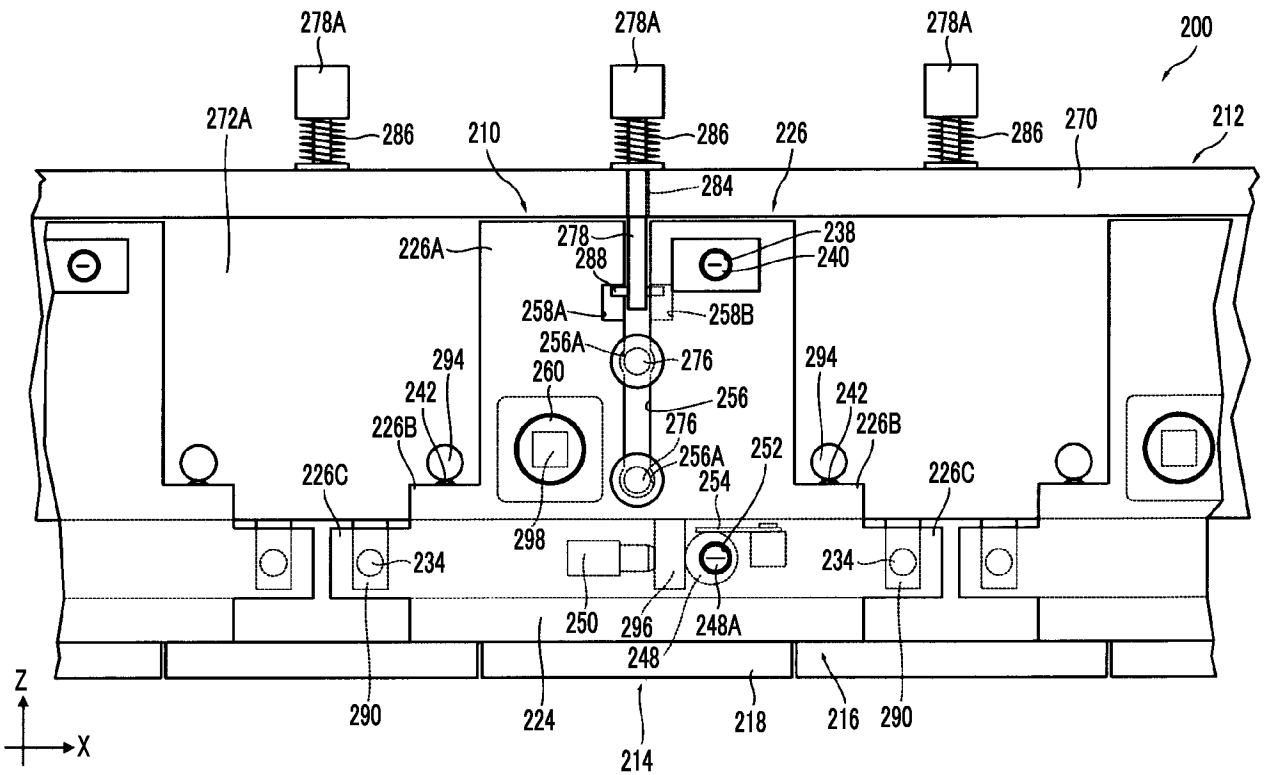
FIG. 6 is a front view showing the structure of a main section of the inkjet head.
Figure 7:
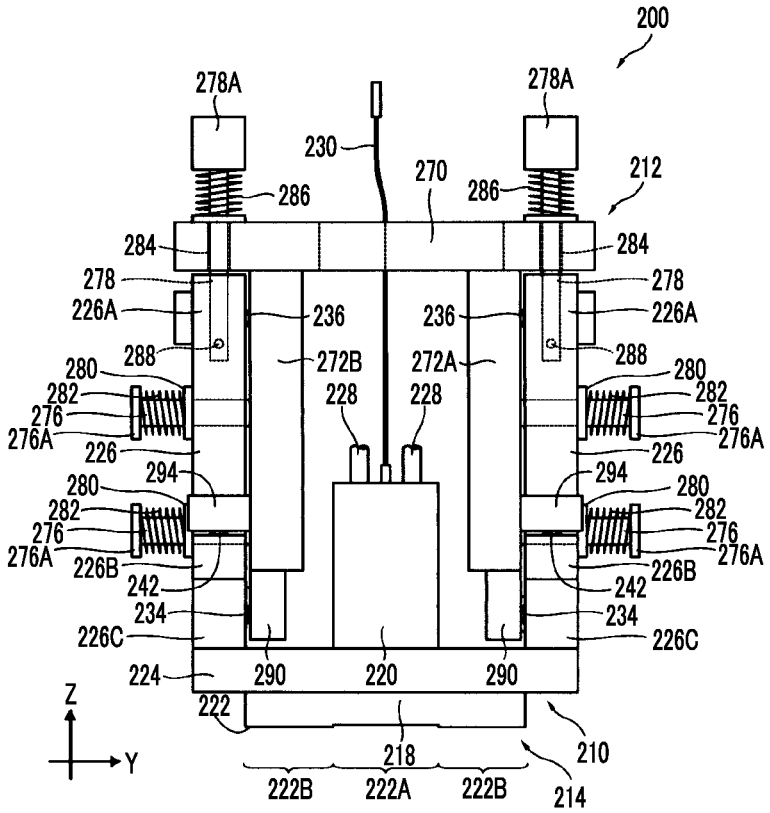
FIG. 7 is a side view showing the structure of the main section of the inkjet head.

FIG. 4 is a bottom view of the inkjet head. FIG. 5 is an enlarged view of a part of the inkjet head shown in FIG. 4. FIG. 6 is a front view showing the structure of a main section of the inkjet head. FIG. 7 is a side view showing the structure of the main section of the inkjet head.

The inkjet head 200 includes a plurality of (17 in this embodiment) head modules 210 that are joined in a line. When the respective head modules 210 are mounted on a base frame 212, the respective head modules 210 are joined in a line.

The base frame 212 is provided with a base frame memory (first storage device) 110 in which information unique to the base frame 212 is stored. Further, each head module 210 is provided with a head module memory (a second storage device) 120 in which information unique to the head module 210 is stored. When the head module 210 is to be replaced, information, which is required to mount the replaced head module 210 at a normal mounting position, is calculated using the information stored in the base frame memory 110 and the information stored in the head module memory 120. Furthermore, the mounting position of the replaced head module 210 is adjusted based on the calculated information.

The structure of the head module 210 and the structure of the base frame 212 will be described below.

Meanwhile, an X-axis, a Y-axis, and a Z-axis will be referred to as three axes orthogonal to one another in the following description and the head modules 210 are disposed along the X-axis. Further, a nozzle face of the inkjet head 200 is disposed along an XY plane (a plane defined by the X-axis and the Y-axis). Furthermore, the XY plane will be referred to as a horizontal plane and an XZ plane and a YZ plane will be referred to as vertical planes in the following description for convenience.

<Head Module>

The head module 210 is a standardized short inkjet head. Accordingly, all the respective head modules 210 have the same structure.

Figure 8:
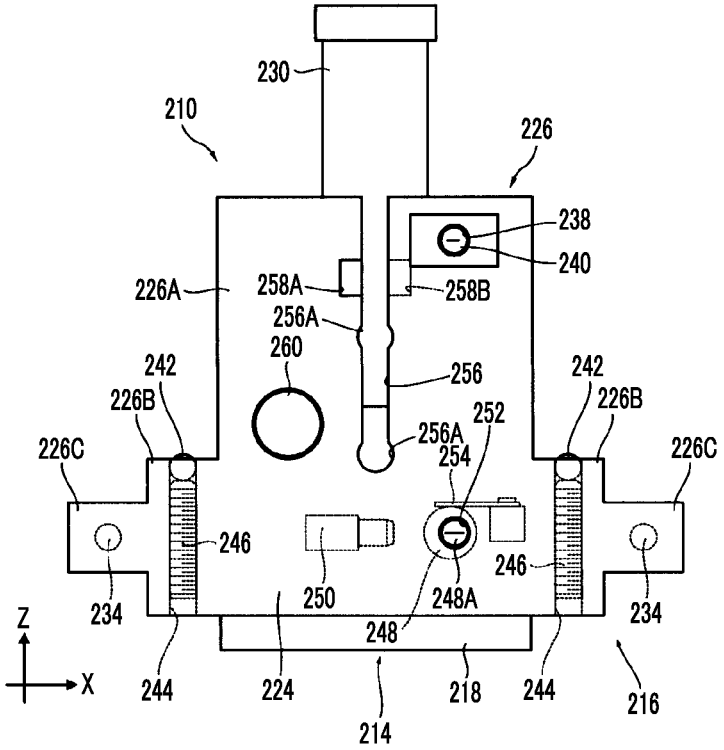
FIG. 8 is a front view of a head module.
Figure 9:
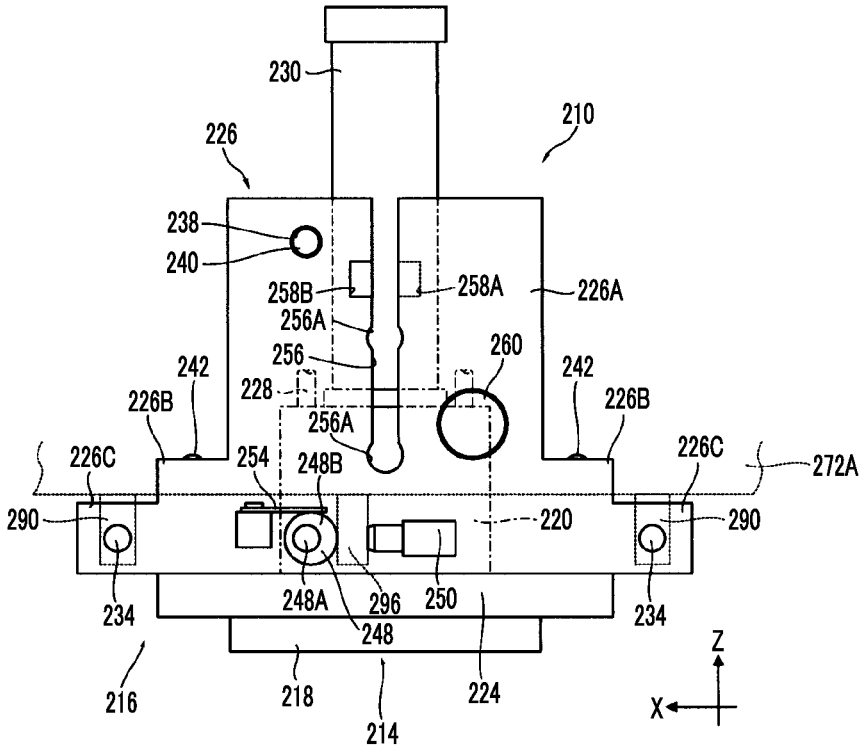
FIG. 9 is a rear view of the head module.
Figure 10:
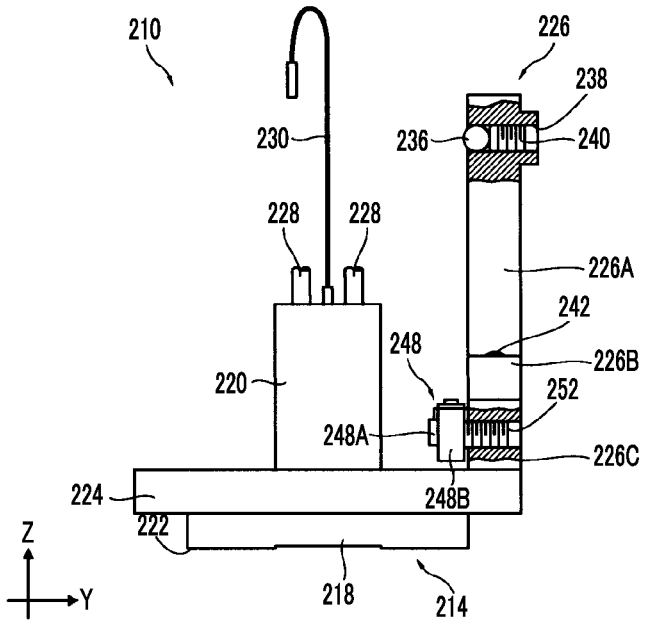
FIG. 10 is a partial side sectional view of the head module.

FIG. 8 is a front view of the head module, FIG. 9 is a rear view of the head module, and FIG. 10 is a partial side sectional view of the head module.

The head module 210 includes a head 214 that discharges an ink and a bracket 216 that is used to mount the head 214 on the base frame 212.

The head 214 includes a head body 218 and an electrical/pipe section 220.

The head body 218 has the shape of a rectangular plate as a whole, and includes a nozzle face 222 on the lower surface thereof. The nozzle face 222 includes a strip-shaped nozzle area 222A in the middle portion thereof and includes nozzle protection areas 222B on both sides of the strip-shaped nozzle area 222A. The nozzle area 222A and the nozzle protection areas 222B have a certain width and are provided in parallel to the X-axis. Further, the nozzle area 222A is formed so as to be recessed from the nozzle protection areas 222B, and the surface of the nozzle area 222A is subjected to liquid repellent treatment.

Nozzles N, which discharge droplets, are provided in the nozzle area 222A and are disposed along the X-axis at regular intervals.

The electrical/pipe section 220 is an assembly of pipes, a circuit board, and the like, and is provided above the head body 218. A circuit board that is used to control the driving of the head 214, a circuit board that is used to communicate with the system controller 100, and the like are included in the circuit board of the electrical/pipe section 220. Further, the head module memory (the second storage device) 120 is provided in the electrical/pipe section 220.

A cable 230 for electrically connecting pipes 228, which are used to supply an ink to the head body 218, to the head unit body 34 is drawn from the electrical/pipe section 220. Each of the head modules 210 of the inkjet head 200 mounted on the head unit body 34 is electrically connected to the head unit body 34 through the cable 230. Accordingly, various kinds of data can be transmitted and received between each head module 210 and the system controller 100. Furthermore, each of the head modules 210 is connected to an ink supply unit (not shown) of the head unit body 34 through the pipes 228.

The bracket 216 has an L shape, and includes a horizontal portion 224 and a vertical portion 226. The horizontal portion 224 functions as a mounting portion for the head 214, and the vertical portion 226 functions as a mounting portion to be mounted on the base frame 212.

The horizontal portion 224 has the shape of a rectangular plate, and has an external shape corresponding to the appearance of the head body 218. When the head body 218 is mounted on the horizontal portion 224, the head 214 is mounted on the bracket 216. In this case, the upper surface of the head body 218 is mounted on the lower surface of the horizontal portion 224, so that the head body 218 is integrated with the horizontal portion 224. An opening 224A is formed in the middle portion of the horizontal portion 224, and the electrical/pipe section 220 of the head 214 is disposed inside the bracket 216 through the opening 224A.

The vertical portion 226 is connected to one end of the horizontal portion 224 so as to be perpendicular to the horizontal portion 224, and is integrated with the horizontal portion 224. The vertical portion 226 includes a vertical portion body 226A, a pair of first protruding portions 226B, and a pair of second protruding portions 226C.

The vertical portion body 226A has the shape of a rectangular plate, and has a width substantially equal to the width of the horizontal portion 224. The pair of first protruding portions 226B are formed so as to protrude from both sides of the vertical portion body 226A in an X-axis direction. Further, the pair of second protruding portions 226C are formed so as to further protrude from the pair of first protruding portions 226B in the X-axis direction.

The vertical portion 226 is provided with a Y-axis head module positioning device that serves as a positioning reference in a Y-axis direction when the head module 210 is mounted on the base frame 212 and a Z-axis head module positioning device that serves as a positioning reference in a Z-axis direction when the head module 210 is mounted on the base frame 212. Further, the vertical portion 226 is further provided with a part of a position adjusting device configured to adjust the position of the head module 210 (the position of the head module 210 in the X-axis direction) that is mounted on the base frame 212.

The Y-axis head module positioning device includes two Y-axis head module stationary contact members 234 that form a Y-axis head module positioning member, and one Y-axis head module movable contact member 236 that forms the Y-axis head module positioning member.

The two Y-axis head module stationary contact members 234 are provided on the second protruding portions 226C of the vertical portion 226. Each of the Y-axis head module stationary contact members 234 is formed of a rigid sphere (a spherical body having stiffness). The Y-axis head module stationary contact members 234 are inserted into holes (not shown) formed in the second protruding portions 226C, and parts thereof protrude from the inner surfaces of the second protruding portions 226C (the surfaces of the second protruding portions 226C that face the base frame 212 when the head module 210 is mounted on the base frame 212) by a predetermined distance.

Meanwhile, the Y-axis head module movable contact member 236 is provided on the vertical portion body 226A of the vertical portion 226. The Y-axis head module movable contact member 236 is formed of a rigid sphere, and is provided in the vertical portion body 226A by being inserted into a Y-axis head module movable contact member-insertion hole 238 formed in the vertical portion body 226A. The Y-axis head module movable contact member-insertion hole 238 is formed in the Y-axis direction, and is formed so as to pass through the vertical portion body 226A from the outer surface of the vertical portion body 226A toward the inner surface thereof. The Y-axis head module movable contact member 236 is inserted into the Y-axis head module movable contact member-insertion hole 238 and can protrude from the inner surface of the vertical portion body 226A. Meanwhile, a portion of the Y-axis head module movable contact member-insertion hole 238, which is close to the inner surface of the vertical portion body 226A, is reduced in diameter so that the Y-axis head module movable contact member 236 is not separated from the Y-axis head module movable contact member-insertion hole 238.

The Y-axis head module movable contact member-insertion hole 238 is formed of a screw hole, and a Y-axis head module movable contact member-position adjusting screw 240 is screwed to the Y-axis head module movable contact member-insertion hole 238. The Y-axis head module movable contact member-position adjusting screw 240 is formed of a so-called set screw (a screw of which the diameter of a head is the same as the diameter of a screw portion). The length of a portion, which protrudes from the inner surface of the vertical portion body 226A, of the Y-axis head module movable contact member 236 is adjusted by the adjustment of the length of a portion, which is screwed to the Y-axis head module movable contact member-insertion hole 238, of the Y-axis head module movable contact member-position adjusting screw 240.

As described below, the Y-axis head module stationary contact members 234 and the Y-axis head module movable contact member 236 come into contact with Y-axis base frame positioning members 290 for stationary contact and a Y-axis base frame positioning member 292 for movable contact, which are provided on the base frame 212, when the head module 210 is mounted on the base frame 212. Accordingly, the head module 210 is positioned relative to the base frame 212 in the Y-axis direction.

The Z-axis head module positioning device includes a pair of Z-axis head module contact members 242 that form a Z-axis head module positioning member.

The pair of Z-axis head module contact members 242 are provided on the first protruding portions 226B of the vertical portion 226. Each of the Z-axis head module contact members 242 is formed of a rigid sphere. The Z-axis head module contact members 242 are provided in the first protruding portions 226B by being inserted into Z-axis head module contact member-insertion holes 244 formed in the first protruding portions 226B. The Z-axis head module contact member-insertion holes 244 are formed in the Z-axis direction, and are formed so as to pass through the first protruding portions 226B from the lower surfaces of the first protruding portions 226B toward the upper surfaces thereof. The Z-axis head module contact members 242 are inserted into the Z-axis head module contact member-insertion holes 244, and a part of the Z-axis head module contact members 242 can protrude from the upper surfaces of the first protruding portions 226B. Meanwhile, portions of the Z-axis head module contact member-insertion holes 244, which are close to the upper surfaces of the first protruding portions 226B, are reduced in diameter so that the Z-axis head module contact members 242 are not separated from the Z-axis head module contact member-insertion holes 244.

Each of the Z-axis head module contact member-insertion holes 244 is formed of a screw hole. Z-axis head module contact member-position adjusting screws 246 are screwed to the Z-axis head module contact member-insertion holes 244. Each of the Z-axis head module contact member-position adjusting screws 246 is formed of a so-called set screw. The length of a portion, which protrudes from the upper surface of the first protruding portion 226B, of the Z-axis head module contact member 242 is adjusted by the adjustment of the length of a portion, which is screwed to the Z-axis head module contact member-insertion hole 244, of each Z-axis head module contact member-position adjusting screw 246.

As described below, the Z-axis head module contact members 242 come into contact with Z-axis base frame contact members 294, which are provided on the base frame 212, when the head module 210 is mounted on the base frame 212. Accordingly, the head module 210 is positioned relative to the base frame 212 in the Z-axis direction.

Meanwhile, it is preferable that an interval between the pair of Z-axis head module contact members 242 (an interval between the pair of Z-axis head module contact members 242 in the X-axis direction) is set to be larger than the width of the print area of the head 214 (the entire length of a nozzle array). Accordingly, since stability is improved when the head module 210 is seated, the positioning accuracy of the head module 210 in the Z-axis direction can be improved.

Further, it is preferable that an interval between the Y-axis head module stationary contact members 234, which make a pair, (an interval between the Y-axis head module stationary contact members 234 in the X-axis direction) is also set to be larger than the width of the print area of the head 214 (the entire length of the nozzle array). Accordingly, since stability is improved when the head module 210 is seated, the positioning accuracy of the head module 210 in the Y-axis direction can be improved.

The position adjusting device mainly includes an eccentric roller 248, a plunger 250, and an X-axis positioning reference pin 296. The eccentric roller 248 and the plunger 250 are provided in the head module 210, and the X-axis positioning reference pin 296 is provided on the base frame 212.

The eccentric roller 248 and the plunger 250 are disposed on the inner surface of the vertical portion body 226A. The eccentric roller 248 and the plunger 250 are disposed so as to face each other with a certain interval therebetween.

The eccentric roller 248 includes a shaft portion 248A and a roller portion 248B. The shaft portion 248A functions as a rotating shaft that is used to rotate the roller portion 248B, and is eccentrically connected to the roller portion 248B. For this reason, when the shaft portion 248A is rotated, the roller portion 248B is eccentrically rotated.

The shaft portion 248A of the eccentric roller 248 is inserted into an eccentric roller-mounting hole 252 of the vertical portion body 226A. The eccentric roller-mounting hole 252 is formed in parallel to the Y-axis direction. The eccentric roller-mounting hole 252 is formed so as to pass through the vertical portion body 226A from the outer surface of the vertical portion body 226A toward the inner surface thereof. When the shaft portion 248A is screwed to the eccentric roller-mounting hole 252, the eccentric roller 248 is mounted on the vertical portion body 226A. A base end portion of the shaft portion 248A of the eccentric roller 248 is provided with a groove (a cross-shaped groove or a linear groove) that is used to rotate the shaft portion 248A with a screwdriver. When the shaft portion 248A is rotated by using a screwdriver, the roller portion 248B of the eccentric roller 248 mounted on the vertical portion body 226A is eccentrically rotated.

A leaf spring 254 comes into pressure contact with the roller portion 248B. The leaf spring 254 is disposed on the inner surface of the vertical portion body 226A. The leaf spring 254 comes into contact with the peripheral surface of the roller portion 248B, and presses the peripheral surface of the roller portion 248B. Since the peripheral surface of the roller portion 248B is pressed by the leaf spring 254, a certain resistance is applied to the rotation of the eccentric roller 248. Accordingly, the unintended rotation of the eccentric roller 248 is prevented.

The plunger 250 functions as an X-axis biasing device. The plunger 250 is disposed so that the axis of the plunger 250 is parallel to the X-axis and the tip (pressing portion) of the plunger 250 faces the eccentric roller 248.

As described above, the eccentric roller 248 and the plunger 250 are disposed so as to face each other with a certain interval therebetween. When the head module 210 is mounted on the base frame 212, the X-axis positioning reference pin 296 provided on the base frame is fitted between the eccentric roller 248 and the plunger 250 and is interposed between the eccentric roller 248 and the plunger 250. The plunger 250 presses the X-axis positioning reference pin 296 in the X-axis direction. Accordingly, the head module 210 is biased in the X-axis direction. When the eccentric roller 248 is rotated in this state, the head module 210 is moved in the X-axis direction according to the rotation angle of the eccentric roller 248.

The vertical portion 226 of the bracket 216 is provided with a guide groove 256 that functions as a guide (module guide portion) for mounting when the head module 210 is mounted on the base frame 212. The guide groove 256 is formed in the middle portion of the vertical portion body 226A, and is formed along the Z-axis. Further, the upper end portion of the guide groove 256 is formed so as to be open at the upper surface of the vertical portion body 226A.

A pair of Y-axis guide posts 276 (module guide devices), which are provided on the base frame, are fitted to the guide groove 256. For this purpose, the width of the guide groove 256 is set to be substantially the same as the width (diameter) of each of the Y-axis guide posts 276.

Since the Y-axis guide posts 276 are fitted to the guide groove 256 when the head module 210 is mounted on the base frame 212, the mounting direction of the head module 210 is restricted and the head module 210 is mounted on the base frame 212 in a certain posture.

Arc-shaped large-diameter portions 256A are formed at the tip portion (lower end portion) and the middle portion of the guide groove 256. When the head module 210 is mounted on the base frame 212, the pair of Y-axis guide posts 276 provided on the base frame are received in the large-diameter portions 256A. Accordingly, the head module 210 is supported by the base frame 212 so that the installation position of the head module 210 can be finely adjusted in the X-axis direction.

The large-diameter portions 256A of the guide groove 256 are provided to allow the installation position of the head module 210 to be finely adjusted in the X-axis direction. Accordingly, since the large-diameter portions 256A are disposed so as to correspond to the Y-axis guide posts 276, the Y-axis guide posts 276 are disposed so as to be received at the substantially central positions of the large-diameter portions 256A when the head module 210 is mounted on the base frame 212.

In this embodiment, each of the large-diameter portions 256A is formed so as to form a circle having a center on the axis of the Y-axis guide post 276 when the head module 210 is mounted on the base frame 212. This circle is formed so as to have a diameter larger than the diameter of the Y-axis guide post 276. Accordingly, when the head module 210 is mounted on the base frame 212, the head module 210 can be supported so as to be capable of being moved within a predetermined range. Further, when the head module 210 is mounted on the base frame 212, the head module 210 can be mounted so that rattling does not occur on the head module 210.

A pair of cutout portions 258A and 258B are formed on the inner wall surface of the guide groove 256. When the bracket 216 is mounted on the base frame 212, a locking bar 288 of a Z-axis suspension rod 278 provided on the base frame is engaged with the pair of cutout portions 258A and 258B. The locking bar 288 of the Z-axis suspension rod 278 is engaged with the cutout portions 258A and 258B, so that the bracket 216 is locked to the base frame 212. The cutout portions 258A and 258B are formed at positions, which face each other, on the inner wall surface of the guide groove 256, and are formed on the inner and outer surfaces of the vertical portion 226 of the bracket 216 so as to have a predetermined depth, respectively. That is, one cutout portion 258A is formed on the outer surface of the vertical portion 226, and the other cutout portion 258B is formed on the inner surface of the vertical portion 226.

Further, the vertical portion 226 of the bracket 216 is provided with a magnet 260 (detection target member) that is used to detect the displacement (moving distance) of the head module 210 when the head module 210 is mounted on the base frame 212. The magnet 260 forms a position detecting device together with a magnetic sensor 298 (a sensor detecting the detection target member) that is provided on the base frame 212. When the head module 210 is mounted on the base frame 212, the magnet 260 is disposed so as to face the magnetic sensor 298 provided on the base frame 212.

The head module 210 has the above-mentioned structure.

<Base Frame>

Figure 11:
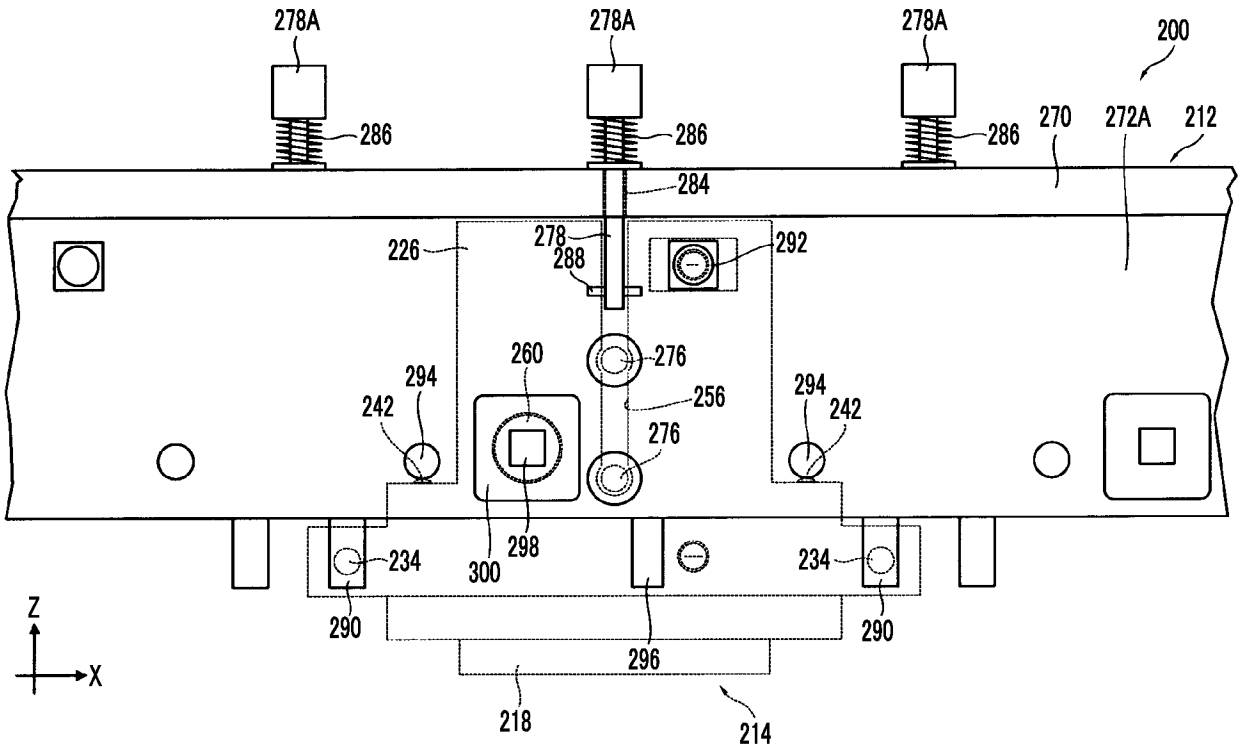
FIG. 11 is a front view showing the structure of a main section of a base frame.
Figure 12:
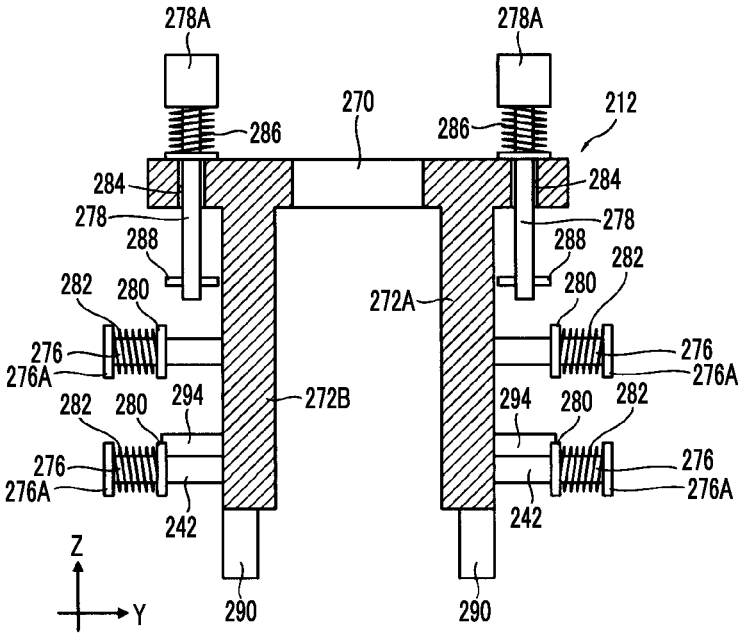
FIG. 12 is a side sectional view showing the structure of the main section of the base frame.

FIG. 11 is a front view showing the structure of a main section of the base frame. Further, FIG. 12 is a side sectional view showing the structure of the main section of the base frame.

The base frame 212 mainly includes an upper frame part 270 and a pair of lower frame parts 272A and 272B.

The upper frame part 270 has the shape of a rectangular plate. The upper frame part 270 is disposed horizontally (in parallel to an XY plane). As shown in FIG. 4, grippers 270A are provided on both end portions of the upper frame part 270. The inkjet head 200 is mounted on the head unit body 34 while the grippers 270A are gripped. Accordingly, the holder (not shown) of the inkjet head, which is included in the head unit body 34, is provided with gripping devices configured to grip the grippers 270A.

Each of the pair of lower frame parts 272A and 272B has the shape of a rectangular plate. The pair of lower frame parts 272A and 272B are disposed vertically (in parallel to an XZ plane) below the upper frame part 270 with a certain interval therebetween.

The pair of lower frame parts 272A and 272B function as mounting portions for the head modules 210. The head modules 210 are alternately mounted on the pair of lower frame parts 272A and 272B. That is, when it is assumed that one lower frame part 272A is a first lower frame (first mounting portion) and the other lower frame part 272B is a second lower frame (second mounting portion), a first head module 210 is mounted on the first lower frame part 272A and a second head module 210 disposed adjacent to the first head module 210 is mounted on the second lower frame part 272B. Further, a third head module 210 disposed adjacent to the second head module 210 is mounted on the first lower frame part 272A and a fourth head module disposed adjacent to the third head module 210 is mounted on the second lower frame part 272B. In this way, the head modules 210 are alternately mounted on the first and second lower frame parts 272A and 272B. As a result, the vertical portions 226 of the brackets 216 of the respective head modules 210 are alternately disposed on the base frame 212 between the adjacent head modules 210.

The base frame 212 is provided with head module support devices (support devices) configured to support the head modules 210. The head module support device is prepared for each head module. Since the head modules 210 are alternately mounted on the pair of lower frame parts 272A and 272B as described above, the head module support devices are alternately provided on the pair of lower frame parts 272A and 272B. Accordingly, an interval between the head module support devices (an interval between the head module support devices in the X-axis direction) corresponds to an interval between the head modules 210 (an interval between the head modules 210 in the X-axis direction) that are mounted on the respective lower frame parts 272A and 272B.

The head module support device includes the pair of Y-axis guide posts 276 and the Z-axis suspension rod 278.

The pair of Y-axis guide posts 276 are disposed in parallel in a vertical direction (the Z-axis direction) with a certain interval therebetween. Each of the Y-axis guide posts 276 is formed in a columnar shape. Each of the Y-axis guide posts 276 includes a flange portion 276A at the apex thereof. The Y-axis guide posts 276 are provided so as to protrude from the outer surfaces of the lower frame parts 272A and 272B, and are disposed in parallel to the Y-axis direction. The width (diameter) of each of the Y-axis guide posts 276 is set to be substantially the same as the width of the guide groove 256.

As described above, the pair of Y-axis guide posts 276 are fitted to the guide groove 256 formed in the vertical portion 226 of the bracket 216 of the head module 210 when the head module 210 is mounted on the base frame 212. Since the width (diameter) of each of the Y-axis guide posts 276 is set to be substantially the same as the width of the guide groove 256, the head module 210 can be mounted so that rattling does not occur when the head module 210 is mounted on the base frame 212.

Each of the pair of Y-axis guide posts 276 is provided with a Y-axis pressing plate 280. The Y-axis pressing plate 280 is formed in the shape of a ring. The Y-axis guide post 276 is inserted into the inner peripheral portion of the Y-axis pressing plate 280, so that the Y-axis pressing plate 280 is provided on the Y-axis guide post 276.

Further, each of the pair of Y-axis guide posts 276 is provided with a Y-axis pressing spring 282 as a Y-axis biasing device. The Y-axis guide posts 276 is inserted into the inner peripheral portion of the Y-axis pressing spring 282, so that the Y-axis pressing spring 282 is provided on the Y-axis guide post 276. The Y-axis pressing spring 282 is disposed between the flange portion 276A and the Y-axis pressing plate 280 of the Y-axis guide post 276.

As described above, the pair of Y-axis guide posts 276 are fitted to the guide groove 256 when the head module 210 is mounted on the base frame 212. When the pair of Y-axis guide posts 276 are fitted to the guide groove 256, the Y-axis pressing plates 280 are engaged with the vertical portion 226 of the bracket 216. Since the Y-axis pressing plates 280 are biased in the Y-axis direction by the Y-axis pressing springs 282, the head module 210 is pressed toward the base frame 212 by the Y-axis pressing plates 280.

Here, the pair of Y-axis guide posts 276 are disposed in the vertical direction with a certain interval therebetween as described above, but springs having different biasing forces, that is, different spring constants are used as the Y-axis pressing springs 282 of the respective Y-axis guide posts 276. Specifically, a spring, which has a spring constant larger than the spring constant of the Y-axis pressing spring 282 provided on the upper Y-axis guide post 276, is used as the Y-axis pressing spring 282 of the lower Y-axis guide post 276. As a result, the pressing force, which is generated from the Y-axis pressing plate 280 of the lower Y-axis guide post 276, is larger than the pressing force that is generated from the Y-axis pressing plate 280 of the upper Y-axis guide post 276. The reason for this is to prevent the head module 210 from being tilted when the mounting position of the head module 210 in the X-axis direction is adjusted. That is, since the center of the rotation moment at the time of the adjustment of the mounting position of the head module in the X-axis direction is set to be close to the position adjusting device when the spring constant of the Y-axis pressing spring 282 of the lower Y-axis guide post 276 close to the position adjusting device is set to be large, it is possible to prevent the head module 210 from being tilted (since the upper portion of the head module 210 is not easily moved when the spring constant of the Y-axis pressing spring 282 provided on the upper Y-axis guide post 276 is set to be large, the head module 210 is easily tilted).

Meanwhile, since the position adjusting device is provided to be close to the lower Y-axis guide post 276 in the inkjet head 200 of this embodiment, the spring constant of the Y-axis pressing spring 282 provided on the lower Y-axis guide post 276 is set to be larger than the spring constant of the Y-axis pressing spring 282 provided on the upper Y-axis guide post 276. However, when the position adjusting device is provided to be close to the upper Y-axis guide post 276, the spring constant of the Y-axis pressing spring 282 provided on the upper Y-axis guide post 276 is set to be larger than the spring constant of the Y-axis pressing spring 282 provided on the lower Y-axis guide post 276. That is, the spring constant of the Y-axis pressing spring 282 of the Y-axis guide post 276 installed closer to the position adjusting device is set to be larger than the spring constant of the Y-axis pressing spring 282 of the other Y-axis guide post 276. Accordingly, it is possible to prevent the head module 210 from being tilted at the time of the adjustment of the mounting position of the head module in the X-axis direction.

The Z-axis suspension rod 278 is formed in a columnar shape. The Z-axis suspension rod 278 includes a knob 278A at the apex thereof. The Z-axis suspension rod 278 is disposed in parallel to the Z-axis direction. Z-axis suspension rod-insertion holes 284, which are used to mount the Z-axis suspension rods 278, are formed in the upper frame part 270. The Z-axis suspension rod-insertion holes 284 are formed in the Z-axis direction, and are formed so as to pass through the upper frame part 270 from the upper surface of the upper frame part 270 toward the lower surface thereof. The Z-axis suspension rods 278 are mounted on the upper frame part 270 by being inserted into the Z-axis suspension rod-insertion holes 284.

The Z-axis suspension rods 278 mounted on the upper frame part 270 are disposed in front of the outer surfaces of the lower frame parts 272A and 272B.

Further, the Z-axis suspension rod 278 is disposed on the same line as the pair of Y-axis guide posts 276, and is disposed above the pair of Y-axis guide posts 276. Accordingly, when the head module 210 is mounted on the base frame 212, the Z-axis suspension rod 278 is received in the guide groove 256.

The Z-axis suspension rod 278 is provided with a Z-axis pressing spring 286 as a Z-axis biasing device. The Z-axis suspension rod 278 is inserted into the inner peripheral portion of the Z-axis pressing spring 286, so that the Z-axis pressing spring 286 is provided on the Z-axis suspension rod 278. The Z-axis pressing spring 286 is provided between the knob 278A of the Z-axis suspension rod 278 and the upper frame part 270. As a result, the Z-axis suspension rod 278 is biased upward (is biased so as to be lifted toward the upper frame part 270) by the biasing force of the Z-axis pressing spring 286.

Further, the locking bar 288 is provided at the tip (lower end) of the Z-axis suspension rod 278. The locking bar 288 is provided so as to protrude to the left and right from the tip of the Z-axis suspension rod 278 (is provided orthogonal to the axial direction of the Z-axis suspension rod 278). The locking bar 288 is formed so as to have a length larger than the width of the guide groove 256. The locking bar 288 locks the head module 210 by being fitted to the cutout portions 258A and 258B that are formed at the guide groove 256 of the head module 210.

The fitting of the locking bar 288 to the cutout portions 258A and 258B is performed by the rotation of the Z-axis suspension rod 278. That is, since the locking bar 288 is formed so as to have a length larger than the width of the guide groove 256 as described above, the locking bar 288 comes into contact with an inlet portion (upper end portion) of the guide groove 256 when the head module 210 is mounted on the base frame 212 while the locking bar 288 is parallel to the same direction as the width direction of the guide groove 256 (the X-axis direction). For this reason, the head module 210 cannot be mounted.

Accordingly, in order to mount the head module 210 on the base frame 212, an operator mounts the head module 210 on the base frame 212 while positioning the locking bar 288 at a position where the locking bar 288 does not come into contact with the inner wall surface of the guide groove 256. Then, when the head module 210 is mounted on the base frame 212 and the locking bar 288 is positioned at a position where the cutout portions 258A and 258B are formed, the operator rotates the Z-axis suspension rod 278. Accordingly, the locking bar 288 is fitted to the cutout portions 258A and 258B.

Meanwhile, when the axial direction of the locking bar 288 is parallel to the width direction of the guide groove 256 (the X-axis direction) as described above, the locking bar 288 is fitted to the cutout portions 258A and 258B. The position of the locking bar 288 at this time is referred to as a lock position.

Meanwhile, when the axial direction of the locking bar 288 is orthogonal to the width direction of the guide groove 256 (the X-axis direction), the locking bar 288 does not come into contact with the inner wall surface of the guide groove 256 (the locking bar 288 deviates from the cutout portions 258A and 258B). The position of the locking bar 288 at this time is referred to as a lock release position.

Since the Z-axis suspension rod 278 is biased upward by the Z-axis pressing spring 286, the locking bar 288 is engaged with the cutout portions 258A and 258B (the locking bar 288 is engaged with the ceiling surfaces of the inner peripheral portions of the cutout portions 258A and 258B) when the locking bar 288 is fitted to the cutout portions 258A and 258B. Accordingly, the head module 210 mounted on the base frame 212 is biased upward.

The base frame 212 is provided with a Y-axis base frame positioning device configured to position the head module 210 in the Y-axis direction when the head module 210 is mounted on the base frame 212 and a Z-axis base frame positioning device configured to position the head module 210 in the Z-axis direction when the head module 210 is mounted on the base frame 212.

The Y-axis base frame positioning device includes two Y-axis base frame positioning members 290 for stationary contact that form a Y-axis base frame positioning member and one Y-axis base frame positioning member 292 for movable contact that forms the Y-axis base frame positioning member.

Each of the two Y-axis base frame positioning members 290 for stationary contact is formed of a pin having stiffness (for example, a pin made of stainless steel), and has a hardness higher than the hardness of the Y-axis head module stationary contact member 234. The two Y-axis base frame positioning members 290 for stationary contact are formed so as to protrude to the lower side (downward in the Z-axis direction) from the lower surfaces of the lower frame parts 272A and 272B, respectively. The two Y-axis base frame positioning members 290 for stationary contact are disposed with the same interval as the interval between the two Y-axis head module stationary contact members 234 that are provided in the head module 210, and are provided at positions where the two Y-axis head module stationary contact members 234 come into contact with the peripheral surfaces of the Y-axis base frame positioning members 290 for stationary contact when the head module 210 is mounted on the base frame 212. That is, the two Y-axis base frame positioning members 290 for stationary contact are provided so as to correspond to the two Y-axis head module stationary contact members 234 provided in the head module 210.

The Y-axis base frame positioning member 292 for movable contact is formed of a pin having stiffness (for example, a pin made of stainless steel), and has a hardness higher than the hardness of the Y-axis head module movable contact member 236. The Y-axis base frame positioning member 292 for movable contact is received in recesses formed on the outer surfaces of the lower frame parts 272A and 272B and is disposed in the lower frame parts 272A and 272B. The Y-axis base frame positioning member 292 for movable contact is disposed in parallel to the Y-axis direction. The Y-axis base frame positioning member 292 for movable contact is provided at a position where the Y-axis head module movable contact member 236 provided in the head module 210 comes into contact with the end face of the Y-axis base frame positioning member 292 for movable contact when the head module 210 is mounted on the base frame 212. That is, the Y-axis base frame positioning member 292 for movable contact is provided so as to correspond to the Y-axis head module movable contact member 236 provided in the head module 210.

When the head module 210 is mounted on the base frame 212, the head module 210 is pressed toward the base frame 212 by the Y-axis pressing plates 280 of the Y-axis guide posts 276 as described above. Accordingly, when the head module 210 is mounted on the base frame 212, the two Y-axis head module stationary contact members 234 provided in the head module 210 come into pressure contact with the two Y-axis base frame positioning members 290 for stationary contact provided on the base frame 212. Further, the Y-axis head module movable contact member 236 provided in the head module 210 comes into pressure contact with the Y-axis base frame positioning member 292 for movable contact provided on the base frame 212. Accordingly, the head module 210 mounted on the base frame 212 is positioned relative to the base frame 212 in the Y-axis direction.

Meanwhile, as described above, the Y-axis base frame positioning member 290 for stationary contact has a hardness higher than the hardness of the Y-axis head module stationary contact member 234, and the Y-axis base frame positioning member 292 for movable contact has a hardness higher than the hardness of the Y-axis head module movable contact member 236. Accordingly, since the positional stability of the head module 210 at the time of the positioning of the head module 210 is improved, it is possible to improve the repeatability of a head module when the head module 210 is replaced.

A method of using a material having high hardness, a method of increasing hardness by performing surface treatment, or the like can be employed as a method of increasing hardness.

The Z-axis base frame positioning device configured to position the head module 210 relative to the base frame 212 in the Z-axis direction includes the pair of Z-axis base frame contact members 294.

Each of the pair of Z-axis base frame contact members 294 is formed of a pin having stiffness (for example, a pin made of stainless steel), and has a hardness higher than the hardness of the Z-axis head module contact member 242. The pair of Z-axis base frame contact members 294 are provided so as to protrude from the outer surfaces of the lower frame parts 272A and 272B, and are disposed in parallel to the Y-axis direction. The pair of Z-axis base frame contact members 294 are disposed with the same interval as the interval between the pair of Z-axis head module contact members 242 that are provided in the head module 210, and are provided at positions where the pair of Z-axis base frame contact members 294 come into contact with the Z-axis head module contact members 242 when the head module 210 is mounted on the base frame 212. That is, the pair of Z-axis base frame contact members 294 are provided so as to correspond to the Z-axis head module contact members 242 provided in the head module 210.

As described above, the head module 210 is biased upward by the operation of the Z-axis pressing spring 286 of the Z-axis suspension rod 278 when the head module 210 is mounted on the base frame 212. Accordingly, when the head module 210 is mounted on the base frame 212, the pair of Z-axis head module contact members 242 provided in the head module 210 come into contact with the pair of Z-axis base frame contact members 294 provided on the base frame 212. Therefore, the head module 210 is positioned relative to the base frame 212 in the Z-axis direction.

Meanwhile, as described above, each of the Z-axis base frame contact members 294 has a hardness higher than the hardness of the Z-axis head module contact member 242. Accordingly, since the positional stability of the head module 210 at the time of the positioning of the head module 210 is improved, it is possible to improve the repeatability of a head module when the head module 210 is replaced.

A method of using a material having high hardness, a method of increasing hardness by performing surface treatment, or the like can be employed as a method of increasing hardness.

The X-axis positioning reference pin 296, which is a component of the position adjusting device, is provided on the base frame 212. The X-axis positioning reference pin 296 is formed of a pin having stiffness (for example, a pin made of stainless steel), and is formed so as to protrude to the lower side (downward in the Z-axis direction) from the lower surfaces of the lower frame parts 272A and 272B. The X-axis positioning reference pin 296 is disposed at a position between the eccentric roller 248 and the plunger 250 provided in the head module 210 when the head module 210 is mounted on the base frame 212.

When the head module 210 is mounted on the base frame 212, the X-axis positioning reference pin 296 is fitted between the eccentric roller 248 and the plunger 250 and is interposed between the eccentric roller 248 and the plunger 250. When the eccentric roller 248 is rotated in this state, the head module 210 is displaced relative to the base frame 212 in the X-axis direction.

Further, the base frame 212 is provided with the magnetic sensor 298 that forms the position detecting device together with the magnet 260 provided in the head module 210. The magnetic sensor 298 is provided on the lower frame parts 272A and 272B. A magnetic sensor mounting portion 300 is provided at predetermined positions on the lower frame parts 272A and 272B. The magnetic sensor 298 is mounted on the magnetic sensor mounting portion 300. The magnetic sensor 298 mounted on the magnetic sensor mounting portion 300 is disposed at a position, which faces the magnet 260 provided in the head module 210, when the head module 210 is mounted on the base frame 212.

When the head module 210 mounted on the base frame 212 is displaced in the X-axis direction by the position adjusting device, the displacement of the head module 210 is detected by the magnetic sensor 298. Information about the displacement of the head module 210, which is detected by the magnetic sensor 298, is output to the system controller 100.

Meanwhile, the base frame 212 includes an electrical section (not shown), and transmits and receives various kinds of data to and from the system controller 100 through the electrical section. The electrical section is provided with a sensor control circuit that controls the operation of the magnetic sensor 298, a communication control circuit that is used to communicate with the system controller 100, and the like. Further, the base frame memory 110 is provided in the electrical section, and a control circuit that controls the reading and writing of the base frame memory 110 is also provided in the electrical section.

The electrical section includes cables (not shown). The base frame 212 of the inkjet head 200 mounted on the head unit body 34 is electrically connected to the head unit body 34 through the cables. Accordingly, various kinds of data can be transmitted and received between the system controller 100 of the inkjet recording device 10 and the base frame 212.

The base frame 212 has the above-mentioned structure.

Meanwhile, the material of the base frame 212 is not particularly limited, but it is preferable that a material hardly affected by heat is used to mount the head module 210 with high accuracy. Specifically, it is preferable that the base frame 212 is made of a material of which the coefficient of linear expansion is 10 ppm/° C. or less lower than the coefficient of linear expansion (about 15 ppm/° C.) of a ferrous material. Accordingly, it is possible to prevent the change of the mounting position of the head module 210 that is caused by the influence of heat. For example, ceramics, Invar, or Super Invar can be used as such a material.

<<Method of Assembling Inkjet Head>>

Next, a method of assembling the inkjet head 200 will be described.

Since the base frame 212 is provided with the head module support device as described above, the head module 210 is mounted on the base frame 212 by using the head module support device.

The head module support devices are alternately provided on the pair of lower frame parts 272A and 272B. Accordingly, the head modules 210 are alternately mounted on the pair of lower frame parts 272A and 272B. Since the method itself of mounting the head module is the same at any position, a case in which the head module is mounted on the lower frame part 272A will be described here.

The head module 210 is mounted on the base frame 212 by an operation for pushing the head module 210 up from the lower side of the base frame 212.

First, when the head module 210 is disposed at a position below the base frame 212, the horizontal portion 224 of the bracket 216 of the head module 210 is in a posture parallel to the upper frame part 270 of the base frame 212. Further, the vertical portion 226 of the bracket 216 is in a posture parallel to the lower frame part 272A of the base frame 212. In this state, the position of the guide groove 256 formed in the bracket 216 of the head module 210 is aligned with the positions of the Y-axis guide posts 276 provided on the lower frame part 272A of the base frame 212.

Figure 13:
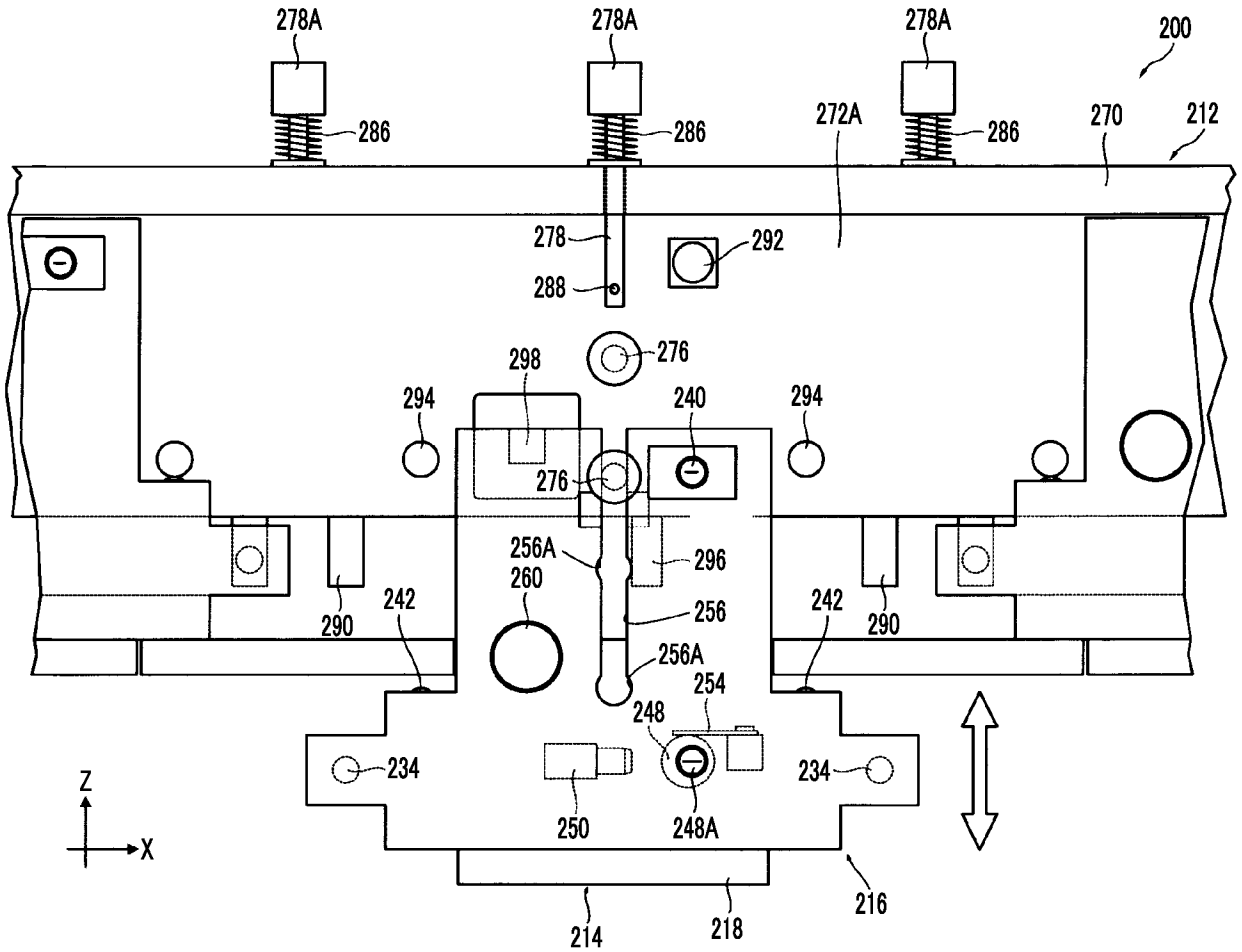
FIG. 13 is a view showing a method of assembling the head module.
Figure 14:
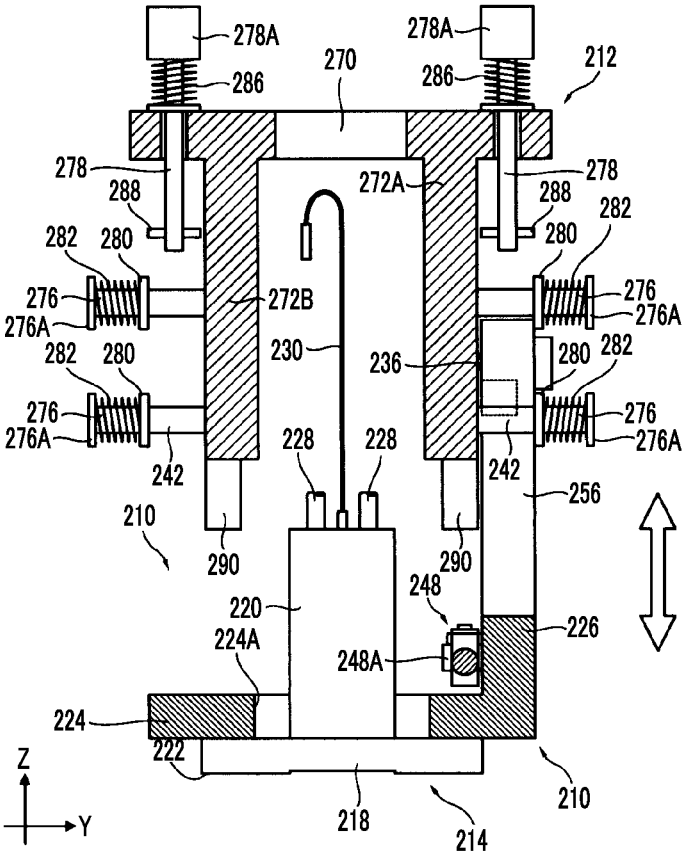
FIG. 14 is a view showing the method of assembling the head module.

Next, as shown in FIGS. 13 and 14, the head module 210 is pushed up toward the base frame 212 so that the Y-axis guide posts 276 are fitted to the guide groove 256. When the Y-axis guide posts 276 are fitted to the guide groove 256, the head module 210 is pushed up vertically while the Y-axis guide posts 276 serve as guides. Accordingly, it is possible to prevent shake or rattling at the time of the mounting of the head module and to prevent the head module 210 from coming into contact with other members (the mounted head modules 210 and the like).

When the Y-axis guide posts 276 are fitted to the guide groove 256, and the head module 210 is pushed up, the Z-axis suspension rod 278 provided on the base frame 212 is received in the guide groove 256.

Here, the Z-axis suspension rod 278 is provided with the locking bar 288. When the head module 210 is mounted on the base frame 212, the locking bar 288 is positioned at the lock release position so that the locking bar 288 do not come into contact with the inner wall surface of the guide groove 256. Accordingly, it is possible to prevent the hindrance to the movement of the head module 210 that is caused when the locking bar 288 comes into contact with the inlet portion of the guide groove 256.

When the head module 210 is pushed up toward the base frame 212 as described above, the pair of Z-axis head module contact members 242 provided on the bracket 216 of the head module 210 come into contact with the pair of Z-axis base frame contact members 294 provided on the base frame 212. Further, when the pair of Z-axis head module contact members 242 come into contact with the pair of Z-axis base frame contact members 294 provided on the base frame 212, the pair of cutout portions 258A and 258B formed on the guide groove 256 of the head module 210 are positioned at the installation position of the locking bar 288 provided at the Z-axis suspension rod 278. The Z-axis suspension rod 278 is rotated in this state, and positions the locking bar 288 at the lock position. Accordingly, the locking bar 288 is fitted to the cutout portions 258A and 258B and the locking bar 288 is locked to the ceiling surfaces of the inner peripheral portions of the cutout portions 258A and 258B. Therefore, the head module 210 is mounted on the base frame 212 while being suspended from the Z-axis suspension rod 278.

Here, the Z-axis suspension rod 278 is provided with the Z-axis pressing spring 286. For this reason, when being locked to the Z-axis suspension rod 278, the head module 210 is pushed up by the operation of the Z-axis pressing spring 286. As a result, the pair of Z-axis head module contact members 242 provided in the head module 210 come into contact with the pair of Z-axis base frame contact members 294 provided on the base frame 212. Accordingly, the head module 210 is positioned relative to the base frame 212 in the Z-axis direction.

Further, the pair of Y-axis guide posts 276, which are fitted to the guide groove 256, are provided with the Y-axis pressing springs 282. The Y-axis pressing springs 282 press the head module 210 toward the base frame 212 through the Y-axis pressing plates 280. As a result, the Y-axis head module stationary contact members 234 and the Y-axis head module movable contact member 236, which are provided in the head module 210, come into pressure contact with the Y-axis base frame positioning members 290 for stationary contact and the Y-axis base frame positioning member 292 for movable contact that are provided on the base frame 212. Accordingly, the head module 210 is positioned relative to the base frame 212 in the Y-axis direction.

Meanwhile, when the Z-axis head module contact members 242 come into contact with the Z-axis base frame contact members 294, the Y-axis guide posts 276 are received in the large-diameter portions 256A formed at the guide groove 256. Accordingly, the head module 210 is mounted on the base frame 212 so as to be displaceable in the X-axis direction.

Meanwhile, the positions of the Z-axis head module contact members 242 and the Y-axis head module movable contact member 236 can be adjusted, but it is preferable that the positions of the Z-axis head module contact members 242 and the Y-axis head module movable contact member 236 are adjusted in advance (for example, at the time of shipment from the factory).

The head module 210 is mounted on the base frame 212 as described above. This work is performed for all head modules 210. Since the head modules 210 are alternately mounted on the base frame 212 as described above, the mounting of the head modules 210 is alternately performed.

Meanwhile, it is preferable that the head modules 210 are mounted in order from one end of the base frame 212 toward the other end thereof or in order from the middle of the base frame toward the ends thereof. In this case, the head module 210, which is to be mounted at first, is mounted so as to correspond to a middle value of an adjustable range (±0: the middle position of a moving range) of displacement in the X-axis direction. Accordingly, since it is possible to reduce a risk that the mounting position of the subsequent head module 210 deviates from the adjustable range, it is possible to prevent a large adjustable range from being unnecessarily set.

The base frame 212 on which the head modules 210 are mounted is mounted on the holder (not shown) of the head unit body 34 and is mounted on the inkjet recording device 10.

<<Method of Positioning Head Module>>

The head module 210 is mounted on the base frame 212 by the above-mentioned mounting work. However, this mounting of the head module is the rough mounting (temporary mounting) of the head module. After that, an interval is accurately adjusted between the adjacent head modules so that a gap is not formed in the nozzle array at a joint between the head modules 210. That is, the positioning of each head module 210 is performed. A method of positioning the head modules 210 will be described below.

In the positioning of the head modules 210, a relative positional relationship between the respective head modules 210 mounted on the base frame 212 is detected first (for example, an interval between the nozzles of the adjacent head modules 210 is detected). Further, the positioning of the head modules 210 is performed by the adjustment of the mounting position of each head module 210 in the X-axis direction that is performed based on the result of the detection so that an interval between the respective head modules 210 is within an allowable range (the mounting position of each head module 210 in the X-axis direction is adjusted so that an interval between the nozzles of the adjacent head modules is within an allowable range).

Here, the detection of the relative positional relationship between the respective head modules 210 mounted on the base frame 212 is detected by, for example, the printing of a predetermined test pattern. That is, the inkjet head 200 in which the head modules 210 are assembled is mounted on the inkjet recording device, and records a predetermined test pattern on a medium. Further, the relative positional relationship between the respective head modules 210 is detected from the image of the obtained test pattern. Specifically, the image of the test pattern recorded on the medium is read by a scanner, and the relative positional relationship between the respective head modules 210, that is, a positional relationship between the nozzles provided at both ends is detected from the processing of data of the read image.

Alternatively, a relative positional relationship between the respective head modules 210 can also be detected when the nozzle face 222 of the inkjet head 200 is imaged by an electronic camera and obtained image data is processed.

After the relative positional relationship between the respective head modules 210 is detected in this way, the fine adjustment of the mounting position of each of the head modules 210 is performed by the position adjusting device. That is, the adjustment of the position of each head module 210 in the X-axis direction is performed so that an interval between the adjacent head modules 210 is within a preset allowable range.

The adjustment of the position in the X-axis direction, which is performed by the position adjusting device, is performed by the rotation of the eccentric roller 248 of each head module 210. The eccentric roller 248 is rotated by using a screwdriver. That is, since a groove for a screwdriver is formed on the end face of the base end portion of the shaft portion 248A of the eccentric roller 248, the tip of a screwdriver may be fitted to this groove and the shaft portion 248A may be rotated by the screwdriver so that the eccentric roller 248 is rotated.

When the shaft portion of the eccentric roller 248 is rotated, the eccentric roller 248 is eccentrically rotated. Further, the eccentric roller 248 is eccentrically rotated, so that the head module 210 is moved relative to the X-axis positioning reference pin 296, which serves as a reference, in the X-axis direction.

Here, when the head module 210 is moved in the X-axis direction, the displacement of the head module 210 is detected by the magnetic sensor 298. Information about the detected displacement is output to the system controller 100 of the inkjet recording device 10. The system controller 100 outputs the obtained information about the displacement to the display unit 104. An operator rotates the eccentric roller 248 by a required angle based on the information about the displacement that is displayed on the display unit 104.

Meanwhile, the amounts of correction of the respective head modules 210 are determined from the relative positional relationship between the respective head modules 210. That is, the amount of correction of the mounting position of each head module 210 is obtained so that an interval between the adjacent head modules 210 is within a preset allowable range.

The system controller 100 acquires information about the relative position of each head module 210 (head module position information), and calculates the amount of correction that allows an interval between the adjacent head modules 210 to be within an allowable range. Information about the calculated amount of correction of the mounting position of each head module 210 is displayed on, for example, the display unit 104 of the inkjet recording device 10. An operator adjusts the mounting position of the head module 210 by moving the head module 210 based on the information about the amount of correction that is displayed on the display unit.

The mounting of the head module 210 and the adjustment of the position (positioning) of the head module 210 are completed by a series of work that has been described above.

<<Method of Removing Head Module>>

The removal of the head module 210 is performed in the following manner.

The locking bar 288 of the Z-axis suspension rod 278 is engaged with the cutout portions 258A and 258B of the bracket 216, so that the head module 210 is mounted on the base frame 212.

First, an operator releases the engagement of the locking bar 288. That is, an operator moves the locking bar 288 to a lock release position by rotating the Z-axis suspension rod 278. Accordingly, the locking bar 288 deviates from the cutout portions 258A and 258B, so that the engagement between the head module 210 and the locking bar 288 is released.

After the engagement between the head module 210 and the locking bar 288 is released, the operator pulls the head module 210 down. Accordingly, the head module 210 is removed from the base frame 212.

Meanwhile, since the pair of Y-axis guide posts 276 serve as a guide when the head module 210 is pulled down, the head module 210 can be removed without coming into contact with the other head modules 210.

<<Method of Replacing Head Module>>

Each head module 210 is detachably mounted on the base frame 212 as described above. Accordingly, when a failure occurs on only a specific head module 210, only the head module 210 on which the failure occurs can be replaced. When the replacement of the head module 210 is performed, the positioning of the head module 210 is performed again. That is, the head module 210 is standardized, but there are variations in the position of the nozzle and the like due to manufacturing errors or the like. Accordingly, even though a new head module is mounted at the position of the head module after the removal of the head module on which the failure occurs, nozzles are not necessarily disposed at the same positions. For this reason, when a head module 210 is replaced, an operation for positioning the head module is performed again. In the inkjet recording device 10 according to this embodiment, an operation for positioning a head module at the time of the replacement of the head module is performed by the following procedure.

First, information about the position of the X-axis positioning reference pin 296, which is required to adjust the position of the replaced head module 210, and information about the positions of nozzles provided on the nozzle face of the replaced head module 210 are acquired. Further, the positions of the nozzles of the replaced head module 210 (the positions of the nozzles on the base frame 212) are calculated based on the obtained information.

Next, information about the positions of the nozzles of each head module 210 mounted on the base frame 212 (the positions of the nozzles on the base frame 212) is acquired. Furthermore, an interval between the replaced head module 210 and a head module 210, which is adjacent to the replaced head module 210, is calculated based on the information about the positions of the nozzles of the replaced head module 210 (the positions of the nozzles on the base frame 212) that have been previously calculated. Specifically, a distance between a nozzle that is positioned at one end of the replaced head module 210 and a nozzle that is positioned at one end (an end portion facing the replaced head module) of a head module 210 adjacent to one end of the replaced head module 210, and a distance between a nozzle that is positioned at the other end of the replaced head module 210 and a nozzle that is positioned at one end (an end portion facing the replaced head module) of the head module 210 adjacent to the other end of the replaced head module 210 are calculated.

Next, the amount of correction of the mounting position of the head module 210, which allows the calculated distances to be within a preset allowable range, is calculated.

Further, the mounting position of the replaced head module 210 is adjusted according to information about the calculated amount of correction of the position.

In the inkjet recording device 10 according to this embodiment, information about the correction of the mounting position of the head module 210 subjected to replacement is acquired by calculation in this way.

A method of replacing the head module 210, which is performed by the inkjet recording device 10 according to this embodiment, will be described below in detail.

As described above, information about the position of the X-axis positioning reference pin 296, information about the positions of the nozzles provided on the nozzle face of each head module 210, and information about the positions of the nozzles of each head module 210 mounted on the base frame 212 (information about the positions of the nozzles on the base frame 212) are required in advance in the method of replacing the head module 210 of this embodiment.

Figure 15:
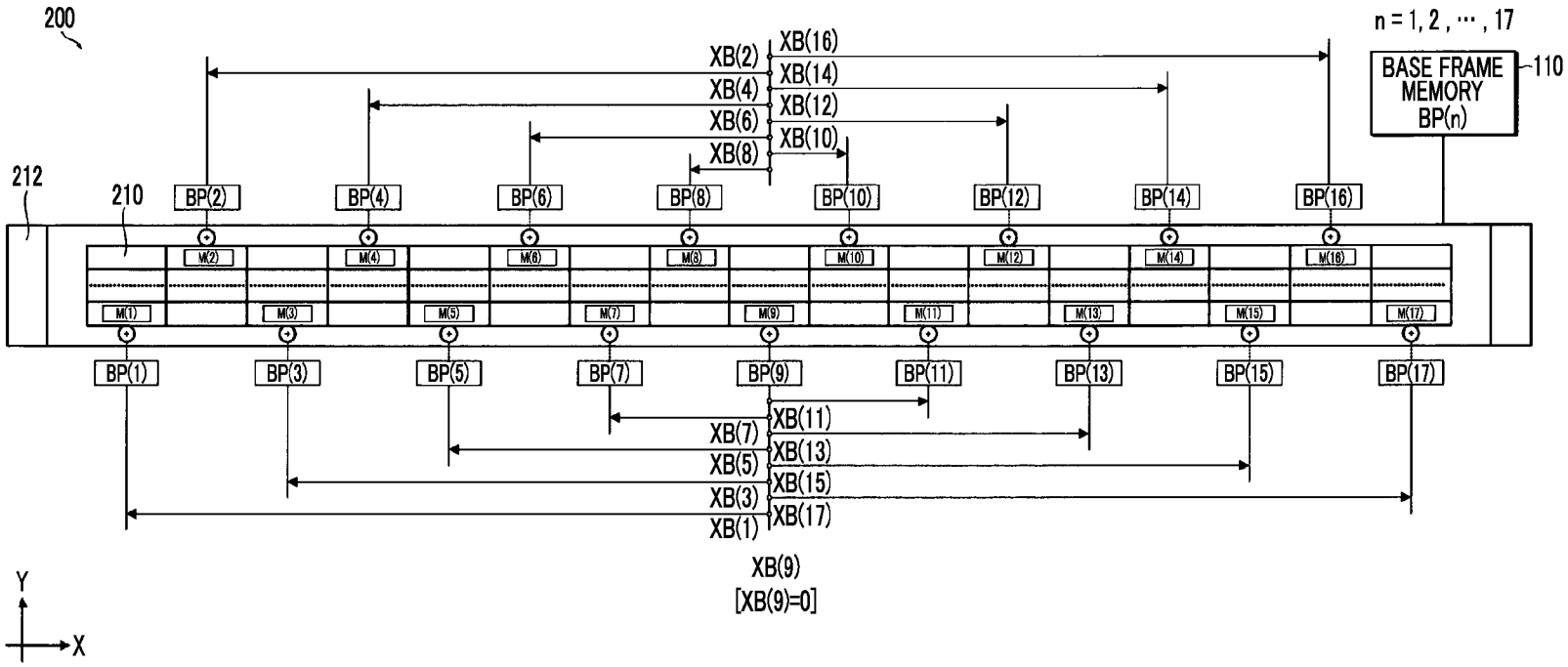
FIG. 15 is a schematic view showing the concept of the positions of X-axis positioning reference pins.

FIG. 15 is a schematic view showing the concept of the positions of the X-axis positioning reference pins.

The inkjet head 200 of this embodiment includes seventeen head modules 210 that are joined in a line. For this reason, the base frame 212 is provided with seventeen head module support devices. Further, the X-axis positioning reference pin 296 is provided so as to correspond to each head module support device.

The position of each X-axis positioning reference pin 296 is detected while the position of a middle X-axis positioning reference pin 296 is used as a reference. That is, the position of each X-axis positioning reference pin 296 is acquired as information about a distance from the middle X-axis positioning reference pin 296.

Here, when the respective X-axis positioning reference pins 296 provided on the base frame 212 are numbered BP(1), BP(2), . . . , BP(17) in order from one end (the left end of FIG. 15) of the base frame 212 and the positions of the respective X-axis positioning reference pins BP(1), BP(2), . . . , BP(17) are denoted by XB(1), XB(2), . . . , XB(17), the respective positions XB(1), XB(2), . . . , XB(17) are obtained as distances (distances in the X-axis direction) between the X-axis positioning reference pins BP(1), BP(2), . . . , BP(17) and the middle X-axis positioning reference pin BP(9). Accordingly, the position of the middle X-axis positioning reference pin BP(9) corresponds to zero.

Meanwhile, in FIG. 15, for the convenience of description, the position of the center of each X-axis positioning reference pin BP(n) (n is an integer in the range of 1 to 17) is shown as the position of each X-axis positioning reference pin (support reference point). However, exactly, the position of a contact point between the eccentric roller 248 of the head module 210 and the X-axis positioning reference pin is the position of the X-axis positioning reference pin (support reference point).

For example, the base frame 212 is imaged by an electronic camera and the image data of the base frame is processed, so that the position XB(n) of each X-axis positioning reference pin is detected. Alternatively, the position XB(n) of each X-axis positioning reference pin is detected by using a three-dimensional coordinate measuring machine.

Information about the position XB(n) of each X-axis positioning reference pin, which is obtained in this way, is stored in the base frame memory 110 provided on the base frame 212.

Further, the detection of the position XB(n) of each X-axis positioning reference pin is performed, for example, at the stage of manufacturing the base frame memory 110, the stage of shipment from the factory, or the like.

Figure 16:
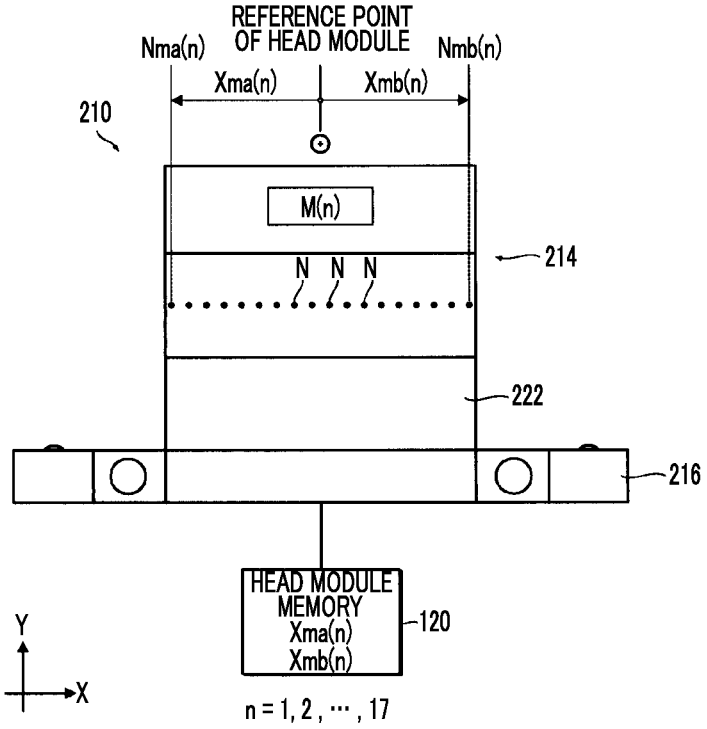
FIG. 16 is a schematic view showing the concept of the positions of nozzles that are provided on a nozzle face of the head module.

FIG. 16 is a schematic view showing the concept of the positions of the nozzles that are provided on the nozzle face of the head module.

Information about the positions of the nozzles N provided on the nozzle face 222 of the head module 210 is acquired as information about the positions of the nozzles that are disposed at both ends of the nozzle array. Further, the positions of the nozzles disposed at both ends of the nozzle array are acquired as information about distances (distances in the X-axis direction) from a specific reference point that is set at the head module 210.

For example, the eccentric roller 248 is used as the specific reference point set at the head module 210, and the position of a contact point between the eccentric roller 248 and the X-axis positioning reference pin 296 is set at the specific reference point (the reference point is set at the position of a contact point between the eccentric roller 248 and the X-axis positioning reference pin 296 when the eccentric roller 248 corresponds to a middle value (±0) of an adjustable range of displacement).

When the nozzle disposed at one end of the nozzle array is denoted by Nma(n), the nozzle disposed at the other end thereof is denoted by Nmb(n), the position of the nozzle Nma(n) is denoted by Xma(n), and the position of the nozzle Nmb(n) is denoted by Xmb(n), the position Xma(n) of the nozzle Nma(n) is acquired as a distance (a distance in the X-axis direction) between the reference point and the nozzle Nma(n) and the position Xmb(n) of the nozzle Nmb(n) is acquired as a distance (a distance in the X-axis direction) between the reference point and the nozzle Nmb(n) as shown in FIG. 16.

For example, the positions of the nozzles Nma(n) and Nmb(n) on the nozzle face are detected and distances (distances in the X-axis direction) from the reference point are calculated, so that the position Xma(n) of the nozzle Nma(n) and the position Xmb(n) of the nozzle Nmb(n) are acquired. The nozzle face 222 is imaged by an electronic camera and an obtained image is processed, so that the positions of the nozzles Nma(n) and Nmb(n) on the nozzle face are detected. Further, the position of the reference point (the position of a contact point between the eccentric roller 248 and the X-axis positioning reference pin 296 when the eccentric roller 248 corresponds to a middle value (±0) of an adjustable range of displacement) is detected by using, for example, a three-dimensional coordinate measuring machine.

Information about the positions Xma(n) and Xmb(n) of the nozzles, which is obtained in this way, is stored in the head module memory 120 of the head module 210.

The detection of the positions Xma(n) and Xmb(n) of the nozzles is performed, for example, at the stage of manufacturing the head module 210 or the stage of shipment from the factory.

Figure 17:
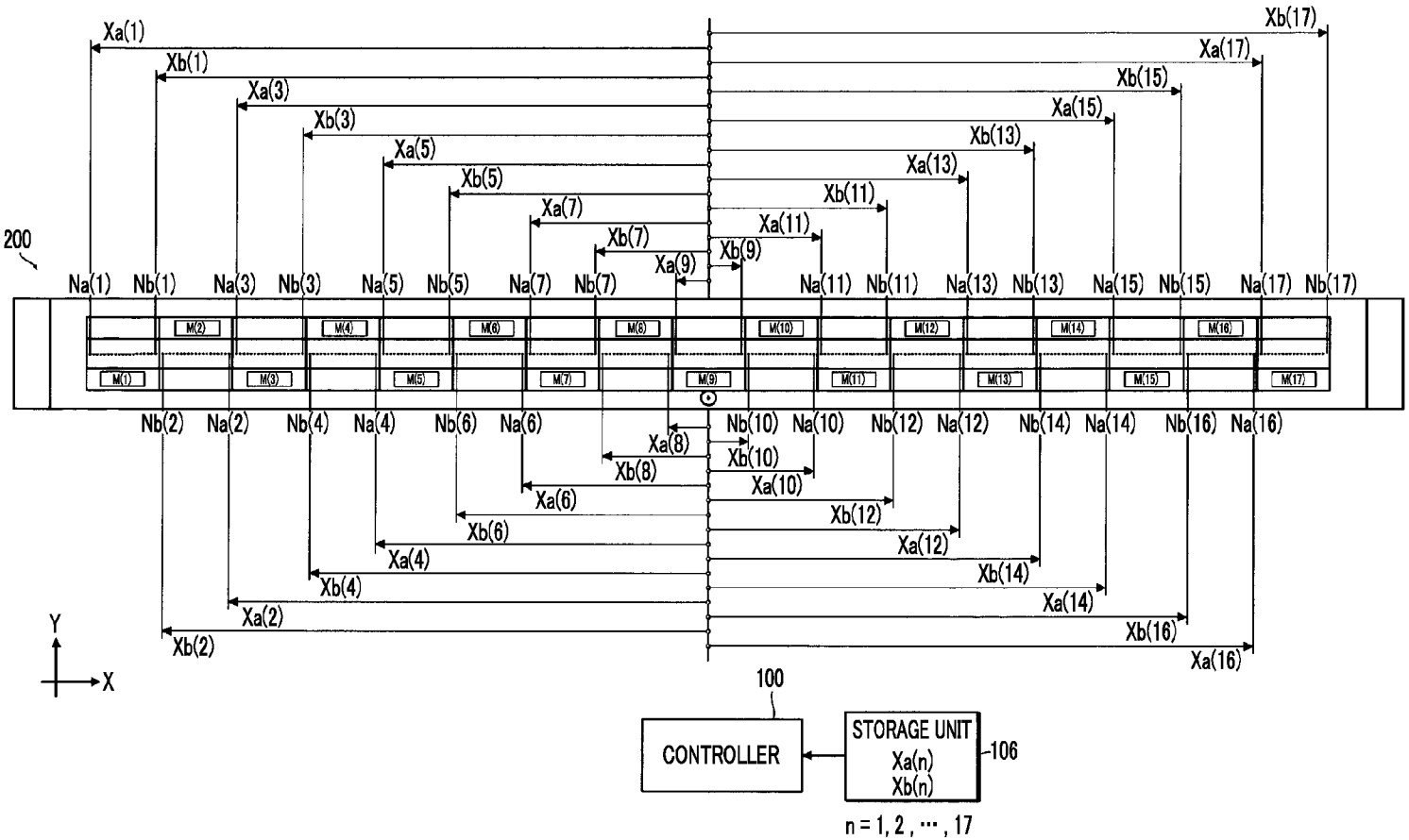
FIG. 17 is a schematic view showing the concept of the positions of the nozzles of each head module that is mounted on the base frame.

FIG. 17 is a schematic view showing the concept of the positions of the nozzles of each head module that is mounted on the base frame.

When the respective head modules 210 are mounted on the base frame 212, the respective head modules 210 are disposed at certain positions on the base frame 212. Accordingly, the nozzles of each head module 210 are also disposed at certain positions on the base frame 212.

The nozzles of each head module 210, which is mounted on the base frame 212, are acquired as information about the positions of the nozzles (the positions of the nozzles on the base frame 212) that are positioned at both ends of the nozzle array of each head module 210. Further, the positions of the nozzles are acquired as information about distances (distances in the X-axis direction) from a specific reference point that is set at the base frame 212.

Here, the middle X-axis positioning reference pin BP(9) is used as the specific reference point set at the base frame 212, and the position of a contact point between the middle X-axis positioning reference pin BP(9) and the eccentric roller 248, which comes into contact with the X-axis positioning reference pin BP(9), is set at the reference point.

When the head modules 210 mounted on the base frame 212 are numbered M(1), M(2), . . . , M(17) in order from one end (the left end of FIG. 17) of the base frame 212, the nozzles disposed at both ends of the nozzle array of each head module M(n) are denoted by Na(1), Nb(1), Na(2), Nb(2), . . . , Na(17), and Nb(17), and the positions of the nozzles Na(1), Nb(1), Na(2), Nb(2), . . . , Na(17), and Nb(17) are denoted by Xa(1), Xb(1), Xa(2), Xb(2), . . . , Xa(17), and Xb(17), the positions Xa(1), Xb(1), Xa(2), Xb(2), . . . , Xa(17), and Xb(17) of the respective nozzles Na(1), Nb(1), Na(2), Nb(2), . . . , Na(17), and Nb(17) are obtained as distances (distances in the X-axis direction) from the middle X-axis positioning reference pin BP(9) as shown in FIG. 17.

For example, the positions of the respective nozzles Na(1), Nb(1), Na(2), Nb(2), . . . , Na(17), and Nb(17) on the nozzle face are detected by the nozzle position detecting device and distances (distances in the X-axis direction) from the reference point are calculated, so that the positions Xa(1), Xb(1), Xa(2), Xb(2), . . . , Xa(17), and Xb(17) of the respective nozzles Na(1), Nb(1), Na(2), Nb(2), . . . , Na(17), and Nb(17) are acquired.

The nozzle position detecting device includes, for example, a scanner and an image processing device. In this case, a test pattern is printed by the inkjet head and the obtained image of the test pattern is read by a scanner. Further, the nozzle position detecting device processes the read image by the image processing device and detects the positions of the nozzles. The scanner may be mounted on the inkjet recording device or may be installed outside the inkjet recording device.

Alternatively, the nozzle position detecting device may include, for example, an electronic camera and an image processing device. In this case, the nozzle face of the inkjet head is imaged by the electronic camera and an obtained image is processed by the image processing device, so that the nozzle position detecting device detects the positions of the nozzles.

Furthermore, the position of the reference point (the position of the middle X-axis positioning reference pin BP(9)) is detected by using, for example, a three-dimensional coordinate measuring machine.

Information about the positions Xa(1), Xb(1), Xa(2), Xb(2), . . . , Xa(17), and Xb(17) of the nozzles Na(1), Nb(1), Na(2), Nb(2), . . . , Na(17), and Nb(17) of each head module 210 on the base frame 212, which is obtained in this way, is stored in the storage unit 106 of the inkjet recording device 10.

The detection of the positions Xa(n) and Xb(n) of the nozzles of each head module on the base frame 212 is performed at the stage of assembling the inkjet head 200, the stage of shipment from the factory, or the like.

As described above, information, which is required to obtain the amount of correction of the mounting position of a replaced head module M(n), is acquired in advance and is stored in a predetermined storage device.

That is, information (first information) about the position XB(n) of each X-axis positioning reference pin provided on the base frame 212, information (second information) about the positions Xma(n) and Xmb(n) of the nozzles of each head module 210, and information (third information) about the positions Xa(n) and Xb(n) of the nozzles of each head module M(n) on the base frame 212 are required to obtain the amount of correction of the mounting position of the replaced head module M(n). However, the information about the position XB(n) of each X-axis positioning reference pin provided on the base frame 212 is stored in the base frame memory 110 (first storage device) provided on the base frame 212, the information about the positions Xma(n) and Xmb(n) of the nozzles of each head module 210 is stored in the head module memory 120 (the second storage device), and the information about the positions Xa(n) and Xb(n) of the nozzles of each head module M(n) on the base frame 212 is stored in the storage unit 106 (third storage device) of the inkjet recording device 10.

When the head module memory 120 is replaced, the system controller 100 of the inkjet recording device 10 acquires these kinds of information and calculates information that is required to mount the replaced head module 210 at a normal position. That is, the amount of correction of the mounting position, which is required to mount the replaced head module 210 at a normal position, is calculated.

Figure 18:
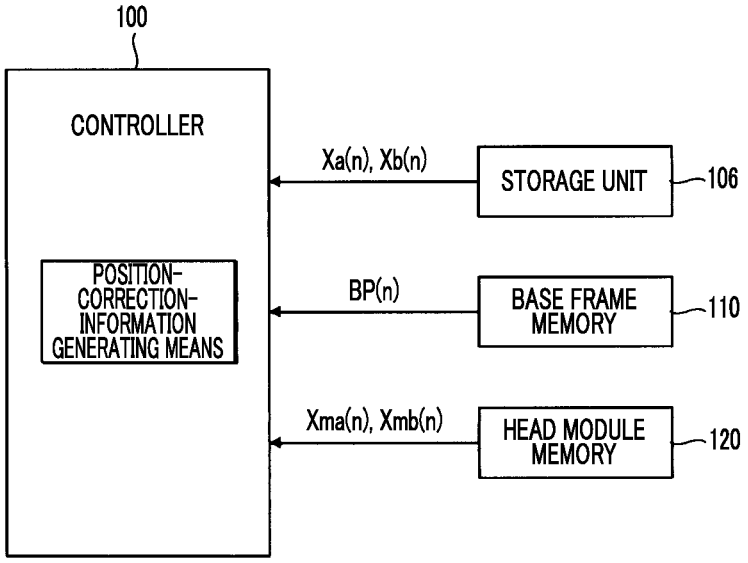
FIG. 18 is a functional block diagram of a system controller when the amount of correction of a mounting position is calculated.

FIG. 18 is a functional block diagram of the system controller when the amount of correction of the mounting position is calculated.

The system controller 100 functions as a position-correction-information generating device configured to calculate the amount of correction of the mounting position, which is required to mount the replaced head module 210 at a normal position, by executing a predetermined program.

A procedure for calculating the amount of correction of the mounting position by the system controller 100 will be described below.

Here, the following description will be made on the assumption that the N-th head module M(N) is replaced.

When the N-th head module M(N) is replaced, the system controller 100 acquires information about the positions Xma(N) and Xmb(N) of nozzles of a replaced head module M(N). Further, the system controller 100 acquires information about the position XB(N) of an X-axis positioning reference pin of the replaced head module M(N) (information about the position XB of the N-th X-axis positioning reference pin).

For example, when a third head module M(3) is replaced, the system controller 100 acquires information about the positions Xma(3) and Xmb(3) of nozzles of the head module M(3) and information about the position XB(3) of the third X-axis positioning reference pin BP(3).

The information about the positions Xma(N) and Xmb(N) of the nozzles is acquired from a head module memory 120 of the replaced head module M(N) and the information about the position XB(N) of the X-axis positioning reference pin is acquired from the base frame memory 110.

The system controller 100 calculates the positions Xa(N) and Xb(N) of the nozzles of the replaced head module 210 on the base frame from the information about the positions Xma(N) and Xmb(N) of the nozzles and the information about the position XB(N) of the X-axis positioning reference pin that have been acquired.

For example, when the third head module M(3) is replaced, the system controller 100 calculates the positions Xa(3) and Xb(3) of the nozzles of the third head module M(3) on the base frame from the information about the positions Xma(3) and Xmb(3) of the nozzles and the information about the position XB(3) of the third X-axis positioning reference pin BP(3), which have been previously acquired.

Next, the system controller 100 acquires information about the positions Xa(n) and Xb(n) of the nozzles of each head module M(n) on the base frame 212 [n=1, 2, . . . , 17, except for information about the positions of the nozzles of the replaced head module M(N)]. The information about the positions Xa(n) and Xb(n) of the nozzles of each head module M(N) on the base frame 212 is acquired from the storage unit 106. Further, the system controller 100 acquires information about the positions of nozzles of head modules M(N−1) and M(N+1), which are adjacent to the replaced head module M(N), based on the obtained information about the positions Xa(n) and Xb(n) of the nozzles.

Here, when the replaced head module M(N) is an even-numbered head module, information about the position Xb(N−1) of one nozzle of the head module M(N−1) and information about the position Xa(N+1) of one nozzle of the head module M(N+1) are acquired.

Furthermore, when the replaced head module M(N) is an odd-numbered head module, information about the position Xa(N−1) of one nozzle of the head module M(N−1) and information about the position Xb(N+1) of one nozzle of the head module M(N+1) are acquired.

For example, when the third head module M(3) is replaced, the system controller 100 acquires information about the positions of the nozzles of the second and fourth head modules M(2) and M(4). Here, since the replaced head module is an odd-numbered head module, the system controller 100 acquires information about the position Xa(2) of a nozzle positioned at the right end of the second head module M(2) and information about the position Xb(4) of a nozzle positioned at the left end of the fourth head module M(4).

Next, the system controller 100 calculates distances X(N−1) and X(N+1) between the replaced head module M(N) and the adjacent head modules M(N−1) and M(N+1) based on the obtained information about the positions of the nozzles. That is, the system controller 100 calculates distances (distances in the X-axis direction) between the nozzle of the replaced head module and the nozzles of the adjacent head modules.

Meanwhile, the distance X(N−1) is a distance between the replaced head module M(N) and the head module M(N−1) that is positioned on the left side of the replaced head module M(N) so as to be adjacent to the replaced head module M(N) (a distance between the nozzle positioned at the left end of the replaced head module M(N) and the nozzle positioned at the right end of the head module M(N−1) positioned on the left side of the replaced head module M(N) so as to be adjacent to the replaced head module M(N)).

Further, the distance X(N+1) is a distance between the replaced head module M(N) and the head module M(N+1) that is positioned on the right side of the replaced head module M(N) so as to be adjacent to the replaced head module M(N) (a distance between the nozzle positioned at the right end of the replaced head module M(N) and the nozzle positioned at the left end of the head module M(N−1) positioned on the left side of the replaced head module M(N) so as to be adjacent to the replaced head module M(N)).

For example, when the third head module M(3) is replaced, distances X(2) and X(4) between the third head module M(3) and the second and fourth head modules M(2) and M(4) are calculated. Further, the distance X(2) is calculated from "Xa(2)−Xa(3)" and the distance X(4) is calculated from "Xb(4)−Xb(3)".

Next, the system controller 100 calculates the amount ΔX of correction of the mounting position, which is required to mount the replaced head module M(N) at a normal mounting position, based on information about the obtained distances X(N−1) and X(N+1). That is, the system controller 100 calculates the amount ΔX of correction of the position that allows the distances X(N−1) and X(N+1) between the replaced head module M(N) and the adjacent head modules to be within an allowable range.

For example, when the distances X(N−1) and X(N+1) between the replaced head module M(N) and the adjacent head modules are 7 and 2, respectively, (X(N−1)=7 and X(N+1)=2) and the allowable range is 5±2, the amount of correction is calculated as, for example, −1 (ΔX=−1, the moving distance of the replaced head module to the left side is 1) (ΔX can be set in the range of −4 to −1. In this embodiment, a value where the moving distance is a minimum is calculated as the amount of correction). In this case, the distances X(N−1) and X(N+1) between the replaced head module M(N) and the adjacent head modules after correction are 6 and 3, respectively, [X(N−1)=6 and X(N+1)=3].

In this way, the system controller 100 calculates the amount ΔX of correction of the mounting position, which is required to mount the replaced head module M(N) at a normal mounting position, based on information about the obtained distances X(N−1) and X(N+1). Further, the system controller 100 displays information about the calculated amount ΔX of correction on the display unit 104.

An operator corrects the position of the replaced head module M(N) according to the display of the display unit 104. That is, the operator finely adjusts the position of the head module M(N) by rotating an eccentric roller 248 of the replaced head module M(N).

Here, examples of the form of the display of the amount of correction on the display unit 104 can include the form of an indicator other than a form in which the calculated amount of correction is displayed as a numerical value. In this case, the indicator can indicate only a correction direction (a positive direction or a negative direction), and can output a display showing that an interval between the replaced head module and the adjacent head module is within an allowable range when the interval is within the allowable range (for example, when the interval is within the allowable range, a predetermined lamp is turned on). The system controller 100 determines whether or not the interval is within the allowable range based on information about the displacement of the head modules M(N) detected by the magnetic sensors 298, and outputs a display showing that the interval is within the allowable range when the interval is within the allowable range.

Work for replacing the head module is completed by a series of work that has been described above.

When the replacement of the head module is completed, the positions Xa(n) and Xb(n) of the nozzles of each head module M(n) on the base frame, which are stored in the storage unit 106, are updated. That is, the positions Xa(N) and Xb(N) of the nozzles of the replaced head module M(N) on the base frame are rewritten by the system controller (updating device) 100.

In this case, the system controller 100 calculates the positions Xa(N) and Xb(N) of the nozzles of the replaced head module M(N) on the base frame based on the information about the displacement of the head modules M(N) detected by the magnetic sensors 298 (=information about the positions of the head modules M(N)), information (first information) about the position XB(n) of the X-axis positioning reference pin that supports the replaced head module, and information (second information) about the positions of the nozzles of the replaced head module; and updates the information, which is stored in the storage unit 106, with the calculated information.

Meanwhile, information about the positions Xa(N) and Xb(N) of the nozzles of the replaced head module M(N) on the base frame is acquired based on information about the moving distance of the head module M(N) that is output from the magnetic sensor 298. That is, since the positions Xma(N) and Xmb(N) of the nozzles of the replaced head module M(N) are already known and information about the position XB(N) of the X-axis positioning reference pin BP(N) of the replaced head module M(N) is also already known, the positions Xa(N) and Xb(N) of the nozzles of the head module M(N), of which the position has been adjusted, on the base frame can be calculated if the moving distance of the head module M(N) moved during the adjustment of position and information about the moving direction thereof can be acquired.

As described above, according to the method of replacing the head module of this embodiment, it is possible to obtain the amount of correction of the mounting position, which is required to mount the replaced head module M(N) at a normal position, without the printing of a test pattern or the like. Accordingly, it is possible to replace the head module in a short time.

Meanwhile, after the above-mentioned replacement processing is performed, it may be confirmed whether or not the replaced head module M(N) is mounted at a normal mounting position. That is, after the head module M(N) is replaced, the positions of the nozzles of each head module on the base frame are detected by the nozzle position detecting device and it is confirmed whether or not the replaced head module M(N) is mounted at a normal mounting position.

The nozzle position detecting device may include, for example, a scanner and an image processing device. In this case, a test pattern is printed by the inkjet head of which the head module M(N) has been replaced, and the obtained image of the test pattern is read by a scanner. Further, the nozzle position detecting device processes the read image by the image processing device and detects the positions of the nozzles. The scanner may be mounted on the inkjet recording device or may be installed outside the inkjet recording device.

Alternatively, the nozzle position detecting device may include, for example, an electronic camera and an image processing device. In this case, the nozzle face of the inkjet head is imaged by the electronic camera and an obtained image is processed by the image processing device, so that the nozzle position detecting device detects the positions of the nozzles.

It is possible to more accurately mount the head module by performing the above-mentioned confirmation processing.

Meanwhile, when it is confirmed from this confirmation processing that the nozzles of each head module of the inkjet head subjected to replacement are not arranged at normal positions (when a distance between the adjacent head modules is not within an allowable range), necessary correction processing (processing for allowing the distance to be within the allowable range) is performed.

Further, when processing for detecting the positions of the nozzles of each head module of the inkjet head subjected to replacement is performed in this way, information about the positions Xa(n) and Xb(n) of the nozzles of each head module M(n) on the base frame, which is stored in the storage unit 106, is updated with information about the detected positions of the nozzles. Accordingly, information (third information) to be stored in the storage unit 106 can be made accurate. That is, since information about the positions of the nozzles actually detected is stored, it is possible to store information more accurate than information that is obtained by calculation.

<<Method of Replacing Head Module of Second Embodiment>>

In the above-mentioned embodiment, the positions Xa(n) and Xb(n) of the nozzles of each head module M(N) on the base frame are detected by the printing of a test pattern or the like. However, it is possible to specify the positions Xa(n) and Xb(n) of the nozzles of each head module M(N) on the base frame when the position of each head module M(n) on the base frame and the positions Xma(n) and Xmb(n) of the nozzles of each head module M(n) are known.

Further, it is possible to specify the position of each head module M(n) on the base frame when the position XB(n) of each X-axis positioning reference pin BP(n) provided on the base frame 212 and the position of the head module M(n) relative to the X-axis positioning reference pin BP(n) are known.

The position of the X-axis positioning reference pin BP(n) is fixed and the position of the head module M(n) relative to the X-axis positioning reference pin BP(n) can be obtained as the displacement of the head module M(n) mounted on the base frame 212. Furthermore, this information can be acquired from the magnetic sensor 298.

As described above, the positions Xa(n) and Xb(n) of the nozzles of each head module M(N) on the base frame can be obtained from information about the position XB(n) of each X-axis positioning reference pin BP(n) provided on the base frame 212, information about the positions Xma(n) and Xmb (n) of the nozzles of each head module M(n), and information about the position of the head module M(n) relative to the X-axis positioning reference pin BP(n) (information about the displacement of each head module M(n) mounted on the base frame 212).

Accordingly, the information (third information) about the positions Xa(n) and Xb(n) of the nozzles of each head module M(n) on the base frame can be acquired without the printing of a test pattern or the like.

Figure 19:
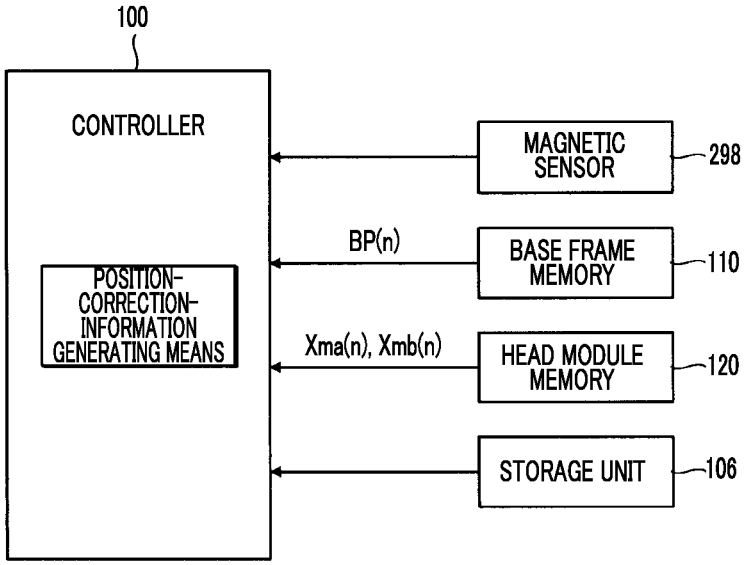
FIG. 19 is a functional block diagram of the system controller when the amount of correction of the mounting position is calculated.

FIG. 19 is a functional block diagram of the system controller when information about the positions of the nozzles of each head module and information about the position of each head module on the base frame are acquired and the amount of correction of the mounting position is calculated.

The system controller 100 acquires information about the position XB(n) of each X-axis positioning reference pin BP(n) provided on the base frame 212, information about the positions Xma(n) and Xmb(n) of the nozzles of each head module M(n), and information about the position of the head module M(n) relative to the X-axis positioning reference pin BP(n) (information about the displacement of each head module M(n) mounted on the base frame 212); and calculates the amount of correction of the mounting position that is required to mount the replaced head module 210 at a normal position.

Meanwhile, the system controller 100 realizes a function as the position-correction-information generating device by executing a predetermined program.

A procedure for calculating the amount of correction of the mounting position by the system controller 100 will be described below.

Here, the following description will be made on the assumption that the N-th head module M(N) is replaced.

When the N-th head module M(N) is replaced, the system controller 100 acquires information about the positions Xma (N) and Xmb(N) of nozzles of a replaced head module M(N). Further, the system controller 100 acquires information about the position XB(N) of an X-axis positioning reference pin of the replaced head module M(N) (information about the position XB of the N-th X-axis positioning reference pin).

The information about the positions Xma(N) and Xmb(N) of the nozzles is acquired from a head module memory 120 of the replaced head module M(N) and the information about the position XB(N) of the X-axis positioning reference pin is acquired from the base frame memory 110.

The system controller 100 calculates the positions Xa(N) and Xb(N) of the nozzles of the replaced head module 210 on the base frame from the information about the positions Xma (N) and Xmb(N) of the nozzles and the information about the position XB(N) of the X-axis positioning reference pin that have been acquired.

Next, the system controller 100 calculates the positions Xa(n) and Xb(n) of the nozzles of each head module M(n) on the base frame 212. The positions Xa(n) and Xb(n) of the nozzles of each head module M(n) on the base frame 212 can be obtained from the positions Xma(n) and Xmb(n) of the nozzles of each head module M(n) and information about the position of each head module M(n) on the base frame. Further, the position of each head module M(n) on the base frame can be obtained from the information about the position XB(n) of the X-axis positioning reference pin BP(n) corresponding to each head module M(n) and the information about the position of the head module M(n) relative to the X-axis positioning reference pin BP(n).

Here, the position of the head module M(n) relative to the X-axis positioning reference pin BP(n) is specified as the displacement of the head module M(n) after the head module M(n) is mounted on the base frame 212. The system controller 100 acquires information about the displacement of each head module M(n) from the magnetic sensor 298 corresponding to each head module M(n), and acquires information about the position of each head module M(n) relative to the X-axis positioning reference pin BP(n).

The system controller 100 calculates the positions Xa(n) and Xb(n) of the nozzles of each head module M(n) on the base frame 212 based on the acquired information, that is, the information about the positions Xma(n) and Xmb(n) of the nozzles of each head module M(n), the information about the position XB(n) of the X-axis positioning reference pin BP, and the information about the displacement of each head module M(n) obtained from the magnetic sensor 298.

Next, the system controller 100 calculates the distances X(N−1) and X(N+1) between the replaced head module M(N) and the adjacent head modules M(N−1) and M(N+1) based on the information about the obtained positions of the nozzles. That is, the system controller 100 calculates the distances (distances in the X-axis direction) between the nozzle of the replaced head module and the nozzles of the adjacent head modules.

Next, the system controller 100 calculates the amount ΔX of correction of the mounting position, which is required to mount the replaced head module M(N) at a normal mounting position, based on the information about the obtained distances X(N−1) and X(N+1). Further, the system controller 100 displays information about the calculated amount ΔX of correction on the display unit 104.

An operator corrects the position of the replaced head module M(N) according to the display of the display unit 104. That is, the operator finely adjusts the position of the head module M(N) by rotating an eccentric roller 248 of the replaced head module M(N).

Work for replacing the head module is completed by a series of work that has been described above.

As described above, by the method of replacing the head module of this embodiment as well, it is possible to obtain the amount of correction of the mounting position, which is required to mount the replaced head module M(N) at a normal position, without the printing of a test pattern or the like. Accordingly, it is possible to replace the head module in a short time.

Further, according to the method of replacing the head module of this embodiment, it is possible to obtain the amount of correction of the mounting position, which is required to mount the replaced head module at a normal mounting position, without acquiring the information about the positions of the nozzles of each head module on the base frame in advance.

Meanwhile, as described above, in the method of replacing the head module of this embodiment, it is possible to obtain the amount of correction of the mounting position, which is required to mount the replaced head module at a normal mounting position, without acquiring the information about the positions of the nozzles of each head module on the base frame in advance. Accordingly, the method can also be applied to the positioning of each head module when the inkjet head is assembled. That is, the positions of the nozzles of each head module on the base frame can be obtained through the acquisition of the information about the position of the X-axis positioning reference pin, the information about the position of the head module relative to the X-axis positioning reference pin, and the information about the positions of the nozzles of the head module. Accordingly, it is possible to position each head module by obtaining the positions of the nozzles of each head module on the base frame through the acquisition of these kinds of information.

Meanwhile, even when the head module is replaced by the method of this embodiment, processing for confirming whether or not the replaced head module M(N) is mounted at a normal mounting position (for example, processing for printing a test pattern and detecting the positions of the nozzles) may be performed as in the replacing method of the above-mentioned embodiment.

Other Embodiments

Since the nozzles are arranged in a line on the nozzle face of each head module in the above-mentioned embodiment, one nozzle array is formed when the respective head modules are joined. However, the nozzles may be arranged in the form of a matrix.

Figure 20:
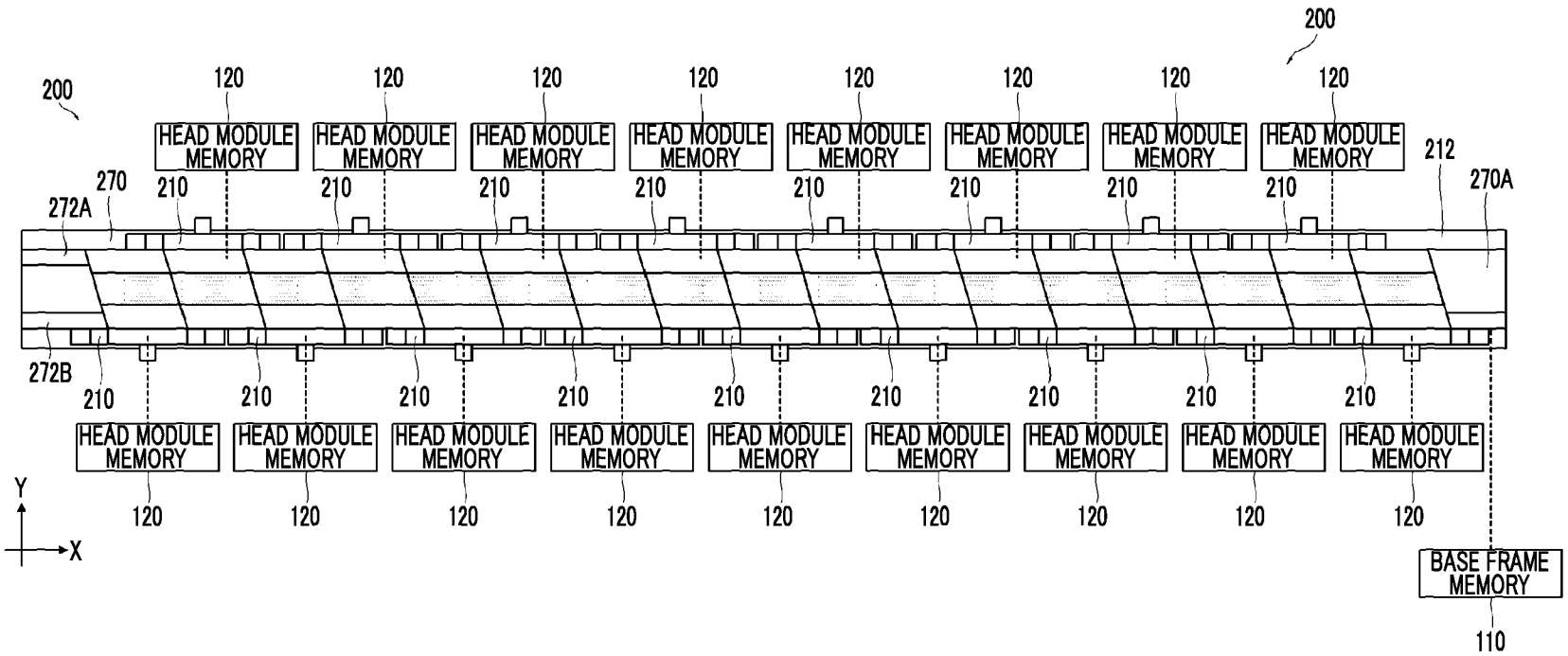
FIG. 20 is a bottom view showing an example of an inkjet head in which nozzles are arranged in the form of a matrix.
Figure 21:
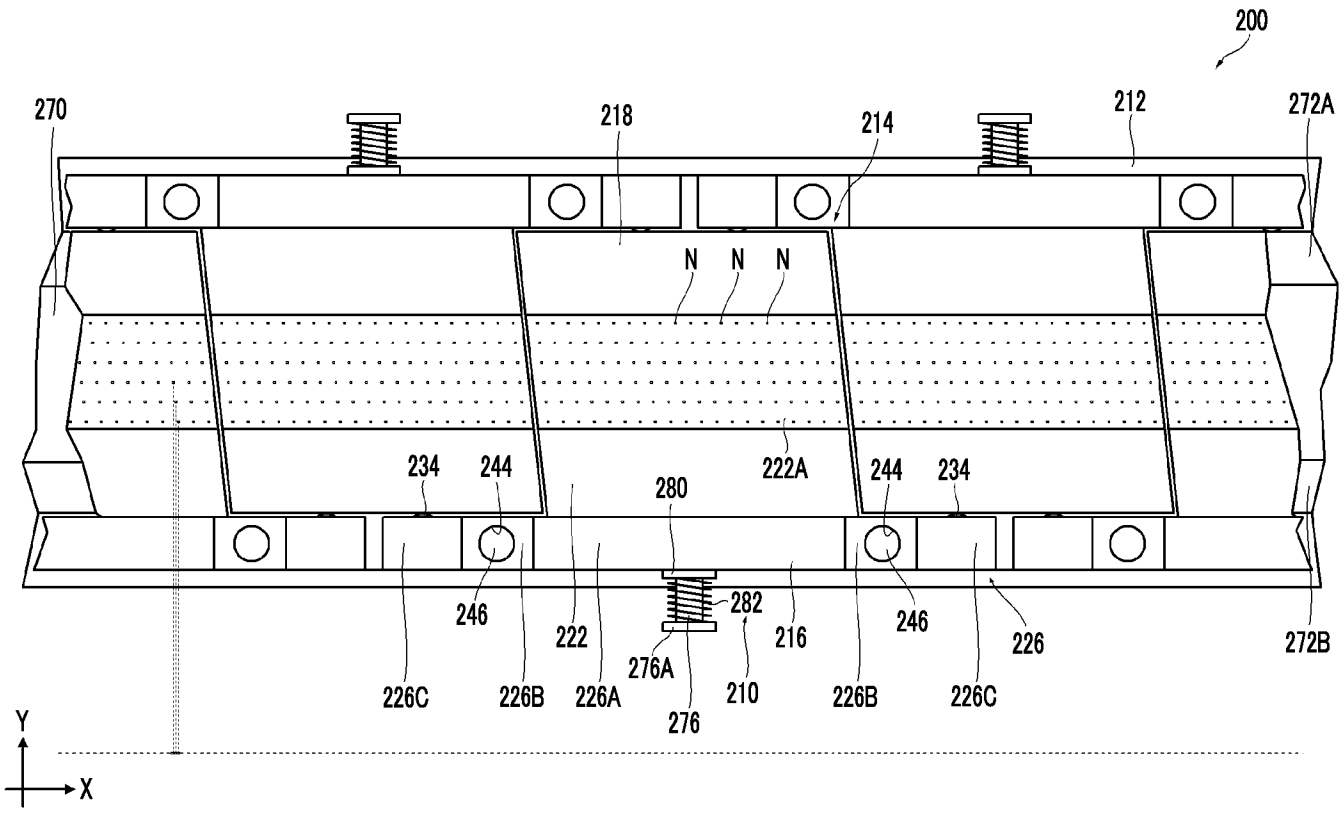
FIG. 21 is an enlarged view of a part of the inkjet head shown in FIG. 20.

FIG. 20 is a bottom view showing an example of an inkjet head in which nozzles are arranged in the form of a matrix, and FIG. 21 is an enlarged view of a part of the inkjet head.

As shown in FIGS. 20 and 21, nozzles N are arranged in the form of a matrix in the nozzle area 222A of the nozzle face 222. In more detail, as shown in FIG. 21, the nozzles N are arranged at a certain pitch in the X-axis direction (a row direction), and the nozzles N are arranged at a certain pitch in the direction of a line, which is inclined with respect to the X-axis by a predetermined angle, (a column direction).

Since the nozzles N are arranged as described above, a substantial interval between the nozzles N, which is projected in the X-axis direction, can be reduced.

Figure 22:
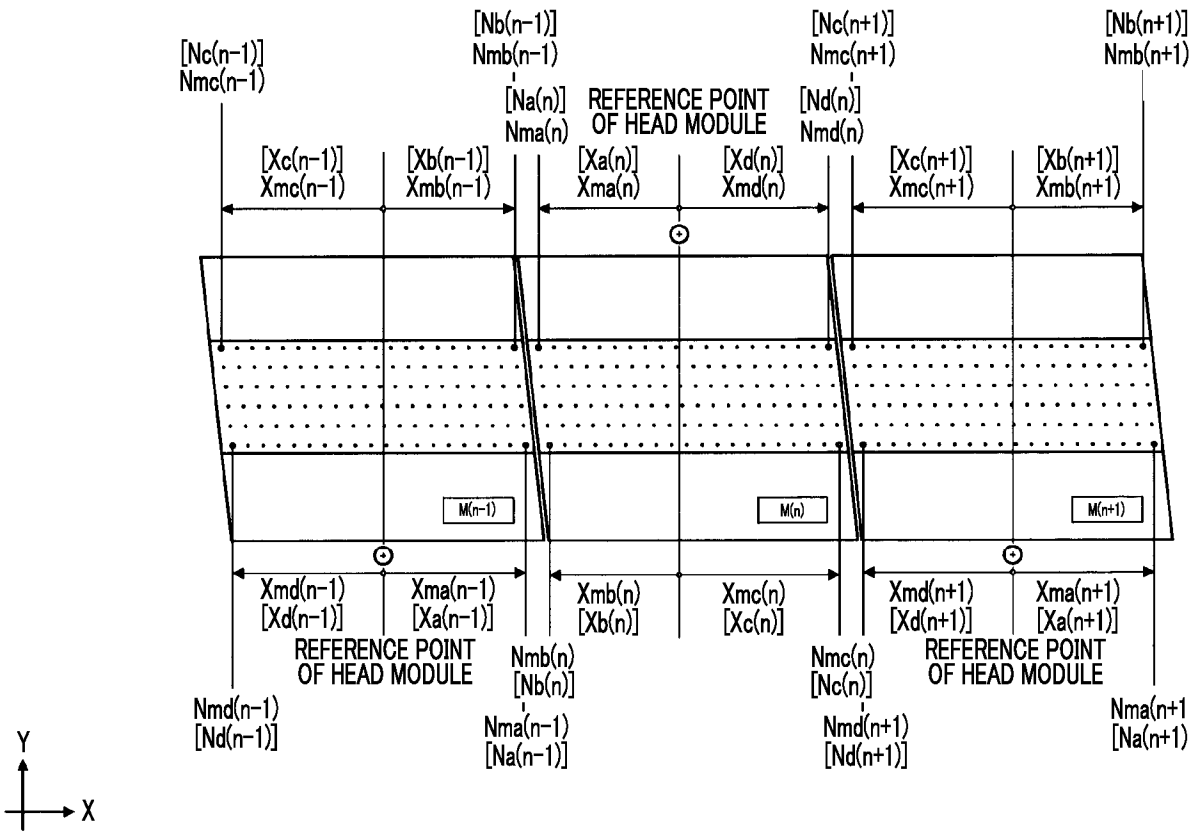
FIG. 22 is a schematic view showing the concept of the positions of nozzles of an inkjet head in which the nozzles are arranged in the form of a matrix.

Meanwhile, when the nozzles N are arranged in the form of a matrix as described above, for example, information about the positions of nozzles Nma(n), Nmb(n), Nmc(n), and Nmd (n) disposed at four corners as shown in FIG. 22 is used as the information about the positions of the nozzles that is to be stored in the head module memory 120.

In this case, the positions Xmb(n), Xmb(n), Xmc(n), and Xmd(n) of the nozzles Nma(n), Nmb(n), Nmc(n), and Nmd (n) disposed at the four corners are acquired as distances (distances in the X-axis direction) between a reference point, which is set at the head module 210, and the respective nozzles Nma(n), Nmb(n), Nmc(n), and Nmd(n).

Further, for example, the eccentric roller 248 is used as the reference point of the head module 210 and the position of a contact point between the eccentric roller 248 and the X-axis positioning reference pin 296 is set at the specific reference point (the reference point is set at the position of a contact point between the eccentric roller 248 and the X-axis positioning reference pin 296 when the eccentric roller 248 corresponds to a middle value (±0) of an adjustable range of displacement).

Furthermore, in order to obtain the amount of correction of the mounting position, for example, distances between the nozzles, which are disposed at the four corners of the replaced head module, and nozzles, which are adjacent to the nozzles, are obtained and the amount of correction is calculated so that each of the obtained distances is within an allowable range.

For example, when a head module to be replaced is denoted by M(N) and nozzles disposed at the four corners of the head module are denoted by Na(N), Nb(N), Nc(N), and Nd(N), a distance between the nozzle Na(N) and a nozzle Nb(N−1) of an adjacent head module M(N−1) is obtained in regard to the nozzle Na(N). Further, a distance between the nozzle Nb(N) and a nozzle Na(N−1) of the adjacent head module M(N−1) is obtained in regard to the nozzle Nb(N). Furthermore, a distance between the nozzle Nc(N) and a nozzle Nd(N+1) of an adjacent head module M(N+1) is obtained in regard to the nozzle Nc(N). Moreover, a distance between the nozzle Nd(N) and a nozzle Nc(N+1) of the adjacent head module M(N+1) is obtained in regard to the nozzle Nd(N). Further, the amount ΔX of correction of the mounting position, which is required to mount the replaced head module M(N) at a normal mounting position, is calculated based on information about each of the obtained distances.

Meanwhile, information about the positions of the nozzles disposed at the four corners is used in the embodiment, but a distance between the replaced head module and an adjacent head module can be obtained if information about at least two positions is obtained.

Further, even when information about the positions of the nozzles disposed at the four corners is used, a distance between the replaced head module and a head module, which is adjacent to the replaced head module, can be obtained in the following manner.

For example, when the replaced head module is denoted by M(N), information about the positions Xa(N) and Xb(N) of two nozzles Na(N) and Nb(N) positioned at one (left) end portion of the head module M(N) is acquired first. Then, an intermediate position XL(N) between the two nozzles Na(N) and Nb(N) is obtained. Information about the positions Xc(N) and Xd(N) of two nozzles Nc(N) and Nd(N) positioned at the other (right) end portion of the replaced head module M(N) is acquired likewise. Then, an intermediate position XR(N) between the two nozzles Nc(N) and Nd(N) is obtained.

The obtained intermediate positions XL(N) and XR(N) between the nozzles, which are disposed at the left and right ends, are defined as the positions of the nozzles that are disposed at both ends of the replaced head module M(N).

Next, information about the positions Xa(N−1) and Xb(N−1) of the two nozzles Na(N−1) and Nb(N−1), which are positioned at one (right) end portion of a head module M(N−1) adjacent to one side (left side) of the replaced head module M(N), is acquired. Then, an intermediate position XR(N−1) between the two nozzles Na(N−1) and Nb(N−1) is obtained.

The obtained intermediate position XR(N−1) between the nozzles is defined as the position of the nozzle that is disposed at one (right) end portion of the head module M(N−1) adjacent to one side (left side) of the replaced head module M(N).

Information about the positions Xc(N+1) and Xd(N+1) of the two nozzles Nc(N+1) and Nd(N+1) positioned at one (left) end portion of the head module M(N+1) adjacent to one side (right side) of the replaced head module M(N) is acquired likewise. Then, an intermediate position XL(N+1) between the two nozzles Nc(N+1) and Nd(N+1) is obtained.

The obtained intermediate position XL(N+1) between the nozzles is defined as the position of the nozzle that is disposed at one (left) end portion of the head module M(N+1) adjacent to one side (right side) of the replaced head module M(N).

Next, distances between the replaced head module and the head modules M(N−1) and M(N+1), which are adjacent to the replaced head module M(N), are obtained based on information about the positions XL(N) and XR(N) between the nozzles, which are disposed at both ends of the replaced head module M(N) and information about the positions XR(N−1) and XL(N+1) of the nozzles of the adjacent head modules M(N−1) and M(N+1).

As described above, the positions of the nozzles, which are disposed at both ends, are virtually obtained from the information about the positions of the nozzles disposed at the four corners and a distance between the head modules can be obtained based on the obtained positions.

<<Calibration 1 of Position Detecting Device>>

The inkjet head 200 of this embodiment is provided with the position detecting device to detect the position of the head module 210 that is mounted on the base frame 212. The position detecting device includes the magnet 260 and the magnetic sensor 298, and the magnet 260 and the magnetic sensor 298 are separately provided. That is, the magnet 260 is provided in the head module 210 and the magnetic sensor 298 is provided on the base frame 212.

Since the head module 210 of the inkjet head 200 of this embodiment is standardized as described above, every head module can also be mounted at every position. For this reason, the combination of the magnetic sensor 298 and the magnet 260 is not uniquely determined Meanwhile, when the head module 210 is moved (movement in the X-axis direction), a value output from the magnetic sensor 298, that is to say, the sensitivity (gain) of the magnetic sensor 298 changes according to the combination of the magnetic sensor 298 and the magnet 260.

Examples of a factor, which causes the sensitivity of the magnetic sensor 298 to change, include an individual difference in the output of the magnetic sensor 298, an individual difference in the magnetic force of the magnet 260, the deviations of the mounting positions of the magnetic sensor 298 and the magnet 260 (for example, deviations in the Y-axis direction and the Z-axis direction), and the like. Accordingly, even when the magnetic sensor 298 and the magnet 260 are used in the form of an arbitrary combination, the magnetic sensor 298 can be used at a certain sensitivity after the correction of the sensitivity of the magnetic sensor 298 if information about the magnetic sensor 298 and the magnet 260 can be acquired.

A method of correcting the sensitivity of the magnetic sensor 298 will be described below.

As described above, the base frame 212 on which the magnetic sensor 298 is mounted is provided with the base frame memory 110 (first storage device). Information, which is required to correct the sensitivity of the respective magnetic sensors 298 provided on the base frame 212, (first sensor-sensitivity-correction information) is stored in the base frame memory 110 in association with information about the installation positions of the magnetic sensors 298.

Meanwhile, each head module 210 on which the magnet 260 is mounted is provided with the head module memory 120 (the second storage device). Information about the correction of the sensitivity of the magnetic sensor 298, which is required when the magnet 260 mounted on the head module 210 is used, (second sensor-sensitivity-correction information) is stored in the head module memory 120.

When the head module 210 is mounted on the base frame 212, the system controller 100 reads the first sensor-sensitivity-correction information from the base frame memory 110. Further, the system controller 100 reads the second sensor-sensitivity-correction information from the head module memory 120. Then, the system controller 100 corrects the sensitivity of the magnetic sensor 298 based on the first sensor-sensitivity-correction information and the second sensor-sensitivity-correction information having been read.

Figure 23:
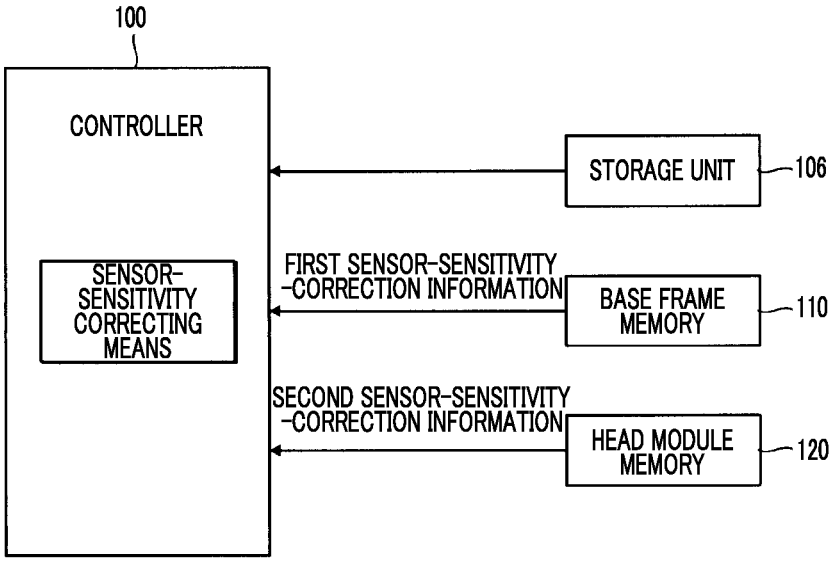
FIG. 23 is a functional block diagram of the system controller when the system controller functions as a sensor-sensitivity correcting device.

That is, as shown in FIG. 23, the system controller 100 functions as a sensor-sensitivity correcting device by executing a predetermined control program, and corrects the sensitivity of the magnetic sensor 298 based on the first sensor-sensitivity-correction information that is acquired from the base frame memory 110 and the second sensor-sensitivity-correction information that is acquired from the head module memory 120.

Accordingly, even when the magnetic sensor 298 and the magnet 260 are used in the form of an arbitrary combination, the magnetic sensor 298 can be used after the sensitivity of the magnetic sensor 298 is corrected to become a certain sensitivity.

Here, individual information about the output of the magnetic sensor 298 (individual data of detection sensitivity (gain)), information about the mounting position of the magnetic sensor 298, and the like are stored as the first sensor-sensitivity-correction information.

Meanwhile, information about the magnetic force as individual information about the magnet 260, information about the mounting position of the magnet 260, and the like are stored as the second sensor-sensitivity-correction information.

For example, when information about the mounting position of the magnetic sensor 298 is recorded as sensor-side correction information and information about the mounting position of the magnet 260 is recorded as magnet-side correction information, it is possible to obtain the deviations of the mounting positions of the magnetic sensor 298 and the magnet 260 (the degree of the deviation in a deviation direction). Further, since the amount of correction of the sensitivity of the magnetic sensor 298 is known when the deviations of the mounting positions of the magnetic sensor 298 and the magnet 260 are known, the system controller 100 corrects the sensitivity of the magnetic sensor 298 based on the deviations of the mounting positions of the magnetic sensor 298 and the magnet 260.

Likewise, when individual information about the output of the magnetic sensor 298 is known, it is possible to correct an output difference caused by an individual difference. Accordingly, when individual information about the magnetic sensor 298 (individual data of detection sensitivity (gain)) is stored as the sensor-side correction information, the system controller 100 reads the information and corrects the sensitivity of the magnetic sensor 298.

Furthermore, when the magnetic force of the magnet 260 is known, it is possible to correct the sensitivity of the magnetic sensor 298 according to the magnetic force of the magnet 260. Accordingly, when information about the magnetic force of the magnet 260 is stored as the magnet-side correction information, the system controller 100 reads the information and corrects the sensitivity of the magnetic sensor 298.

Since the magnetic sensor 298 and the magnet 260 individually have information that is required to correct the sensitivity of the magnetic sensor 298 as described above, the magnetic sensor 298 can be used after the sensitivity of the magnetic sensor 298 is corrected to become a certain sensitivity even when the magnetic sensor 298 and the magnet 260 are used in the form of an arbitrary combination.

Meanwhile, if information, which is to be recorded in the base frame memory 110 and the head module memory 120, is information effective in correcting the sensitivity of the magnetic sensor 298, the kinds and the like of the information are not particularly limited. For example, information about the correction of the sensitivity of the magnetic sensor 298 according to temperature other than the above-mentioned information can be stored in the base frame memory 110. That is, since the sensitivity of the magnetic sensor may change according to temperature or the mounting position of the magnetic sensor may change, information about the correction of the sensitivity of the magnetic sensor according to temperature may be stored and the sensitivity of the magnetic sensor may be appropriately corrected according to the change of ambient temperature. Since the magnetic force of the magnet 260 may change according to temperature or the mounting position of the magnet 260 may change likewise, information about the correction of the sensitivity of the magnetic sensor according to temperature may be stored in the head module memory 120 and the sensitivity of the magnetic sensor may be appropriately corrected according to the change of ambient temperature.

Meanwhile, in this case, the inkjet head is provided with a temperature sensor as a temperature detecting device in order to acquire temperature information. The temperature sensor is provided on each magnetic sensor, and measures the ambient temperature of each magnetic sensor 298. Meanwhile, when there is no deviation in the temperature distribution in one inkjet head, a temperature sensor is installed at one point on the base frame 212 and the temperature measured by the temperature sensor may be defined as the ambient temperature of each magnetic sensor. Alternatively, an area to be measured is divided into a plurality of areas and temperature may be measured in each of the areas.

<<Calibration 2 of Position Detecting Device>>

In this method, the sensitivity of the magnetic sensor 298 and the sensitivity of the magnet 260 are measured in advance by dedicated measuring jigs, and the sensitivity of the magnetic sensor is set based on the obtained sensitivity data of the magnetic sensor 298, the obtained sensitivity data of the magnet 260, and the data of the measuring jigs.

A method of setting the sensitivity of the magnetic sensor 298 by this method will be described below.

First, a measuring jig (magnet-sensitivity measuring jig) for measuring the sensitivity of the magnet 260 and a measuring jig (magnetic sensor-sensitivity measuring jig) for measuring the sensitivity of the magnetic sensor 298 are prepared.

The magnet-sensitivity measuring jig (detection target member-sensitivity measuring jig) is formed of, for example, the base frame provided with a magnetic sensor serving as a reference. Further, the magnetic sensor-sensitivity measuring jig (sensor-sensitivity measuring jig) is formed of, for example, the head module provided with a magnet serving as a reference.

Furthermore, a master and a copy of the magnet-sensitivity measuring jig are prepared. The master is a first magnet-sensitivity measuring jig A1 (first detection target member-sensitivity measuring jig), and the copy thereof is a second magnet-sensitivity measuring jig A2 (second detection target member-sensitivity measuring jig).

A master and a copy of the magnetic sensor-sensitivity measuring jig are also prepared likewise. The master is a first magnetic sensor-sensitivity measuring jig B1 (first sensor-sensitivity measuring jig), and the copy is a second magnetic sensor-sensitivity measuring jig B2 (second sensor-sensitivity measuring jig).

<Acquisition of Jig Data>

First, sensitivity data is acquired by using the first magnet-sensitivity measuring jig A1 and the first magnetic sensor-sensitivity measuring jig B1. That is, the first magnet-sensitivity measuring jig A1 and the first magnetic sensor-sensitivity measuring jig B1 are combined with each other to acquire the sensitivity data of the magnetic sensor of the first magnet-sensitivity measuring jig A1. The acquired data is defined as reference data ST.

Next, sensitivity data is acquired by using the first magnetic sensor-sensitivity measuring jig B1 and the second magnet-sensitivity measuring jig A2. That is, the first magnetic sensor-sensitivity measuring jig B1 and the second magnet-sensitivity measuring jig A2 are combined with each other to acquire the sensitivity data of the magnetic sensor of the second magnet-sensitivity measuring jig A2. The acquired data is defined as characteristic data AT of the second magnet-sensitivity measuring jig A2.

Next, sensitivity data is acquired by using the first magnet-sensitivity measuring jig A1 and the second magnetic sensor-sensitivity measuring jig B2. That is, the first magnet-sensitivity measuring jig A1 and the second magnetic sensor-sensitivity measuring jig B2 are combined with each other to acquire the sensitivity data of the magnetic sensor of the first magnet-sensitivity measuring jig A1. The acquired data is defined as characteristic data BT of the second magnetic sensor-sensitivity measuring jig B2.

<Measurement Using Jig (Copy)>

Next, the sensitivity data of the magnet 260 of the head module 210 is acquired by using the second magnet-sensitivity measuring jig A2. The acquired data is defined as temporary sensitivity data MM (temporary) of the magnet 260 of the head module.

Processing for acquiring the temporary sensitivity data MM (temporary) of the magnet 260 is performed, for example, during the manufacture of the head module 210.

Next, the sensitivity data of the magnetic sensor 298 provided on the base frame 212 is acquired by using the second magnetic sensor-sensitivity measuring jig B2. The acquired data is defined as temporary sensitivity data MS (temporary) of the magnetic sensor 298 provided on the base frame 212.

Processing for acquiring the temporary sensitivity data MS (temporary) of the magnetic sensor 298 is performed, for example, during the manufacture of the base frame 212.

<Generation of Sensitivity Information>

Next, the temporary sensitivity data MM (temporary) of the magnet 260 of the head module 210 is corrected based on the reference data ST and the characteristic data AT of the second magnet-sensitivity measuring jig A2. When corrected sensitivity data is denoted by MM, correction is calculated by the following expression.

$$MM = MM(\text{temporary}) * ST/AT$$

The corrected sensitivity data MM is stored in the head module memory 120 as magnet-sensitivity information (detection target member-sensitivity information).

Next, the temporary sensitivity data MS (temporary) of the magnetic sensor 298 provided on the base frame 212 is corrected based on the reference data ST and the characteristic data BT of the second magnetic sensor-sensitivity measuring jig B2.

When corrected sensitivity data is denoted by MS, correction is calculated by the following expression.

$$MS = MS(\text{temporary}) * ST/BT$$

The corrected sensitivity data MS is stored in the base frame memory 110 as magnetic sensor-sensitivity information.

<Setting of Sensor Sensitivity>

Figure 24:
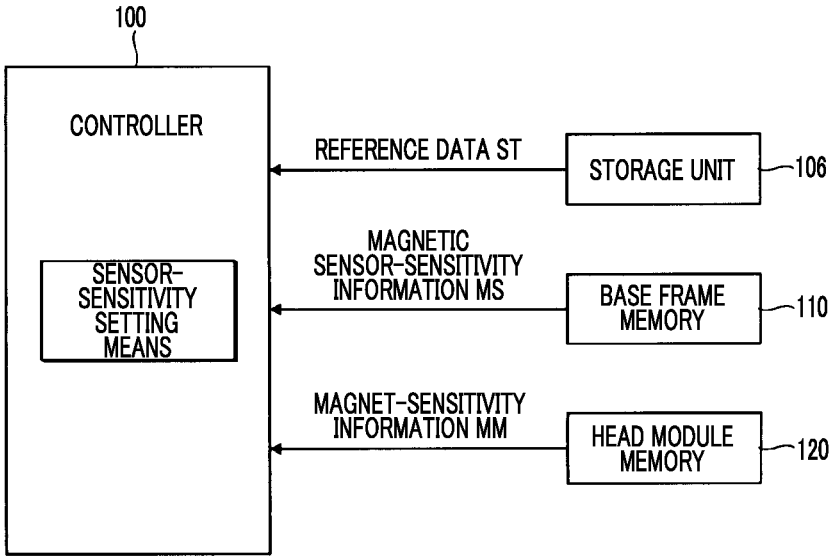
FIG. 24 is a functional block diagram of the system controller when the system controller functions as a sensor-sensitivity setting device.

When the replacement of the head module 210 is performed, the system controller 100 acquires the magnetic sensor-sensitivity information MS and the magnet-sensitivity information MM and sets the sensitivity of the magnetic sensor 298 that measures the displacement of the replaced head module 210. That is, as shown in FIG. 24, the system controller 100 functions as a sensor-sensitivity setting device. The system controller 100 functions as the sensor-sensitivity setting device by executing a predetermined control program, and sets the sensitivity of the magnetic sensor 298 that measures the displacement of the replaced head module 210 based on the magnetic sensor-sensitivity information MS, the magnet-sensitivity information MM, and the reference data ST. This processing is performed in the following manner.

First, the system controller 100 acquires the magnet-sensitivity information MM from the head module memory 120 of the replaced head module 210.

Next, the system controller 100 acquires the magnetic sensor-sensitivity information MS of the magnetic sensor 298, which corresponds to the replaced head module 210, from the base frame memory 110 provided on the base frame 212.

After that, the system controller 100 generates sensitivity data MC of the magnetic sensor 298, which corresponds to the replaced head module 210, based on the obtained magnetic sensor-sensitivity information MS and the obtained magnet-sensitivity information MM. The sensitivity data MC is calculated by the following expression.

$$MC=MM+MS-ST$$

That is, the system controller 100 generates the sensitivity data MC, which is to be actually used, by adding the magnet-sensitivity information MM to the magnetic sensor-sensitivity information MS and subtracting the reference data ST from the sum of the two kinds of information.

Since the sensitivity of the magnetic sensor 298 to be actually used is set in this way, it is possible to suppress the variation of the sensitivity of magnetic sensor 298 caused by a difference in the combination of the magnet 260 and the magnetic sensor 298. Accordingly, it is possible to perform position detection (detection of displacement) with high accuracy.

Meanwhile, the reference data ST is acquired in advance by the system controller. For example, the reference data ST is stored in the storage unit 106 and the system controller 100 reads and acquires the reference data ST from the storage unit 106 during the calculation of the sensitivity data MC.

The sensitivity data MC of the magnetic sensor 298 can be acquired as described above, but it is possible to perform position detection with higher accuracy by further correcting the acquired sensitivity data MC according to temperature.

In the correction according to temperature, for example, a predetermined temperature correction function is prepared and the sensitivity data MC is multiplied by a temperature correction coefficient, which is calculated by the temperature correction function, to correct the sensitivity data MC. Alternatively, a predetermined table is prepared, a temperature correction coefficient is acquired with reference to the table, and the sensitivity data MC is multiplied by the acquired temperature correction coefficient to correct the sensitivity data MC.

<<Other Examples of Displacement Detecting Device>>

A structure, such as a laser distance sensor, an infrared distance sensor, or an eddy current sensor, other than the above-mentioned magnetic sensor can be used as the position detecting device of the head module mounted on the base frame.

<Laser Distance Sensor>

When a laser distance sensor is used, for example, the laser distance sensor is provided on the base frame 212 and a detection object for the laser distance sensor (an object to be irradiated with laser beams) is provided on the head module 210.

It is preferable that the correction of the sensitivity of the sensor or the setting of the sensitivity of the sensor is performed as in the case of the magnetic sensor even when the laser distance sensor is used. That is, since the laser distance sensor also has an individual difference in the output thereof like the magnetic sensor, each laser distance sensor includes a memory (sensor-side storage device) and information required to correct sensitivity (sensor-side correction information) is stored in the memory. For example, individual information about the laser distance sensor (individual data of detection sensitivity (gain)), information about the mounting position of the laser distance sensor, and the like are stored as the sensor-side correction information. Since the sensitivity of the sensor also changes according to the reflectance or the ambient brightness, the ambient temperature, or the like of the detection object, the detection object also includes a memory (detection object-side storage device) and information about the correction of the sensitivity of the laser distance sensor, which is required for detection using the detection object, (detection object-side correction information) is stored in the memory. For example, information about the reflectance, the ambient brightness, the ambient temperature, and the mounting position of the detection object, and the like are stored as the detection object-side correction information. Accordingly, even though the laser distance sensor and the detection object may be used in the form of any combination, the laser distance sensor can be used after the sensitivity of the laser distance sensor is corrected to become a certain sensitivity.

<Infrared Distance Sensor>

When an infrared distance sensor is used, for example, the infrared distance sensor is provided on the base frame 212 and a detection object for the infrared distance sensor (an object to be irradiated with infrared rays) is provided on the head module 210.

It is preferable that the correction of the sensitivity of the sensor or the setting of the sensitivity of the sensor is performed as in the case of the magnetic sensor even when the infrared distance sensor is used. That is, since the infrared distance sensor also has an individual difference in the output thereof like the magnetic sensor, each infrared distance sensor includes a memory (sensor-side storage device) and information required to correct sensitivity (sensor-side correction information) is stored in the memory. For example, individual information about the infrared distance sensor (individual data of detection sensitivity (gain)), information about the mounting position of the infrared distance sensor, and the like are stored as the sensor-side correction information. Since the sensitivity of the sensor also changes according to the reflectance or the ambient temperature of the detection object, the temperature of the detection object, the color or the ambient brightness of the detection object, or the like, the detection object also includes a memory (detection object-side storage device) and information about the correction of the sensitivity of the infrared distance sensor, which is required for detection using the detection object, (detection object-side correction information) is stored in the memory. For example, information about the surface roughness, the reflectance, or the ambient temperature of the detection object, the temperature of the detection object, the color and the ambient brightness of the detection object, and the like are stored as the detection object-side correction information. Accordingly, even though the infrared distance sensor and the detection object may be used in the form of any combination, the infrared distance sensor can be used after the sensitivity of the infrared distance sensor is corrected to become a certain sensitivity.

<Eddy Current Sensor>

When an eddy current sensor is used, for example, the eddy current sensor is provided on the base frame 212 and a detection object for the eddy current sensor is provided on the head module 210.

It is preferable that the correction of the sensitivity of the sensor or the setting of the sensitivity of the sensor is performed as in the case of the magnetic sensor even when the eddy current sensor is used. That is, since the eddy current sensor also has an individual difference in the output thereof like the magnetic sensor, each eddy current sensor includes a memory (sensor-side storage device) and information required to correct sensitivity (sensor-side correction information) is stored in the memory. For example, individual information about the eddy current sensor (individual data of detection sensitivity (gain)), information about the mounting position of the eddy current sensor, and the like are stored as the sensor-side correction information. Since the sensitivity of the sensor also changes according to the conductivity or the magnetic permeability of the detection object, the temperature of the detection object, or the like, the detection object also includes a memory (detection object-side storage device) and information about the correction of the sensitivity of the eddy current sensor, which is required for detection using the detection object, (detection object-side correction information) is stored in the memory. For example, information about the conductivity or the magnetic permeability of the detection object, the temperature and mounting position of the detection object, and the like are stored as the detection object-side correction information. Accordingly, even though the eddy current sensor and the detection object may be used in the form of any combination, the eddy current sensor can be used after the sensitivity of the eddy current sensor is corrected to become a certain sensitivity.

<Others>

In addition, a displacement detecting device configured to detect the displacement of the head module 210 has high resolution, and a small measurement instrument can be suitably used as the displacement detecting device.

<<Other Examples of X-Axis Mounting Position Adjusting Device>>

The X-axis mounting position adjusting device (mounting position adjusting device) of the embodiment has been adapted so that the eccentric roller 248 is manually rotated, but an actuator can be mounted on the head module 210 so as to rotate the eccentric roller 248 by electric power.

Figure 25:
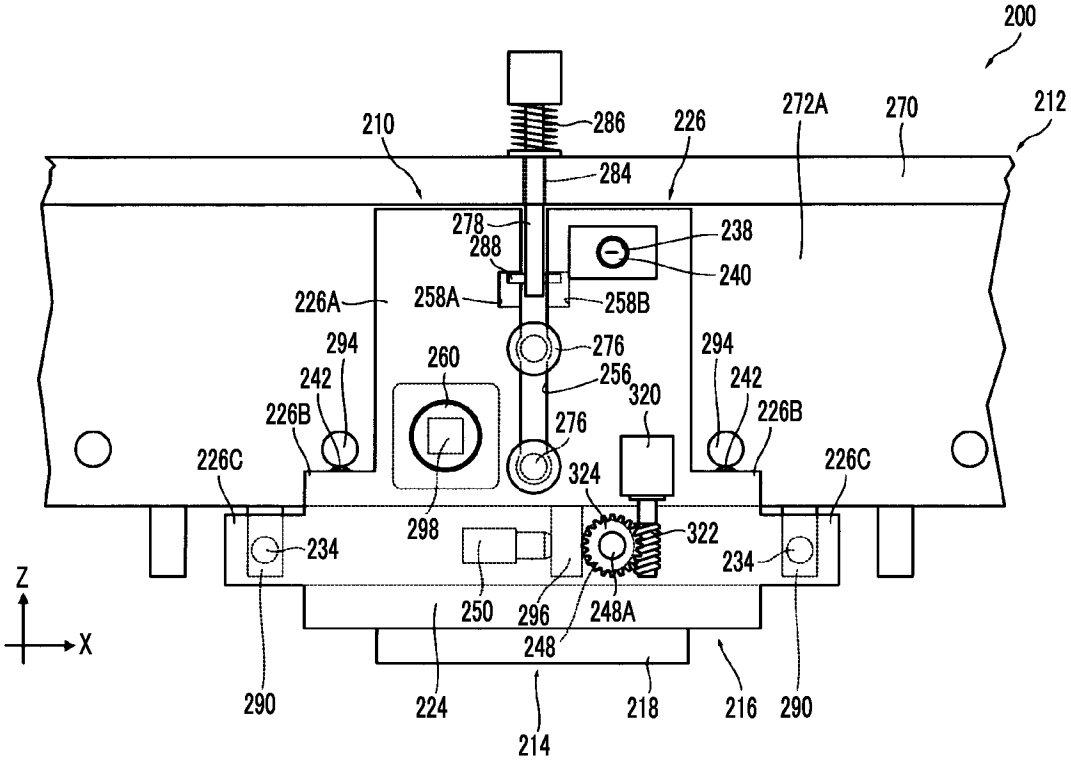
FIG. 25 is a front view showing another example of an X-axis mounting position adjusting device.

In an example shown in FIG. 25, a motor 320 is mounted on the head module 210 as the actuator for the eccentric roller 248. A screw gear (worm) 322 is connected to a drive shaft of the motor 320. A helical gear (worm wheel) 324 is connected to the shaft portion 248A of the eccentric roller 248. The screw gear 322 meshes with the helical gear 324. When the motor 320 is driven to rotate the screw gear 322, the helical gear 324 is rotated. As a result, the eccentric roller 248 is rotated.

As described above, the eccentric roller 248 can be adapted to be rotated by electric power. In this case, processing for positioning the head module 210 can be automatically performed. Further, even when a positional deviation, which is equal to or larger than an allowable positional deviation, occurs on the head module 210, correction processing can be automatically performed.

Meanwhile, the X-axis mounting position adjusting device includes the eccentric roller 248, the plunger 250, and the X-axis positioning reference pin 296 in the above-mentioned embodiment, but the structure of the X-axis mounting position adjusting device is not limited thereto. Alternatively, the X-axis mounting position adjusting device may be formed using, for example, a moving mechanism, such as a ball screw mechanism.

Other Embodiments

In the above-mentioned embodiment, the eccentric roller 248 and the plunger 250 have been provided in the head module 210 and the X-axis positioning reference pin 296 has been provided on the base frame 212. However, the eccentric roller 248 and the plunger 250 may be provided on the base frame 212 and the X-axis positioning reference pin 296 may be provided in the head module 210.

Further, in the above-mentioned embodiment, the magnetic sensor 298 has been provided on the base frame 212 and the magnet 260 has been provided in the head module 210. However, the magnetic sensor 298 may be provided in the head module 210 and the magnet 260 may be provided on the base frame 212.

Furthermore, in the above-mentioned embodiment, a roller where the roller portion 248B and the shaft portion 248A are eccentrically disposed has been used as the eccentric roller 248. However, even when a roller of which a roller portion has an elliptical shape or the like is used, the same effects can be obtained.

Moreover, in the above-mentioned embodiment, the position of each X-axis positioning reference pin BP(n) relative to the middle X-axis positioning reference pin BP(9), which serves as a reference, has been specified. However, a point, which is used as a reference in order to obtain the position of each X-axis positioning reference pin BP(n), is not particularly limited to this point. The position of the X-axis positioning reference pin (BP(1) or BP(17)), which is positioned at a longitudinal end portion of the base frame, may be used as a reference. The same applies to a case in which the positions of the nozzles of each head module M(n) mounted on the base frame are to be obtained.

Further, the support reference point also has only to be a point that can be used to specify the position of the head module mounted on the base frame, and does not necessarily need to be set at the position of the X-axis positioning reference pin. As long as the positions of the nozzles can be specified if the positions of the nozzles provided on the head module are to be specified, a point serving as the reference can be arbitrarily determined.

Figure 26:
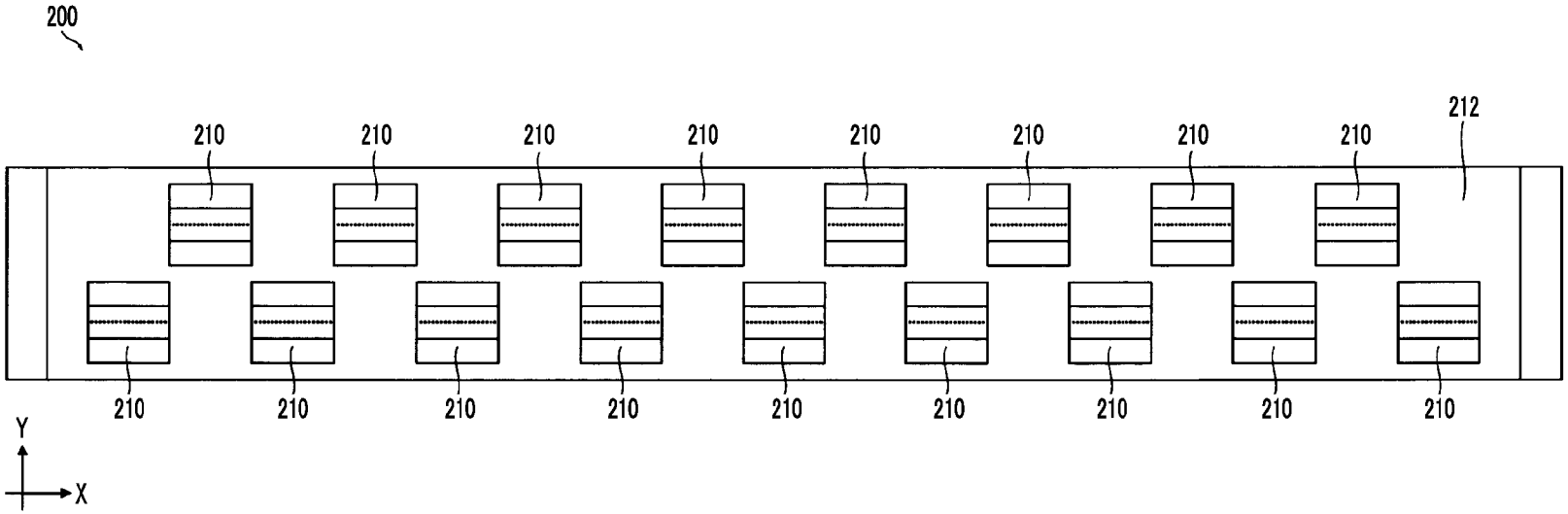
FIG. 26 is a bottom view showing another example of the inkjet head.

Furthermore, a case in which the invention is applied to the inkjet head in which the head modules are arranged on the same line has been described in the above-mentioned embodiment by way of example. However, the invention can also be applied to an inkjet head in which the head modules 210 are arranged in a zigzag pattern on the base frame 212 (an inkjet head in which the head modules 210 are alternately arranged in a line) as shown in FIG. 26.

Moreover, the information (third information) about the positions Xa(n) and Xb(n) of the nozzles of each head module M(n) on the base frame 212 has been stored in the storage unit 106 (third storage device) of the inkjet recording device 10 in the above-mentioned embodiment, but may be stored in the storage device provided on the base frame 212. In this case, the third information may be stored in the base frame memory 110 together with the information (first information) about the position XB(n) of each X-axis positioning reference pin provided on the base frame 212, or may be stored in a storage device that is separately provided. For example, a first base frame memory and a second base frame memory may be provided on the base frame 212, the information (first information) about the position XB(n) of each X-axis positioning reference pin provided on the base frame 212 may be stored in the first base frame memory, and the information (third information) about the positions Xa(n) and Xb(n) of the nozzles of each head module M(n) on the base frame 212 may be stored in the second base frame memory.

EXPLANATION OF REFERENCES

10: inkjet recording device

12: medium

20: medium conveying unit
22: motor
24: belt
30: head unit
32C, 32M, 32Y, 32K: inkjet head
34: head unit body
40: maintenance station
42C, 42M, 42Y, 42K: cap unit
44: waste liquid tray
46: waste liquid tank
50: transfer unit
52: guide rail
54: slider
54A: female screw portion
56: drive unit
58: screw rod
60: motor
100: system controller
102: operation unit
104: display unit
106: storage unit
110: base frame memory
120: head module memory
200: inkjet head
210: head module
212: base frame
214: head
216: bracket
218: head body
220: electrical/pipe section
222: nozzle face
222A: nozzle area
222B: nozzle protection area
224: horizontal portion
224A: opening
226: vertical portion
226A: vertical portion body
226B: first protruding portion
226C: second protruding portion
228: pipe
230: cable
234: Y-axis head module stationary contact member
236: Y-axis head module movable contact member
238: Y-axis head module movable contact member-insertion hole
240: Y-axis head module movable contact member-position adjusting screw
242: Z-axis head module contact member
244: Z-axis head module contact member-insertion hole
246: Z-axis head module contact member-position adjusting screw
248: eccentric roller
248A: shaft portion
248B: roller portion
250: plunger
252: eccentric roller-mounting hole
254: leaf spring
256: guide groove
256A: large-diameter portion
258A, 258B: cutout portion
260: magnet
270: upper frame part
270A: gripper
272A: lower frame part (first lower frame part)
272B: lower frame part (second lower frame part)
276: Y-axis guide post
276A: flange portion
278: Z-axis suspension rod
278A: knob
280: Y-axis pressing plate
282: Y-axis pressing spring
284: Z-axis suspension rod-insertion hole
286: Z-axis pressing spring
288: locking bar
290: Y-axis base frame positioning members for stationary contact
292: Y-axis base frame positioning member for movable contact
294: Z-axis base frame contact member
296: X-axis positioning reference pin
298: magnetic sensor
300: magnetic sensor mounting portion
320: motor
322: screw gear
324: helical gear
N: nozzle

What is claimed is:

1. An inkjet recording device comprising:

an inkjet head including a base frame, a plurality of support devices that are provided on the base frame at regular intervals, a plurality of head modules that are joined in a line by being mounted on the base frame through the support devices, a plurality of position adjusting devices configured to individually adjust the positions of the head modules mounted on the base frame, and a plurality of position detecting devices configured to individually detect the positions of the head modules, which are mounted on the base frame, relative to support reference points that are set at the respective support devices and serve as references;

a first storage device which is provided on the base frame and in which information about the positions of the respective support reference points is stored;

second storage devices which are provided in the respective head modules and in which information about the positions of nozzles of the head modules is stored;

a third storage device in which information about the positions of the nozzles of the respective head modules mounted on the base frame is stored; and a position-correction-information generating device configured to generate information about the correction of a position, which is required to mount the replaced head module at a normal position, based on the information stored in the first storage device, the information stored in the second storage devices, and the information stored in the third storage device when the head module is replaced.

2. The inkjet recording device according to claim 1, wherein the position-correction-information generating device calculates the positions of nozzles of the replaced head module based on the information stored in the first storage device and the information stored in the second storage devices, acquires information about the positions of nozzles of the head modules adjacent to the replaced head module based on the information stored in the third storage device, and generates the information about the correction of the position, which is required to mount the replaced head module at the normal position, based on information about the positions of the nozzles of the replaced head module and the information about the positions of the nozzles of the head modules adjacent to the replaced head module.

3. The inkjet recording device according to claim 2, wherein the position-correction-information generating device calculates a distance between the nozzle positioned at a first end portion of the replaced head module and the nozzle positioned at an end portion, which faces the first end portion, of the head module adjacent to the first end portion of the replaced head module and a distance between the nozzle positioned at a second end portion, which is different from the first end portion, of the replaced head module and the nozzle positioned at an end portion, which faces the second end portion, of the head module adjacent to the second end portion of the replaced head module; and generates the information about the correction that allows the calculated distances to be within an allowable range.

4. The inkjet recording device according to claim 2, wherein the position-correction-information generating device calculates distances between the replaced head module and the adjacent head modules, and generates the information about the correction that allows the calculated distances to be within an allowable range.

5. The inkjet recording device according to claim 2, wherein the position-correction-information generating device calculates distances between the nozzles, which are disposed at four corners of the replaced head module, and the nozzles, which are adjacent to the nozzles disposed at the four corners, and generates the information about the correction that allows the calculated distances to be within an allowable range.

6. The inkjet recording device according to claim 1, further comprising:

a nozzle position calculating device configured to acquire information about the position of the replaced head module from the position detecting device after the position of the replaced head module is adjusted to the normal position, and calculating the positions of the nozzles of the replaced head module based on the acquired information, the information stored in the first storage device, and the information stored in the second storage devices; and an updating device configured to acquire information about the positions of the nozzles calculated by the nozzle position calculating device and updating the information stored in the third storage device.

7. The inkjet recording device according to claim 1, further comprising:

a nozzle position detecting device configured to detect the positions of the nozzles of the respective head modules mounted on the base frame; and an updating device configured to acquire the information about the positions of the nozzles of the respective head modules mounted on the base frame from the nozzle position detecting device after the position of the replaced head module is adjusted to the normal position, and updating the information stored in the third storage device.

8. The inkjet recording device according to claim 1, wherein:

the position detecting device includes a detection target member that is provided in the head module and a sensor that is provided on the base frame and detects the displacement of the detection target member, and the position detecting device detects the displacement of the detection target member by the sensor and detects the position of the head module relative to the support reference point that serves as a reference.

9. The inkjet recording device according to claim 8, wherein:

information, which is required to correct the sensitivity of the sensor when the sensor is used, is further stored in the first storage device as first sensor-sensitivity-correction information, information, which is required to correct the sensitivity of the sensor when the detection target member is used, is further stored in the second storage devices as second sensor-sensitivity-correction information, and the inkjet recording device further comprises a sensor-sensitivity correcting device configured to acquire the first sensor-sensitivity-correction information and the second sensor-sensitivity-correction information and correcting the sensitivity of the sensor.

10. The inkjet recording device according to claim 8, further comprising:

a first detection target member-sensitivity measuring jig that is used to measure the sensitivity of the detection target member;

a second detection target member-sensitivity measuring jig that is used to measure the sensitivity of the detection target member;

a first sensor-sensitivity measuring jig that is used to measure the sensitivity of the sensor;

a second sensor-sensitivity measuring jig that is used to measure the sensitivity of the sensor; and a sensor-sensitivity setting device configured to set the sensitivity of the sensor, wherein when sensitivity data, which is acquired by using the first detection target member-sensitivity measuring jig and the first sensor-sensitivity measuring jig, is defined as reference data ST, sensitivity data, which is acquired by using the first sensor-sensitivity measuring jig and the second detection target member-sensitivity measuring jig, is defined as characteristic data AT of the second detection target member-sensitivity measuring jig, sensitivity data, which is acquired by using the first detection target member-sensitivity measuring jig and the second sensor-sensitivity measuring jig, is defined as characteristic data BT of the second sensor-sensitivity measuring jig, sensitivity data of the detection target member, which is acquired by using the second detection target member-sensitivity measuring jig, is defined as temporary sensitivity data MM (temporary) of the detection target member, sensitivity data of the sensor, which is acquired by using the second sensor-sensitivity measuring jig, are defined as temporary sensitivity data MS (temporary) of the sensor, data, which is obtained by correcting the temporary sensitivity data MM (temporary) of the detection target member based on the reference data ST and the characteristic data AT, is defined as detection target member-sensitivity information MM, and data, which is obtained by correcting the temporary sensitivity data MS (temporary) of the sensor based on the reference data ST and the characteristic data BT, is defined as sensor-sensitivity information MS, the sensor-sensitivity information MS is further stored in the first storage device, the detection target member-sensitivity information MM is further stored in the second storage devices, and the sensor-sensitivity setting device acquires the sensor-sensitivity information MS from the first storage device, acquires the detection target member-sensitivity information MM from the second storage devices, and sets the sensitivity of the sensor based on the sensor-sensitivity information MS, the detection target member-sensitivity information MM, and the reference data ST.

11. The inkjet recording device according to claim 1, wherein:

the position adjusting device includes a positioning reference pin that is provided on the base frame, an eccentric roller that is provided on the head module, and a biasing device that is provided on the head module, is engaged with the positioning reference pin, and allows the eccentric roller to come into pressure contact with the positioning reference pin, and the position adjusting device moves the head module to the mounting position of the head module by rotating the eccentric roller that comes into pressure contact with the positioning reference pin.

12. A method of replacing a head module of an inkjet head, the inkjet head including a base frame, a plurality of support devices that are provided on the base frame at regular intervals, a plurality of head modules that are joined in a line by being mounted on the base frame through the support devices, a plurality of position adjusting devices configured to individually adjust the positions of the head modules mounted on the base frame, and a plurality of position detecting devices configured to individually detect the positions of the head modules, which are mounted on the base frame, relative to support reference points that are set at the respective support devices and serve as references, the method comprising:

a step of acquiring information about the position of the support reference point of the support device, which supports the replaced head module, as first information;

a step of acquiring information about the positions of nozzles of the replaced head module as second information;

a step of acquiring information about the positions of the nozzles of the respective head modules, which are mounted on the base frame, as third information;

a step of generating information about the correction of a position, which is required to mount the replaced head module at a normal position, based on the first information, the second information, and the third information; and a step of adjusting the position of the replaced head module according to the generated information about the correction of the position.

13. The method according to claim 12, wherein the step of generating the information about the correction calculates the positions of nozzles of the replaced head module based on the first information and the second information, acquires information about the positions of nozzles of the head modules adjacent to the replaced head module based on the third information, and generates the information about the correction of the position, which is required to mount the replaced head module at the normal position, based on information about the positions of the nozzles of the replaced head module and the information about the positions of the nozzles of the head modules adjacent to the replaced head module.

14. The method according to claim 13, wherein the step of generating the information about the correction includes a step of calculating a distance between the nozzle positioned at a first end portion of the replaced head module and the nozzle positioned at an end portion, which faces the first end portion, of the head module adjacent to the first end portion of the replaced head module and a distance between the nozzle positioned at a second end portion, which is different from the first end portion, of the replaced head module and the nozzle positioned at an end portion, which faces the second end portion, of the head module adjacent to the second end portion of the replaced head module, and a step of generating the information about the correction that allows the calculated distances to be within an allowable range.

15. The method according to claim 13, wherein the step of generating the information about the correction includes a step of calculating distances between the replaced head module and the adjacent head modules, and a step of generating the information about the correction that allows the calculated distances to be within an allowable range.

16. The method according to claim 12, wherein:

the base frame includes a first storage device in which information about the positions of the respective support reference points is stored, the respective head modules include second storage devices in which information about the positions of the nozzles of the head modules is stored, an inkjet recording device on which the inkjet head is mounted or the base frame includes a third storage device in which information about the positions of the nozzles of the respective head modules mounted on the base frame is stored, the first information is acquired from the first storage device, the second information is acquired from the second storage devices, and the third information is acquired from the third storage device.

17. The method according to claim 16, further comprising a step of acquiring information about the position of the replaced head module from the position detecting device after adjusting the position of the replaced head module according to the generated information about the correction of the position, calculating the positions of the nozzles of the replaced head module based on the acquired information, the information stored in the first storage device, and the information stored in the second storage devices, and updating the information, which is stored in the third storage device, with the calculated information.

18. The method according to claim 16, further comprising a step of detecting the positions of the nozzles of the respective head modules mounted on the base frame after adjusting the position of the replaced head module according to the generated information about the correction of the position, and updating the information, which is stored in the third storage device, with the detected information.

19. The method according to claim 16, further comprising, when the position detecting device includes a detection target member provided in the head module and a sensor provided on the base frame and detecting the displacement of the detection target member, detects the displacement of the detection target member by the sensor, and detects the position of the head module relative to the support reference point serving as a reference:

a step of acquiring information, which is required to correct the sensitivity of the sensor when the sensor is used, as first sensor-sensitivity-correction information;

a step of acquiring information, which is required to correct the sensitivity of the sensor when the detection target member is used, as second sensor-sensitivity-correction information; and a step of correcting the sensitivity of the sensor based on the first sensor-sensitivity-correction information and the second sensor-sensitivity-correction information.

20. The method according to claim 16, further comprising, when the position detecting device includes a detection target member provided in the head module and a sensor provided on the base frame and detecting the displacement of the detection target member, detects the displacement of the detection target member by the sensor, and detects the position of the head module relative to the support reference point serving as a reference:

a step of setting the sensitivity of the sensor, wherein the step of setting the sensitivity of the sensor includes a step of preparing a first detection target member-sensitivity measuring jig used to measure the sensitivity of the detection target member, a second detection target member-sensitivity measuring jig used to measure the sensitivity of the detection target member, a first sensor-sensitivity measuring jig used to measure the sensitivity of the sensor, and a second sensor-sensitivity measuring jig used to measure the sensitivity of the sensor, and acquiring reference data ST by acquiring sensitivity data by using the first detection target member-sensitivity measuring jig and the first sensor-sensitivity measuring jig, a step of acquiring characteristic data AT of the second detection target member-sensitivity measuring jig by acquiring sensitivity data by using the first sensor-sensitivity measuring jig and the second detection target member-sensitivity measuring jig, a step of acquiring characteristic data BT of the second sensor-sensitivity measuring jig by acquiring sensitivity data by using the first detection target member-sensitivity measuring jig and the second sensor-sensitivity measuring jig, a step of acquiring temporary sensitivity data MM (temporary) of the detection target member by acquiring sensitivity data of the detection target member by using the second detection target member-sensitivity measuring jig, a step of acquiring temporary sensitivity data MS (temporary) of the sensor by acquiring sensitivity data of the sensor by using the second sensor-sensitivity measuring jig, a step of acquiring detection target member-sensitivity information MM by correcting the temporary sensitivity data MM (temporary) of the detection target member based on the reference data ST and the characteristic data AT, a step of acquiring sensor-sensitivity information MS by correcting the temporary sensitivity data MS (temporary) of the sensor based on the reference data ST and the characteristic data BT, and a step of setting the sensitivity of the sensor based on the detection target member-sensitivity information MM, the sensor-sensitivity information MS, and the reference data ST.

* * * * *